US006770431B2

(12) United States Patent
Mizukawa et al.

(10) Patent No.: US 6,770,431 B2
(45) Date of Patent: Aug. 3, 2004

(54) SILVER HALIDE COLOR PHOTOSENSITIVE MATERIAL

(75) Inventors: Yuki Mizukawa, Minami-Ashigara (JP); Masaaki Tsukase, Minami-Ashigara (JP); Toshio Kawagishi, Minami-Ashigara (JP); Hiroshi Fukuzawa, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/329,466

(22) Filed: Dec. 27, 2002

(65) Prior Publication Data

US 2004/0101792 A1 May 27, 2004

(30) Foreign Application Priority Data

Dec. 28, 2001 (JP) ..... 2001-401228

(51) Int. Cl.[7] ..... G03C 1/08; G03C 7/26; G03C 7/32

(52) U.S. Cl. ..... 430/558; 430/543; 430/551

(58) Field of Search ..... 430/543, 558, 430/551

(56) References Cited

U.S. PATENT DOCUMENTS 4,835,094 A 5/1989 Wolff et al.
4,882,266 A 11/1989 Kawagishi et al.
5,272,049 A 12/1993 Sakanoue et al.
5,656,418 A * 8/1997 Nakamine et al. ..... 430/558
5,858,635 A * 1/1999 Nakamine et al. ..... 430/558
6,468,729 B2 10/2002 Shimura et al.
6,492,100 B2 * 12/2002 Mikoshiba et al. ..... 430/558

FOREIGN PATENT DOCUMENTS

EP 0 183 445 6/1986
EP 1 033 621 9/2000
JP 2000-267237 * 9/2000

* cited by examiner

*Primary Examiner*—Geraldine Letscher
(74) *Attorney, Agent, or Firm*—Sughrue Mion, PLLC

(57) ABSTRACT

A silver halide color photosensitive material comprising a 1H-pyrazolo[3,2-c]-1,2,4-triazole type coupler having, in its molecule, at least one substituent represented by the following general formula (I):

(I)

wherein $R_1$ represents a substituent; m represents an integer of 0 to 4; and $R_2$ represents an alkyl group, alkenyl group or aryl group.

14 Claims, No Drawings

SILVER HALIDE COLOR PHOTOSENSITIVE MATERIAL

CROSS-REFERENCE TO RELATED APPLICATIONS

This application is based upon and claims the benefit of priority from the prior Japanese Patent Application No. 2001-401228, filed December 28, 2001, the entire contents of which are incorporated herein by reference.

BACKGROUND OF THE INVENTION

1. Field of the Invention

The present invention relates to a novel color coupler compound, and relates to a silver halide color photosensitive material containing the novel color coupler compound and an image-forming method using the silver halide color photosensitive material. More particularly, the present invention relates to a silver halide color reversal photosensitive material and an image-forming method using the same.

2. Description of the Related Art

In recent years, the demands on silver halide color photosensitive materials for not only photographic speed increase, excellent sharpness and graininess but also faithful color reproduction to originals are strong.

In recent years, pyrazolotriazole couplers of low secondary absorption are in practical use as a magenta dye forming coupler. It has become apparent that pyrazolotriazole magenta couplers, although being compounds having excellent characteristics in hue, pose various problems such as low color-forming property, low resistance to processing variation and poor color image storability.

For example, couplers wherein the position for coupling with an oxidized aromatic primary amine developer is a hydrogen atom, known as 4-equivalent couplers, have drawbacks such as low color-forming property and yellow coloring upon aging after development processing, although the couplers are excellent in graininess. On the other hand, couplers having a coupling position substituted with a split-off group other than a hydrogen atom (for example, a halogen atom), known as 2-equivalent couplers, have a drawback in that the graininess is lowered to thereby result in deterioration of image quality, although the couplers are characterized in that, as compared with those of the 4-equivalent couplers, a color formation occurs with a decreased amount of silver and the possibility of yellow coloring is lowered.

Further, most of these couplers are used in the form of a solution or dispersion in a high-boiling organic solvent such as a phosphoric ester or a phthalic ester. In recent years, in accordance with the requirement for high sharpness, the amount of high-boiling organic solvent added tends to be reduced, and so-called oilless is demanded. However, with respect to most of pyrazolotriazole magenta couplers, extreme lowering of color-forming property is caused when they are used in an oilless state. Therefore, an improvement thereto is being demanded.

For solving the above problems, there have been proposed couplers based on pyrazolotriazoles wherein various ingenuities have been exerted onto substituents on the pyrazolotriazole ring. For example, with respect to the durability of color image, an improvement by a coupler having a 6-position substituent rendered bulky has been disclosed in U.S. Pat. No. 4,882,266 and E.P. 183,445.

Further, with respect to an improvement to color-forming property in an oilless state, a coupler having a carboxyl group introduced as a split-off group in the molecule thereof has been disclosed in Jpn. Pat. Appln. KOKAI Publication No. (hereinafter referred to as JP-A-) 1-102557.

However, these disclosed technologies have been unsatisfactory for the resolution of problems, such as yellow coloring by aging after processing and color image storability. Introduction of a split-off group, although an improvement in color-forming property can be recognized, causes couplers to suffer a cost increase and a poor crystallinity, thereby posing a problem in the industrial application. Moreover, additional problems, such as yellow staining of undyed portions by light irradiation or in humid heating atmosphere and occurrence of photographic speed drop during the stay from mixing with a color-sensitized silver halide emulsion through coating, have revealed. Still further, the resistance to variations of processing solution compositions is unsatisfactory, so that an improvement thereto has been demanded.

Most of the pyrazoloazole couplers now in practical use are 2-equivalent couplers. In the processing of color reversal photosensitive material, the first development is followed by reversal, and thereafter a color development processing is carried out. At this stage, the 2-equivalent couplers pose such an inherent problem that the color-forming property per mol of silver is high, thereby causing the photographic speed to be low as compared with those of the 4-equivalent couplers. Accordingly, when it is intended to apply a pyrazolotriazole magenta coupler to a color reversal photosensitive material, 4-equivalent couplers are preferably employed from the viewpoint of photographic speed. The application of 4-equivalent pyrazolotriazole magenta couplers to color reversal photosensitive materials is disclosed in, for example, JP-A's 1-102557, 5-100382 (pages 13–15, 24–34, 42–45 and 53–63), 2001-33921 (pages 12–44) and 2001-324784 (pages 22–41). However, these disclosed technologies are not yet satisfactory for resolving the problems of durability to variations in processing solution compositions, and a solution to the problem of yellow coloring by aging after processing is desired.

BRIEF SUMMARY OF THE INVENTION

It is the first object of the present invention to provide a magenta coupler capable of accomplishing stable image formation despite variations of processing solution compositions and further to provide a magenta coupler which realizes excellent color-forming property even in the reduction of high-boiling organic solvents, in so-called an oilless state. It is the second object of the present invention to provide a silver halide color photosensitive material which enables stable image formation despite variations of processing solution compositions, which exhibits excellent color reproducibility and durability, and which arises less stain.

The inventors have made extensive and intensive studies with a view toward obtaining a coupler which exhibits satisfactory color-forming property even in an oilless state, and also which arises less stain, which enables stable image formation despite variations of processing solution compositions, and which is excellent in graininess, image storability, etc. As a result, the present invention has been completed.

The objects of the present invention have been attained by the following means.

(1) A silver halide color photosensitive material comprising a 1H-pyrazolo[3,2-c]-1,2,4-triazole type coupler having, in its molecule, at least one substituent represented by the following general formula (I):

(I)

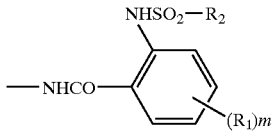

wherein $R_1$ represents a substituent, m represents an integer of 0 to 4, and $R_2$ represents an alkyl group, alkenyl group or aryl group.

(2) The silver halide color photosensitive material according to item (1) above wherein the coupler described in item (1) above is represented by the following general formula (II):

(II)

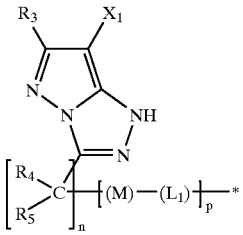

wherein $R_3$ represents a substituent; $X_1$ represents a hydrogen atom or a group capable of splitting-off upon reaction with an oxidized developing agent; $R_4$ and $R_5$ each independently represents a hydrogen atom, alkyl group, or aryl group; and n represents an integer of 1 to 3. M represents —O—, —S—, —SO—, —$SO_2$—, —C(=O)O—, —OC(=O)—, —C(=O)N($R_6$)—, —N($R_6$)C(=O)—, —$SO_2$N($R_6$)—, —N($R_6$)$SO_2$—, —C($R_6$)C(=O)N($R_7$)—, —N($R_6$)C(=O)O— or —OC(=O)N($R_6$)—, wherein $R_6$ and $R_7$ each independently represents a hydrogen atom, alkyl group or aryl group; $L_1$ represents an alkylene group, aralkylene group or arylene group; and p represents 0 or 1. * represents the position at which the group represented by the general formula (I) is attached.

(3). A silver halide color photosensitive material comprising at least one coupler represented by the following general formula (III) or general formula (IV):

(III)

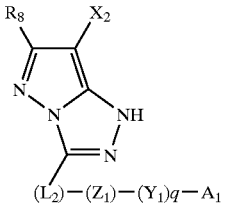

-continued (IV)

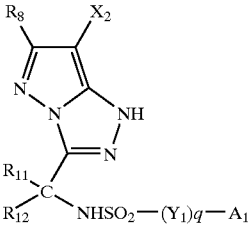

wherein $R_8$ represents a substituent; $X_2$ represents a hydrogen atom or a group capable of splitting-off upon reaction with an oxidized developing agent. $L_2$ represents an alkylene group or aralkylene group; $Z_1$ represents —N($R_9$)C(=O)—, —N($R_9$)C(=O)O—, —N($R_9$)C(=O)N($R_{10}$)—, —OC(=O)—, —OC(=O)N($R_9$)—, —C(=O)N($R_9$)— or —C(=O)O—, wherein $R_9$ and $R_{10}$ each independently represents a hydrogen atom, alkyl group or aryl group. $Y_1$ represents a divalent linking group, and q represents 0 or 1. $R_{11}$ and $R_{12}$ each independently represents a hydrogen atom, alkyl group or aryl group, and $A_1$ represents a group represented by the following general formula (V) or a group having a group represented by the following general formula (V):

(V)

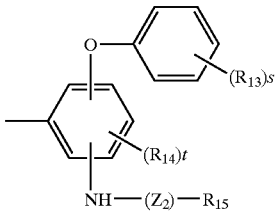

Wherein $R_{13}$ and $R_{14}$ each independently represents a substituent, s represents in integer of 0 to 5; and t represents an integer of 0 to 3. $R_{15}$ represents an alkyl group or aryl group; and $Z_2$ represents —C(=O)—, —C(=O)O—, —C(=O)N($R_{16}$)—, —$SO_2$— or —$SO_2$N($R_{16}$)—, wherein $R_{16}$ represents a hydrogen atom, alkyl group or aryl group.

(4) The silver halide color photosensitive material according to item (3) above, wherein $L_2$ in the general formula (III) is represented by the following general formula (VI):

(VI)

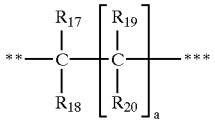

wherein $R_{17}$, $R_{18}$, $R_{19}$ and $R_{20}$ each independently represents a hydrogen atom, alkyl group or aryl group; and a represents an integer of 0 to 2.  represents a position at which $L_2$ attaches to the pyrazolotriazole skeleton of the coupler represented by the general formula (III); and * represents a position to which $Z_1$ in the general formula (III) attaches.

(5) The silver halide color photosensitive material according to item (3) or (4) above, wherein the group represented by $A_1$ in the general formula (III) and general formula (IV) is represented by the following general formula (VII):

(VII)

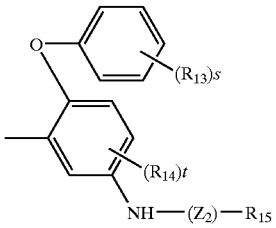

wherein $R_{13}$ and $R_{14}$ each independently represents a substituent, s represents an integer of 0 to 5; and t represents an integer of 0 to 3. $R_{15}$ represents an alkyl group or aryl group; and $Z_2$ represents —C(=O)—, —C(=O)O—, —C(=O)N($R_{16}$)—, —$SO_2$— or —$SO_2$N($R_{16}$)—, wherein $R_{16}$ represents a hydrogen atom, alkyl group or aryl group.

(6) The silver halide color photosensitive material according to any one of items (1) to (5), wherein the coupler described in the items (1) to (5) is a coupler represented by the following formula (VIII):

(VIII)

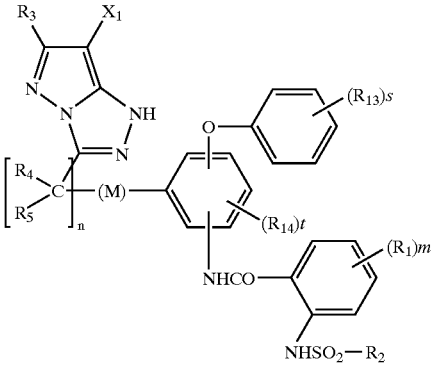

wherein $R_1$ represents a substituent; m represents an integer of 0 to 4; and $R_2$ represents an alkyl group, alkenyl group or aryl group. $R_3$ represents a substituent, and $X_1$ represents a hydrogen atom or a group capable of splitting-off upon reaction with an oxidized developing agent. $R_4$ and $R_5$ each independently represents a hydrogen atom, alkyl group, or aryl group; and n represents an integer of 1 to 3. M represents —O—, —S—, —SO—, —$SO_2$—, —C(=O)O—, —OC(=O)—, —C(=O)N($R_6$)—, —N($R_6$)C(=O)—, —$SO_2$N($R_6$)—, —N($R_6$)$SO_2$—, —C($R_6$)C(=O)N($R_7$)—, —N($R_6$)C(=O)O— or —OC(=O)N($R_6$)—, wherein $R_6$ and $R_7$ each independently represents a hydrogen atom, alkyl group or aryl group. $R_{13}$ and $R_{14}$ each independently represents a substituent, s represents an integer of 0 to 5; and t represents an integer of 0 to 3.

(7) The silver halide color photosensitive material according to any one of items (2) to (6) above, wherein $R_3$ in the general formula (II) and general formula (VIII), and $R_8$ in the general formula (III) and general formula (IV) each represents a tertiary alkyl group.

(8) The silver halide color photosensitive material according to any one of items (2) to (7) above, wherein $X_1$ in the general formula (II) and general formula (VIII), and $X_2$ in the general formula (III) and general formula (IV) each represents a hydrogen atom.

(9) The silver halide color photosensitive material according to any one items (1) to (8) above further comprising the following compound SR-1:

(SR-1)

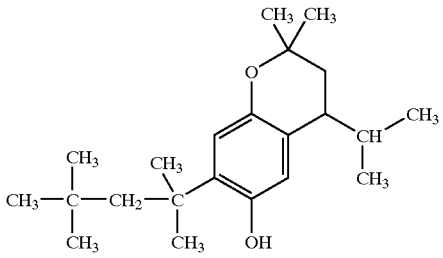

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

$R_1$, m and $R_2$ of the general formula (I) will be described in detail.

$R_1$ in the general formula (I) represents a substituent. The substituent represented by $R_1$ includes halogen atom (e.g., a fluorine atom, a chlorine atom or a bromine atom); an alkyl group (preferably a linear, branched or cyclic alkyl group having 1 to 48 carbon atoms (hereinafter the groups containing an alkyl moiety such as a alkoxy group and so on have the same meaning), such as methyl, ethyl, propyl, isopropyl, butyl, t-butyl, pentyl, hexyl, heptyl, octyl, 2-ethylhexyl, dodecyl, hexadecyl, cyclopropyl, cyclopentyl, cyclohexyl, 1-norbornyl or 1-adamantyl); an alkenyl group (preferably an alkenyl group having 2 to 48 carbon atoms, such as vinyl, allyl or 3-buten-1-yl); an aryl group (preferably an aryl group having 6 to 48 carbon atoms, such as phenyl or naphthyl); a heterocyclic group (preferably a heterocyclic group having 1 to 32 carbon atoms and having at least one hetero atom selected from a group consisting of N, S, O and P, and an aromatic ring such as a benzene ring may be fused thereto (hereinafter groups containing a heterocyclic moiety such as a heterocyclic oxy group and so on have the same meaning), such as 2-thienyl, 4-pyridyl, 2-furyl, 2-pyrimidinyl, 1-pyridyl, 2-benzothiazolyl, 1-imidazolyl, 1-pyrazolyl or benzotriazol-1-yl); a silyl group (preferably a silyl group having 3 to 38 carbon atoms, such as trimethylsilyl, triethylsilyl, tributylsilyl, t-butyldimethylsilyl or t-hexyldimethylsilyl); a hydroxyl group; a cyano group; a nitro group; an alkoxy group (preferably an alkoxy group having 1 to 48 carbon atoms, such as methoxy, ethoxy, 1-butoxy, 2-butoxy, isopropoxy, t-butoxy, dodecyloxy or a cycloalkyloxy group (e.g., cyclopentyloxy or cyclohexyloxy)); an aryloxy group (preferably an aryloxy group having 6 to 48 carbon atoms, such as phenoxy or 1-naphthoxy); a heterocyclic oxy group (preferably a heterocyclic oxy group having 1 to 32 carbon atoms, such as 1-phenyltetrazol-5-oxy or 2-tetrahydropyranyloxy); a silyloxy group (preferably a silyloxy group having 1 to 32 carbon atoms, such as trimethylsilyloxy, t-butyldimethylsilyloxy or diphenylmethylsilyloxy); an acyloxy group (preferably an acyloxy group having 2 to 48 carbon atoms, such as acetoxy, pivaloyloxy, benzoyloxy or dodecanoyloxy); an alkoxycarbonyloxy group (preferably an alkoxycarbonyloxy group having 2 to 48 carbon atoms, such as ethoxycarbonyloxy, t-butoxycarbonyloxy or a cycloalkyloxycarbonyloxy group (e.g., cyclohexyloxycarbonyloxy)); an aryloxycarbonyloxy group (preferably an aryloxycarbonyloxy group having 7 to 32 carbon atoms, such as phenoxycarbonyloxy); a carbamoyloxy group (preferably a carbamoyloxy group having 1 to 48 carbon atoms, such as N,N-dimethylcarbamoyloxy, N-butylcarbamoyloxy, N-phenylcarbamoyloxy or N-ethyl-N-phenylcarbamoyloxy); a sulfamoyloxy group (preferably a sulfamoyloxy group having 1 to 32 carbon atoms, such as N,N-diethylsulfamoyloxy or N-propylsulfamoyloxy); an alkylsulfonyloxy group (preferably an alkylsulfonyloxy group having 1 to 38 carbon atoms, such as methylsulfonyloxy, hexadecylsulfonyloxy or cyclohexylsulfonyloxy); an arylsulfonyloxy group (preferably an arylsulfonyloxy group having 6 to 32 carbon atoms, such as phenylsulfonyloxy); an acyl group (preferably an acyl group having 1 to 48 carbon atoms, such as formyl, acetyl, pivaloyl, benzoyl, tetradecanoyl or cyclohexanoyl); an alkoxycarbonyl group (preferably an alkoxycarbonyl group having 2 to 48 carbon atoms, such as methoxycarbonyl, ethoxycarbonyl, octadecyloxycarbonyl or cyclohexyloxycarbonyl); an aryloxycarbonyl group (preferably an aryloxycarbonyl group having 7 to 32 carbon atoms, such as phenoxycarbonyl); a carbamoyl group (preferably a carbamoyl group having 1 to 48 carbon atoms, such as carbamoyl, N,N-diethylcarbamoyl, N-ethyl-N-octylcarbamoyl, N,N-dibutylcarbamoyl, N-propylcarbamoyl, N-phenylcarbamoyl, N-methyl-N-phenylcarbamoyl or N,N-dicyclohexylcarbamoyl); an amino group (preferably an amino group having 32 or less carbon atoms, such as amino, methylamino, N,N-dibutylamino, tetradecylamino, 2-ethylhexylamino or cyclohexylamino); an anilino group (preferably an anilino group having 6 to 32 carbon atoms, such as anilino or N-methylanilino); a heterocyclic amino group (preferably a heterocyclic amino group having 1 to 32 carbon atoms, such as 4-pyridylamino); a carbonamido group (preferably a carbonamido group having 2 to 48 carbon atoms, such as acetamido, benzamido, tetradecanamido, pivaloylamido or cyclohexanamido); a ureido group (preferably a ureido group having 1 to 32 carbon atoms, such as ureido, N,N-dimethylureido or N-phenylureido); an imido group (preferably an imido group having 10 or less carbon atoms, such as N-succinimido or N-phthalimido); an alkoxycarbonylamino group (preferably an alkoxycarbonylamino group having 2 to 48 carbon atoms, such as methoxycarbonylamino, ethoxycarbonylamino, t-butoxycarbonylamino, octadecyloxycarbonylamino or cyclohexyloxycarbonylamino); an aryloxycarbonylamino group (preferably an aryloxycarbonylamino group having 7 to 32 carbon atoms, such as phenoxycarbonylamino); a sulfonamido group (preferably a sulfonamido group having 1 to 48 carbon atoms, such as methanesulfonamido, butanesulfonamido, benzenesulfonamido, hexadecanesulfonamido or cyclohexanesulfonamido); a sulfamoylamino group (preferably a sulfamoylamino group having 1 to 48 carbon atoms, such as N,N-dipropylsulfamoylamino or N-ethyl-N-dodecylsulfamoylamino); an azo group (preferably an azo group having 1 to 32 carbon atoms, such as phenylazo or 3-pyrazolylazo); an alkylthio group (preferably an alkylthio group having 1 to 48 carbon atoms, such as methylthio, ethylthio, octylthio or cyclohexylthio); an arylthio group (preferably an arylthio group having 6 to 48 carbon atoms, such as phenylthio); a heterocyclic thio group (preferably a heterocyclic thio group having 1 to 32 carbon atoms, such as 2-benzothiazolylthio, 2-pyridylthio or 1-phenyltetrazolylthio); an alkylsulfinyl group (preferably an alkylsulfinyl group having 1 to 32 carbon atoms, such as dodecanesulfinyl); an arylsulfinyl group (preferably an arylsulfinyl group having 6 to 32 carbon atoms, such as phenylsulfinyl); an alkylsulfonyl group (preferably an alkylsulfonyl group having 1 to 48 carbon atoms, such as methylsulfonyl, ethylsulfonyl, propylsulfonyl, butylsulfonyl, isopropylsulfonyl, 2-ethylhexylsulfonyl, hexadecylsulfonyl, octylsulfonyl or cyclohexylsulfonyl); an arylsulfonyl group (preferably an arylsulfonyl group having 6 to 48 carbon atoms, such as phenylsulfonyl or 1-naphthylsulfonyl); a sulfamoyl group (preferably a sulfamoyl group having 32 or less carbon atoms, such as sulfamoyl, N,N-dipropylsulfamoyl, N-ethyl-N-dodecylsulfamoyl, N-ethyl-N-phenylsulfamoyl or N-cyclohexylsulfamoyl); a sulfo group; a phosphonyl group (preferably a phosphonyl group having 1 to 32 carbon atoms, such as phenoxyphosphonyl, octyloxyphosphonyl or phenylphosphonyl); or a phosphinoylamino group (preferably a phosphinoylamino group having 1 to 32 carbon atoms, such as diethoxyphosphinoylamino or dioctyloxyphosphinoylamino).

When $R_1$ represents a group capable of further being substituted, it may be substituted with any of the above substituents. When it is substituted with two or more substituents, these substituents may be the same or different. When it is substituted with two or more substituents, these may be bonded together thereby forming a ring (hereinafter the same can be applied to the case where a substituent is further substituted with two or more substituent).

m represents an integer of 0 to 4. When m represents 2 or more, a plurality of $R_1$'s may be the same or different.

In the general formula (I), $R_2$ represents an alkyl group, alkenyl group or aryl group. Preferable ranges of the alkyl group, alkenyl group and aryl group are the same as the alkyl group, alkenyl group and aryl group described above as $R_1$, respectively. The alkyl group, alkenyl group or aryl group represented by $R_2$ may be substituted by a substituent described above as $R_1$. When the alkyl group, alkenyl group or aryl group represented by $R_2$ is substituted by two or more substituents, those substituents may be the same or different.

Representative specific examples of the general formula (I) are set forth below, but the present invention is not limited to these.

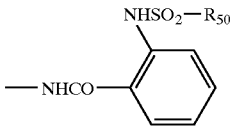

| No. | $R_{50}$ |
|---|---|
| I-1 | $-CH_3$ |
| I-2 | $-C_4H_9$ |
| I-3 | $-C_8H_{17}$ |
| I-4 | $-C_{12}H_{25}$ |
| I-5 | $-C_{16}H_{33}$ |
| I-6 | $-CH_2CH_2OCH_3$ |
| I-7 | $-CH_2CH(C_2H_5)C_4H_9$ |

-continued
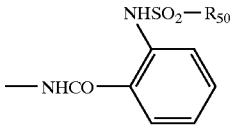
| No. | $R_{50}$ |
|---|---|
| I-8 | $-CH_2CH(C_6H_{13})C_8H_{17}$ |
| I-9 | $-CH_2CH_2SC_4H_9$ |
| I-10 | $-CH_2CH_2SO_2CH_3$ |
| I-11 | 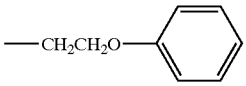 |
| I-12 | 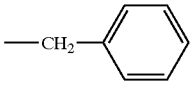 |
| I-13 | 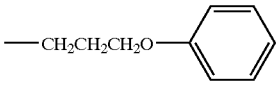 |
| I-14 | 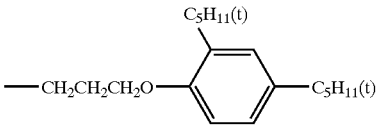 |
| I-15 | 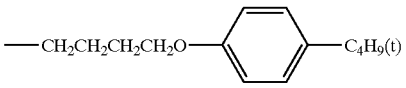 |
| I-16 | 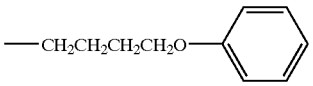 |
| I-17 | $-CH(COOC_2H_5)CH_2COOC_2H_5$ |
| I-18 | 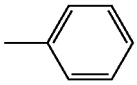 |
| I-19 | 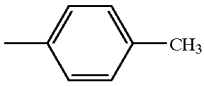 |
| I-20 | 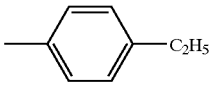 |
| I-21 | 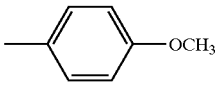 |
| I-22 | 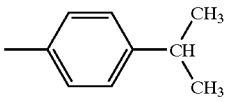 |
-continued
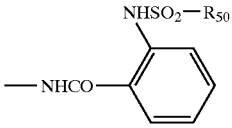
| No. | $R_{50}$ |
|---|---|
| I-23 | 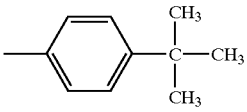 |
| I-24 | 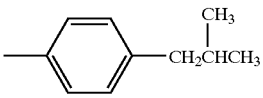 |
| I-25 | 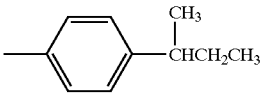 |
| I-26 | 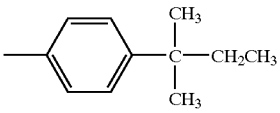 |
| I-27 | 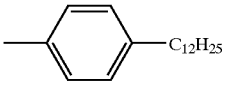 |
| I-28 | 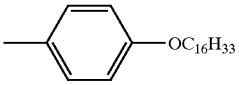 |
| I-29 | 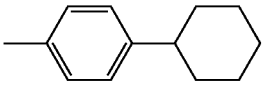 |
| I-30 | 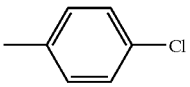 |
| I-31 | 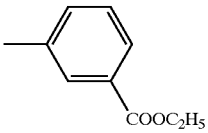 |
| I-32 | 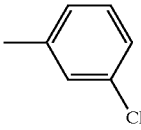 |
| I-33 | 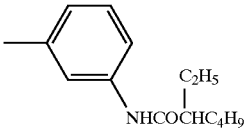 |

-continued
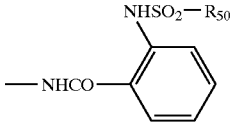
| No. | $R_{50}$ |
|---|---|
| I-34 | 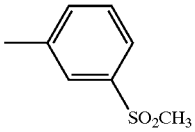 |
| I-35 | 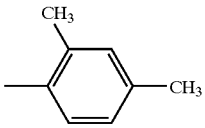 |
| I-36 | 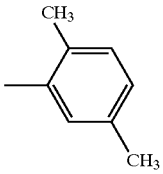 |
| I-37 | 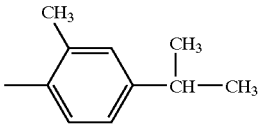 |
| I-38 | 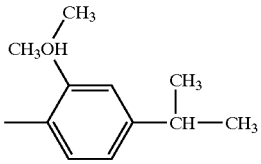 |
| I-39 | 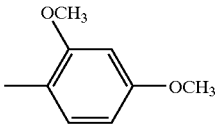 |
| I-40 | 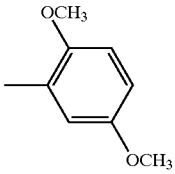 |
| I-41 | 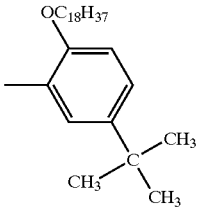 |
-continued
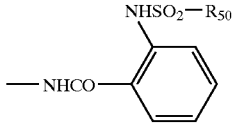
| No. | $R_{50}$ |
|---|---|
| I-42 | 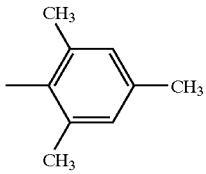 |
| I-43 | 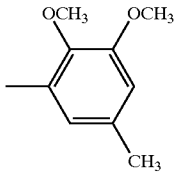 |
| I-44 | 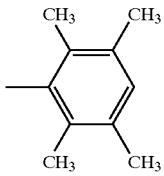 |
| I-45 | 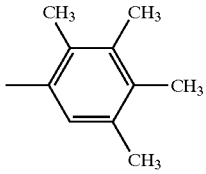 |
| I-46 | 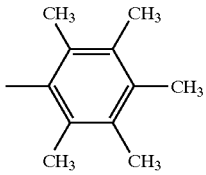 |
| I-47 | 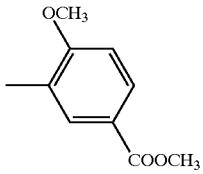 |
| I-48 | 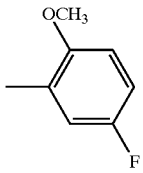 |

-continued
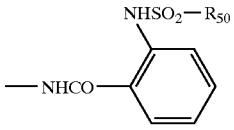
| No. | $R_{50}$ |
|---|---|
| I-49 | 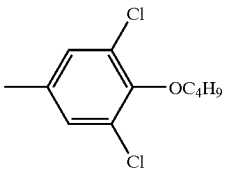 |
| I-50 | 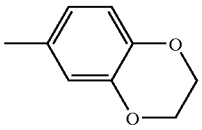 |
| I-51 | 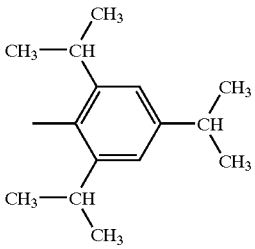 |
| I-52 | 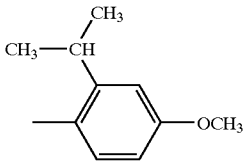 |
| I-53 | 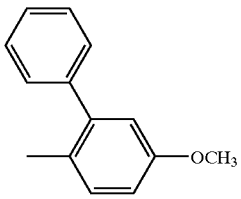 |
| I-54 | 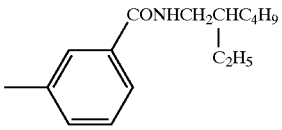 |
| I-55 | 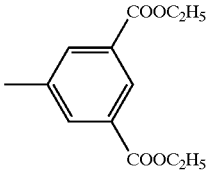 |
-continued
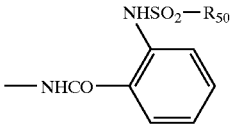
| No. | $R_{50}$ |
|---|---|
| I-56 | 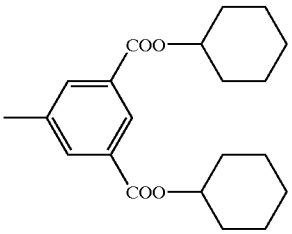 |
| I-57 | 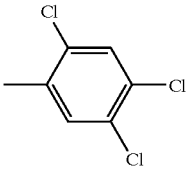 |
| I-58 | 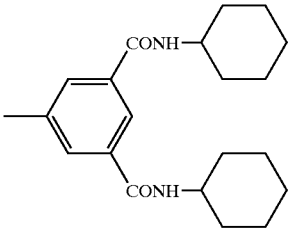 |
| I-59 | 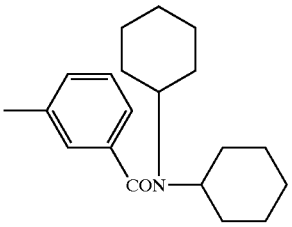 |
| I-60 | 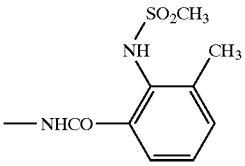 |
| I-61 | 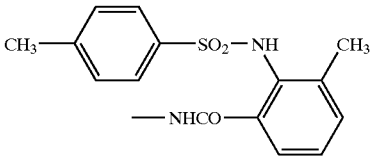 |

-continued
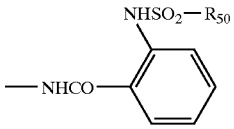
| No. | $R_{50}$ |
|---|---|
| I-62 | 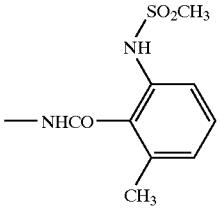 |
| I-63 | 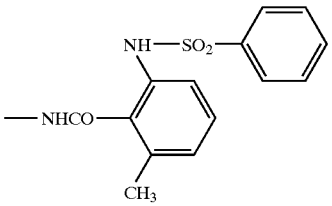 |
| I-64 | 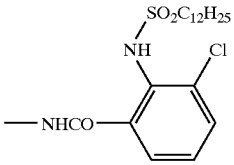 |
| I-65 | 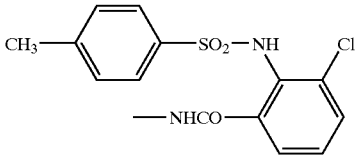 |
| I-66 | 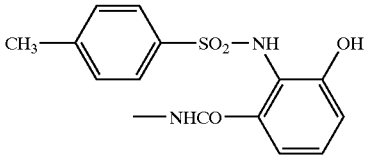 |
| I-67 | 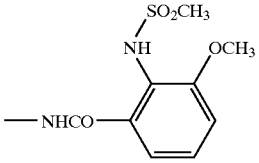 |
| I-68 | 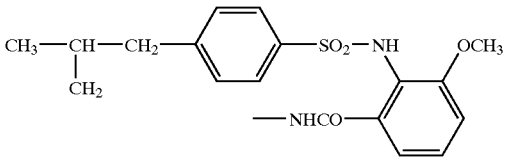 |
-continued
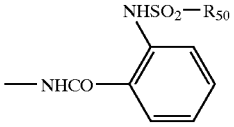
| No. | $R_{50}$ |
|---|---|
| I-69 | 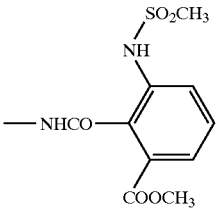 |
| I-70 | 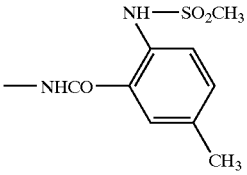 |
| I-71 | 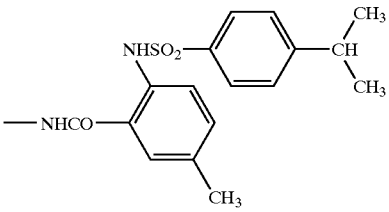 |
| I-72 | 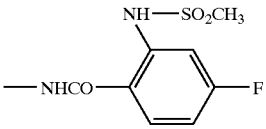 |
| I-73 | 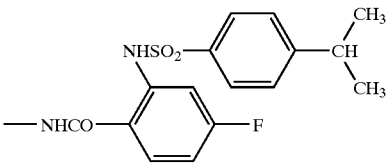 |
| I-74 | 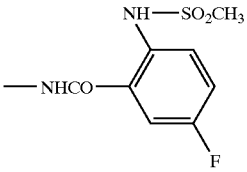 |
| I-75 | 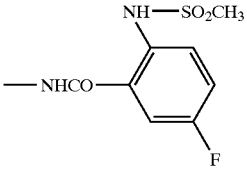 |

-continued
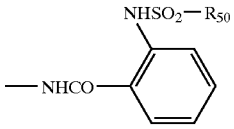
| No. | $R_{50}$ |
|---|---|
| I-76 | 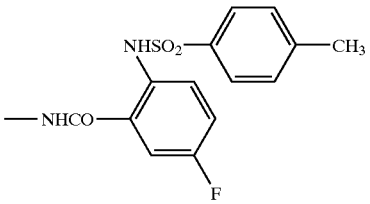 |
| I-77 | 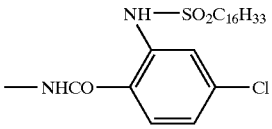 |
| I-78 | 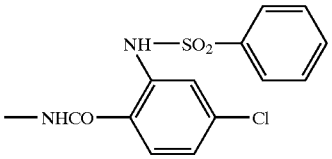 |
| I-79 | 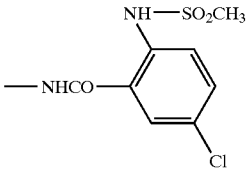 |
| I-80 | 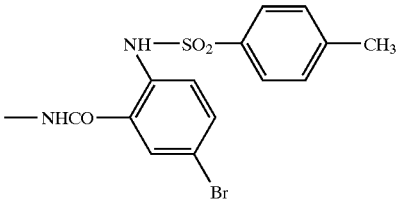 |
| I-81 | 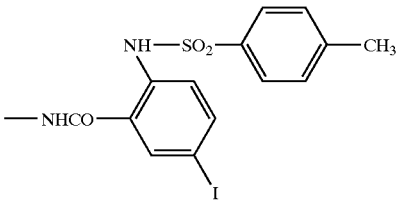 |
| I-82 | 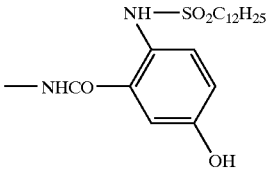 |
-continued
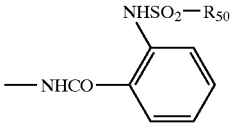
| No. | $R_{50}$ |
|---|---|
| I-83 | 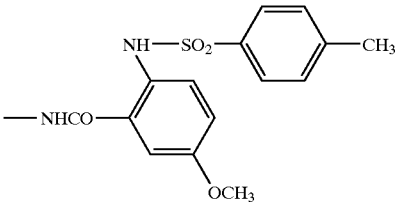 |
| I-84 | 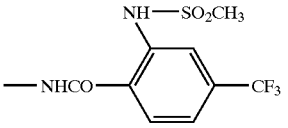 |
| I-85 | 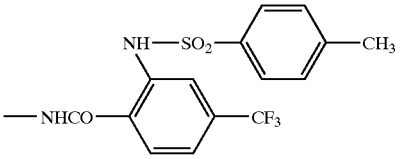 |
| I-86 | 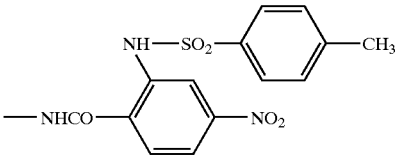 |
| I-87 | 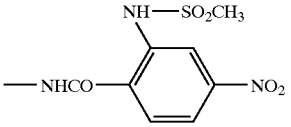 |
| I-88 | 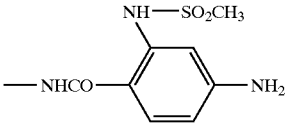 |
| I-89 | 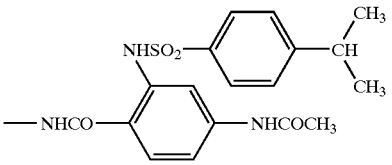 |
| I-90 | 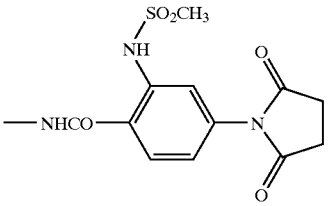 |

-continued
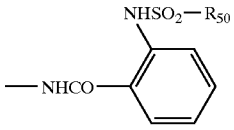
| No. | $R_{50}$ |
|---|---|
| I-91 | 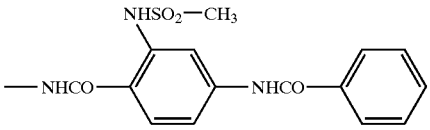 |
| I-92 | 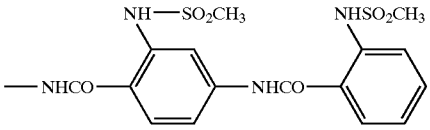 |
| I-93 | 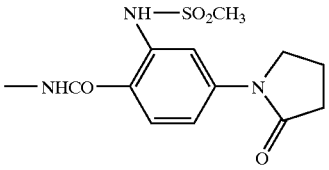 |
| I-94 | 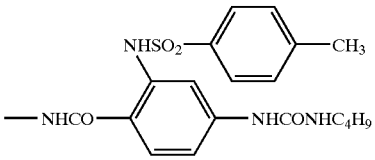 |
| I-95 | 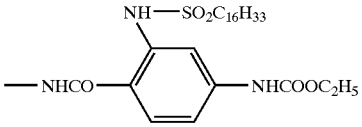 |
| I-96 | 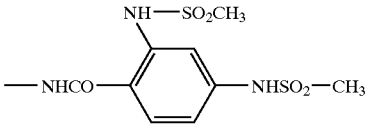 |
| I-97 | 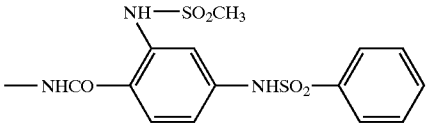 |
| I-98 | 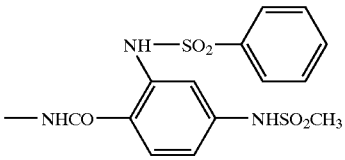 |
| I-99 | 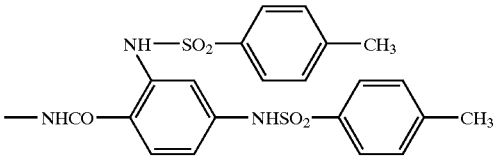 |
-continued
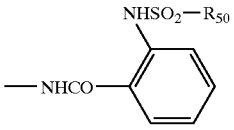
| No. | $R_{50}$ |
|---|---|
| I-100 | 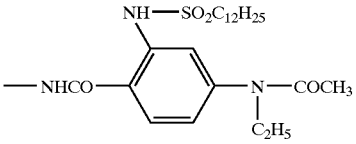 |
| I-101 | 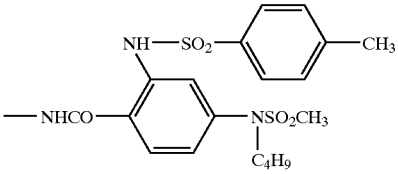 |
| I-102 | 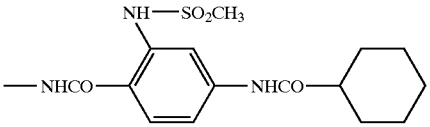 |
| I-103 | 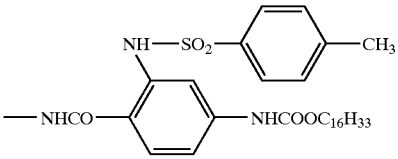 |
| I-104 | 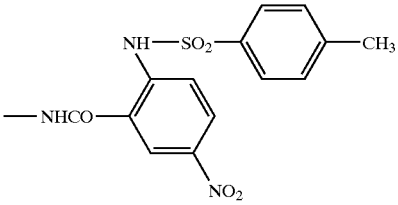 |
| I-105 | 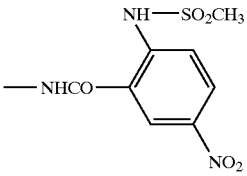 |
| I-106 | 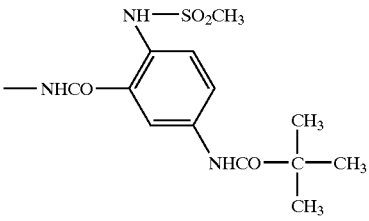 |

-continued
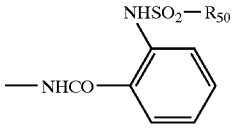
| No. | $R_{50}$ |
|---|---|
| I-107 | 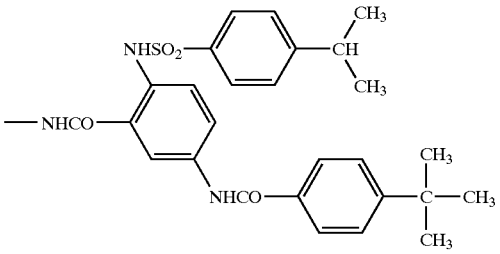 |
| I-108 | 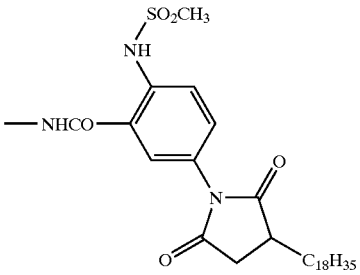 |
| I-109 | 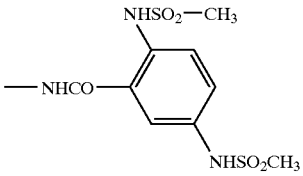 |
| I-110 | 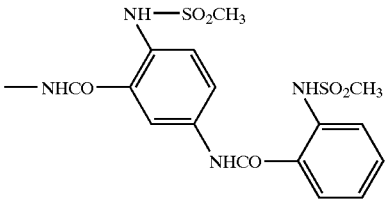 |
| I-111 | 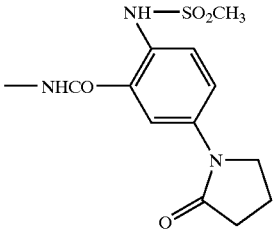 |
| I-112 | 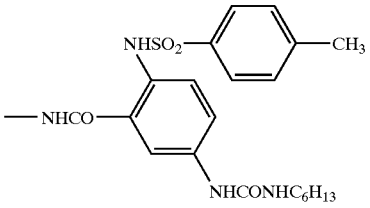 |
-continued
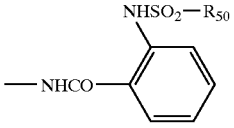
| No. | $R_{50}$ |
|---|---|
| I-113 | 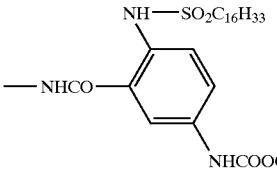 |
| I-114 | 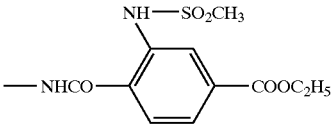 |
| I-115 | 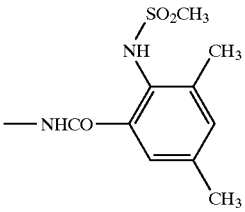 |
| I-116 | 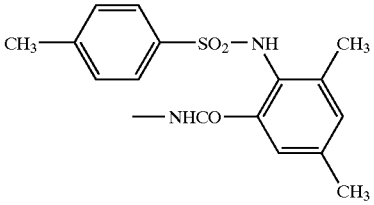 |
| I-117 | 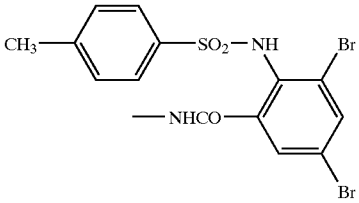 |
| I-118 | 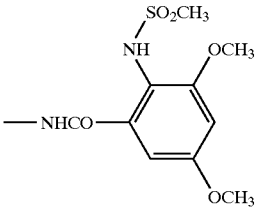 |
| I-119 | 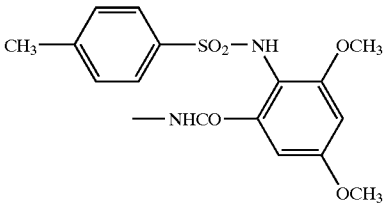 |

-continued

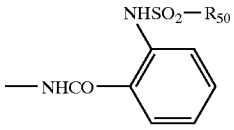

| No. | $R_{50}$ |
|---|---|
| I-120 | 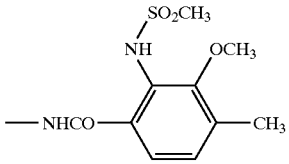 |
| I-121 | 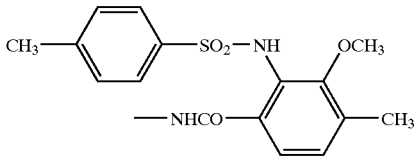 |

The group represented by the general formula (I) may be attached to a substituent at 3-, 6- or 7-position of 1H-pyrazolo[3,2-c]-1,2,4-triazole type coupler. The number of the group represented by the general formula (I) may be two or more. When the coupler has two or more groups represented by the general formula (I), the groups may have the same structure or may be different.

The 1H-pyrazolo[3,2-c]-1,2,4-triazole type coupler having the group represented by the general formula (I) is preferably represented by the above general formula (II).

Next, the general formula (II) will be described in detail.

In the formula (II), $R_3$ represents a substituent. Preferable range of the substituent represented by $R_3$ is the same as the substituent represented by $R_1$ described above. When the substituent represented by $R_3$ represents a group capable of having a further substituent, $R_3$ may have a substituent described above as $R_1$. When $R_3$ has two or more substituents, those substituents may be the same or different.

In the general formula (II), $R_4$ and $R_5$ each independently represents a hydrogen atom, alkyl group or aryl group. The alkyl group and aryl group represented by $R_4$ and $R_5$ have the same meaning as the alkyl group and aryl group described above as $R_1$, respectively. The alkyl group and aryl group represented by $R_4$ and $R_5$ may have a substituent described above as $R_1$. When the alkyl group and the aryl group have two or more substituents, those substituents may be the same or different.

n represents an integer of 1 to 3.

In the general formula (II), M represents —O—, —S—, —SO—, —$SO_2$—, —C(=O)O—, —OC(=O)—, —C(=O)N($R_6$)—, —N($R_6$)C(=O)—, —$SO_2$N($R_6$)—, —N($R_6$)$SO_2$—, —C($R_6$)C(=O)N($R_7$)—, —N($R_6$)C(=O)O— or —OC(=O)N($R_6$)—, wherein in each of the formulas, the left hand side bonding attaches to —$\{C(R_4)(R_5)\}_n$— of the general formula (II). $R_6$ and $R_7$ each independently represents a hydrogen atom, alkyl group or aryl group.

The alkyl group and aryl group represented by $R_6$ and $R_7$ have the same meaning as the alkyl group and aryl group described above as $R_1$, respectively. The alkyl group and aryl group represented by $R_6$ and $R_7$ may have a substituent described above as $R_1$. When the alkyl group and the aryl group have two or more substituents, those substituents may be the same or different.

$L_1$ of the general formula (II) represents an alkylene group, arylene group or aralkylene group. In particular, $L_1$ represents an alkylene group (alkylene group having 1 to 48 carbon atoms, preferably 1 to 18 carbon atoms, such as methylene, ethylene, propylene or butylene), aralkylene group (aralkylene group having 7 to 48 carbon atoms, preferably 7 to 18 carbon atoms, wherein the aralkylene group includes both groups of -alkylene-arylene- and -arylene-alkylene-, such as divalent benzyl or divalent phenethyl), or arylene group (arylene group having 6 to 48, preferable 6 to 18 carbon atom, such as o-phenylene, m-phenylene, p-phenylene, or 1,4-naphthalene). When the alkylene group, aralkylene group and arylene group are capable of being substituted, the alkylene, aralkylene and arylene groups may be substituted with a substituent described above as $R_1$. When the alkylene, aralkylene and arylene groups are substituted with two or more substituents, these substituents may be the same or different.

p represents 0 or 1, and * represents the position at which the group represented by the general formula (I) is attached.

$X_1$ of the general formula (II) represents a hydrogen atom, or a group capable of splitting-off upon reaction with an oxidized developing agent. Specific examples of $X_1$ includes a hydrogen atom, halogen atom, alkoxy group, aryloxy group, heterocyclicoxy group, acyloxy group, alkoxycarbonyloxy group, carbamoyloxy group, alkylthio group, arylthio group, heterocyclic thio group, imido group azo group or aromatic heterocyclic group with its nitrogen atom attached to the coupling active position. Preferable ranges of these hydrogen atom, halogen atom, alkoxy group, aryloxy group, heterocyclicoxy group, acyloxy group, alkoxycarbonyloxy group, carbamoyloxy group, alkylthio group, arylthio group, heterocyclic thio group, imido group azo group and aromatic heterocyclic group with its nitrogen atom attached to the coupling active position, the same as those described above as $R_1$, respectively. When each of these groups represented by $X_1$ is a group capable of being further substituted, these groups represented by $X_1$ may be substituted by a substituent described above as $R_1$. When each of these groups represented by $X_1$ is substituted by two or more substituents, those substituents may be the same or different.

Next, preferable range of the coupler of the invention having the group represented by the general formula (I) will be described.

A preferable coupler is one having the group represented by the general formula (I) that is attached at the position marked with * in the 1H-pyrazolo[3,2-c]-1,2,4-triazole type coupler represented by the general formula (II).

More preferable coupler is, in the general formula (II), $R_3$ represents an alkyl group, aryl group, alkoxy group, aryloxy group, anilino group, carbonamido group or alkoxycarbonylamino group, $X_1$ represents a hydrogen atom, halogen atom, aryloxy group, alkylthio group, arylthio group, heterocyclic thio group or aromatic heterocyclic group with its nitrogen atom attached to the pyrazolotriazole ring, $R_4$ and $R_5$ each independently represents a hydrogen atom or alkyl group, n represents an integer of 1 to 3, p represents 0 or 1, wherein when p represents 1, M represents —OC(=O)—, —N($R_6$)C(=O)—, —N($R_6$)$SO_2$—, —N($R_6$)C(=O)N($R_7$)— or —N($R_6$)C(=O)O—, wherein $R_6$ and $R_7$ represents a hydrogen atom, $L_1$ represents an alkylene group or arylene group, and in the general formula (I), $R_1$ represents a halogen atom, alkyl group, aryl group, hydroxyl group, cyano group, nitro group, alkoxy group, aryloxy group, alkoxycarbonyl group, carbamoyl group carbonamido group ureido group, alkoxycarbonylamino group, sulfonamido group, alkylthio group, arylthio group, alkylsulfonyl group arylsulfonyl group or sulfamoyl group, m represents 0 or 1, and $R_2$ represents an alkyl group or aryl group.

More preferable coupler is, in the general formula (II), $R_3$ represents an alkyl group, $X_1$ represents a hydrogen atom, halogen atom, aryloxy group, alkylthio group, arylthio group or aromatic heterocyclic group with its nitrogen atom attached to the pyrazolotriazole ring, $R_4$ and $R_5$ each independently represents a hydrogen atom or alkyl group, n represents an integer of 1 to 3, p represents 0 or 1, wherein when p represents 1, M represents —OC(=O)—, —N($R_6$)C(=O)—, —N($R_6$)$SO_2$—, —N($R_6$)C(=O)N($R_7$)— or —N($R_6$)C(=O)O—, $R_6$ and $R_7$ represents a hydrogen atom, $L_1$ represents an alkylene group or arylene group, and in the general formula (I), $R_1$ represents a halogen atom or alkyl group, m represents 0 or 1, and $R_2$ represents an alkyl group or aryl group.

Much more preferable coupler is, in the general formula (II), $R_3$ represents a tertiary alkyl group, $X_1$ represents a hydrogen atom, halogen atom, aryloxy group, alkylthio group, arylthio group or aromatic heterocyclic group with its nitrogen atom attached to the pyrazolotriazole ring, $R_4$ and $R_5$ each independently represents a hydrogen atom or alkyl group, n represents an integer of 1 to 3, p represents 0 or 1, wherein when p represents 1, M represents —OC(=O)—, —N($R_6$)C(=O)—, —N($R_6$)$SO_2$—, —N($R_6$)C(=O)N($R_7$)— or —N($R_6$)C(=O)O—, each of $R_6$ and $R_7$ represents a hydrogen atom, $L_1$ represents an alkylene group or arylene group, and in the general formula (I), $R_1$ represents a halogen atom or alkyl group, m represents 0 or 1, and $R_2$ represents an alkyl group or aryl group.

Still much more preferable coupler is, in the general formula (II), $R_3$ represents a tertiary alkyl group, $X_1$ represents a hydrogen atom or halogen atom, $R_4$ and $R_5$ each independently represents a hydrogen atom or alkyl group, n represents an integer of 1 to 3, p represents 0 or 1, wherein when p represents 1, M represents —OC(=O)—, —N($R_6$)C(=O)—, —N($R_6$)$SO_2$—, —N($R_6$)C(=O)N($R_7$)— or —N($R_6$)C(=O)O—, wherein each of $R_6$ and $R_7$ represents a hydrogen atom, $L_1$ represents an alkylene group or arylene group, and in the general formula (I), $R_1$ represents a halogen atom or alkyl group, m represents 0 or 1, and $R_2$ represents an alkyl group or aryl group.

Still much more preferable coupler is, in the general formula (II), $R_3$ represents a tertiary alkyl group, $X_1$ represents a hydrogen atom or halogen atom, $R_4$ and $R_5$ each independently represents a hydrogen atom or alkyl group, n represents an integer of 1 to 2, p represents 0 or 1, wherein when p represents 1, M represents —OC(=O)—, —N($R_6$)C(=O)— or —N($R_6$)$SO_2$—, wherein $R_6$ represents a hydrogen atom, $L_1$ represents an alkylene group or arylene group, and in the general formula (I), $R_1$ represents a halogen atom or alkyl group, m represents 0 or 1, and $R_2$ represents an alkyl group or aryl group.

Still much more preferable coupler is, in the general formula (II), $R_3$ represents a tertiary alkyl group, $X_1$ represents a hydrogen atom, $R_4$ and $R_5$ each independently represents a hydrogen atom or alkyl group, n represents an integer of 1 to 2, p represents 0 or 1, wherein when p represents 1, M represents —OC(=O)—, —N($R_6$)C(=O)— or —N($R_6$)$SO_2$—, wherein $R_6$ represents a hydrogen atom, $L_1$ represents an alkylene group or arylene group, and in the general formula (I), m represents 0, and $R_2$ represents an alkyl group or aryl group.

Most preferable coupler is, in the general formula (II), $R_3$ represents a tertiary alkyl group, $X_1$ represents a hydrogen atom, $R_4$ represents a hydrogen atom or methyl group, $R_5$ represents a methyl group, n represents an integer of 1 to 2, p represents 1, M represents —OC(=O)—, —N($R_6$)C(=O)— or —N($R_6$)$SO_2$—, wherein $R_6$ represents a hydrogen atom, $L_1$ represents an alkylene group, and in the general formula (I), m represents 0, and $R_2$ represents an alkyl group or aryl group.

Next, representative specific examples of the coupler of the present invention having a substituent represented by the general formula (I) are shown, but the present invention is not limited to these.

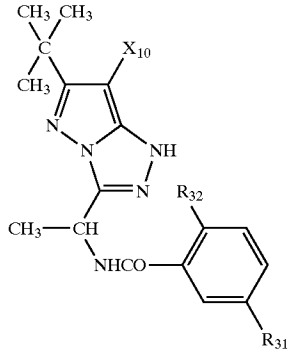
| Exemplified Coupler No. | $X_{10}$ | $R_{31}$ | $R_{32}$ |
|---|---|---|---|
| MA-1 | —H | I-1 | $—OC_{18}H_{37}$ |
| MA-2 | —H | I-4 | $—OC_{18}H_{37}$ |
| MA-3 | —H | I-7 | $—OC_{18}H_{37}$ |
| MA-4 | —H | I-11 | $—OC_{18}H_{37}$ |
| MA-5 | —H | I-17 | $—OC_{18}H_{37}$ |
| MA-6 | —H | I-18 | $—OC_{18}H_{37}$ |
| MA-7 | —H | I-19 | $—OC_{18}H_{37}$ |
| MA-8 | —H | I-21 | $—OC_{18}H_{37}$ |
| MA-9 | —H | I-22 | $—OC_{18}H_{37}$ |
| MA-10 | —H | I-24 | $—OC_{18}H_{37}$ |
| MA-11 | —H | I-28 | $—OC_{18}H_{37}$ |
| MA-12 | —H | I-51 | $—OC_{18}H_{37}$ |
| MA-13 | —H | I-57 | $—OC_{18}H_{37}$ |
| MA-14 | —H | I-19 | $—OC_{16}H_{33}$ |
| MA-15 | —H | I-19 | $—OCH_2CH(C_6H_{13})C_8H_{17}$ |
| MA-16 | —H | I-19 | $—OC_{18}H_{35}$ |
| MA-17 | —H | I-28 | $—OCH_2CH(C_2H_5)C_4H_9$ |
| MA-18 | —H | I-1 | $—OC_{22}H_{45}$ |
| MA-19 | —H | I-28 | $—OCH_3$ |
| MA-20 | —H | I-28 | $—OCH_2CH_2OCH_3$ |
| MA-21 | —H | I-26 | $—O—CH(C_{12}H_{25})COOC_2H_5$ |
| MA-22 | —H | I-5 | $—OCH_2CH_2OH$ |

-continued
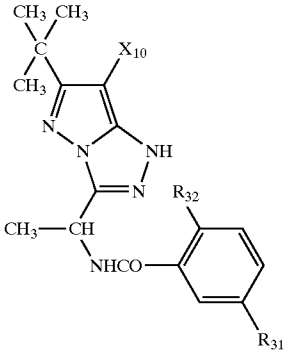
| Exemplified Coupler No. | $X_{10}$ | $R_{31}$ | $R_{32}$ |
|---|---|---|---|
| MA-23 | —H | I-5 | 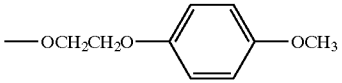 |
| MA-24 | —H | I-5 | 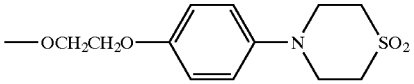 |
| MA-25 | —H | I-28 | 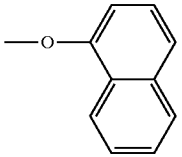 |
| MA-26 | —H | I-1 | $—SC_{18}H_{37}$ |
| MA-27 | —H | I-19 | 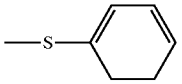 |
| MA-28 | —H | I-19 | 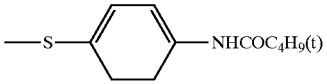 |

-continued
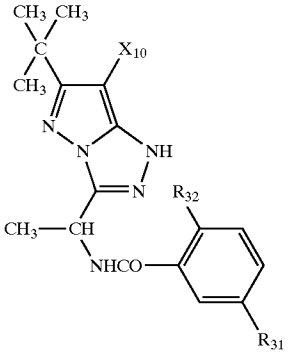
| Exemplified Coupler No. | $X_{10}$ | $R_{31}$ | $R_{32}$ |
|---|---|---|---|
| MA-29 | —H | I-5 | —S—$CH_2CH(C_2H_5)C_4H_9$ |
| MA-30 | —H | I-29 | —$SO_2C_{12}H_{25}$ |
| MA-31 | —H | I-28 | —$SO_2$—$C_6H_4$—$CH_3$ |
| MA-32 | —H | I-46 | —$SO_2$—$C_6H_4$—$OC_{12}H_{25}$ |
| MA-33 | —H | I-5 | —$NHSO_2CH_3$ |
| MA-34 | —H | I-28 | —$NHSO_2$—$C_6H_4$—$CH_3$ |
| MA-35 | —H | I-28 | —$N(C_4H_9)SO_2$—$C_6H_4$—$CH_3$ |

-continued
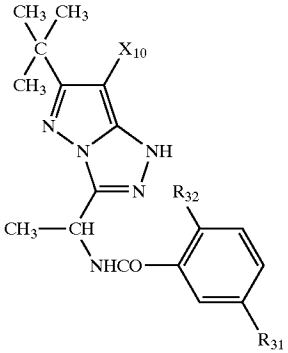
| Exemplified Coupler No. | $X_{10}$ | $R_{31}$ | $R_{32}$ |
|---|---|---|---|
| MA-36 | —H | I-28 | 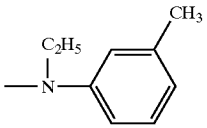 |
| MA-37 | —H | I-54 | $—N—(C_8H_{17})_2$ |
| MA-38 | —H | I-28 | 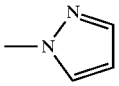 |
| MA-39 | —H | I-5 | —Cl |
| MA-40 | —H | I-28 | —Cl |
| MA-41 | —H | I-5 | —OH |
| MA-42 | —H | I-28 | $—O—CH_2COOH$ |
| MA-43 | —H | I-28 | 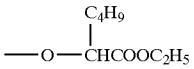 |
| MA-44 | —H | I-28 | 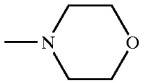 |

-continued
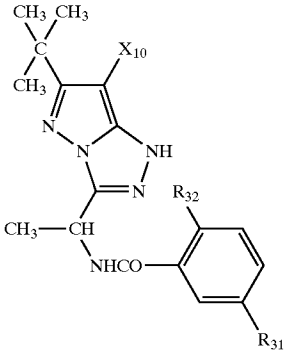
| Exemplified Coupler No. | $X_{10}$ | $R_{31}$ | $R_{32}$ |
|---|---|---|---|
| MA-45 | —H | I-28 | 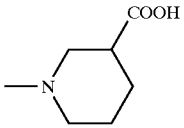 |
| MA-46 | —H | I-28 | 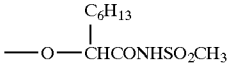 |
| MA-47 | —H | I-60 | $—OC_{18}H_{37}$ |
| MA-48 | —H | I-63 | $—OC_{18}H_{37}$ |
| MA-49 | —H | I-70 | $—OC_{18}H_{37}$ |
| MA-50 | —H | I-71 | $—OC_{18}H_{37}$ |
| MA-51 | —H | I-76 | $—OC_{18}H_{37}$ |
| MA-52 | —H | I-77 | $—OC_{18}H_{37}$ |
| MA-53 | —H | I-85 | $—OC_{18}H_{37}$ |
| MA-54 | —H | I-92 | $—OC_{18}H_{37}$ |
| MA-55 | —H | I-95 | $—OC_{18}H_{37}$ |
| MA-56 | —H | I-110 | $—OC_{18}H_{37}$ |
| MA-57 | —H | I-107 | $—SO_2C_{16}H_{33}$ |
| MA-58 | —H | I-110 | $—SO_2C_{16}H_{33}$ |
| MA-59 | —H | I-116 | $—SO_2C_{16}H_{33}$ |
| MA-60 | —Cl | I-1 | $—OC_{18}H_{37}$ |
| MA-61 | —Cl | I-19 | $—OC_{18}H_{37}$ |
| MA-62 | —Cl | I-24 | $—OC_{18}H_{37}$ |
| MA-63 | —Cl | I-1 | $—SO_2C_{16}H_{33}$ |
| MA-64 | —Cl | I-19 | $—SO_2C_{16}H_{33}$ |
| MA-65 | —Cl | I-24 | $—SO_2C_{16}H_{33}$ |

-continued
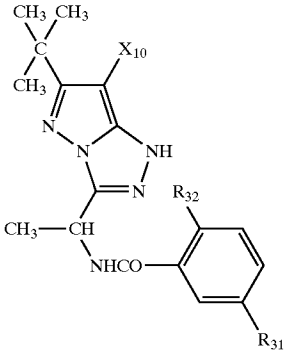
| Exemplified Coupler No. | $X_{10}$ | $R_{31}$ | $R_{32}$ |
|---|---|---|---|
| MA-66 | —Cl | I-28 | 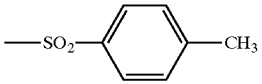 |
| MA-67 | —Cl | I-1 | $—SC_{18}H_{37}$ |
| MA-68 | —Cl | I-24 | $—SC_{18}H_{37}$ |
| MA-69 | 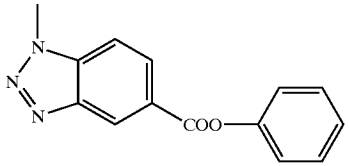 | I-1 | $—OC_{18}H_{37}$ |
| MA-70 | 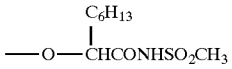 | I-19 | $—OC_{18}H_{37}$ |
| MA-71 | 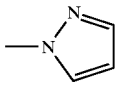 | I-1 | $—OC_{18}H_{37}$ |
| MA-72 | 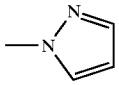 | I-19 | $—OC_{18}H_{37}$ |

-continued
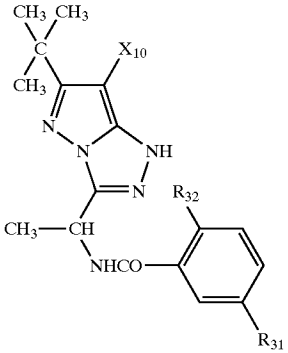
| Exemplified Coupler No. | $X_{10}$ | $R_{31}$ | $R_{32}$ |
|---|---|---|---|
| MA-73 | 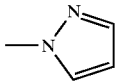 | I-19 | $—SO_2C_{16}H_{33}$ |
| MA-74 | 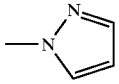 | I-28 | 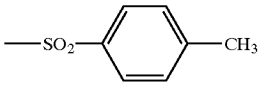 |
| MA-75 | 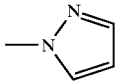 | I-1 | $—S_{18}H_{37}$ |
| MA-76 | 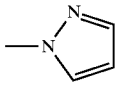 | I-19 | $—SCH_2COOC_{12}H_{25}$ |
| MA-77 | 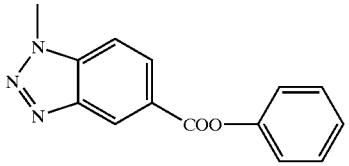 | I-4 | 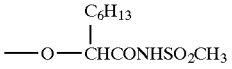 |

-continued
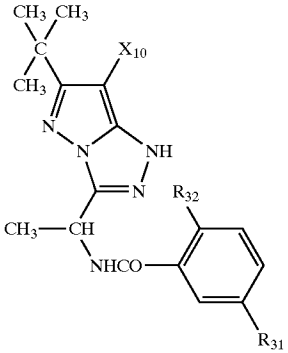
| Exemplified Coupler No. | $X_{10}$ | $R_{31}$ | $R_{32}$ |
|---|---|---|---|
| MA-78 | 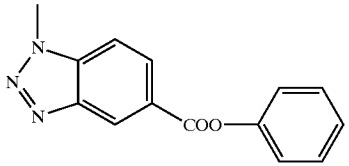 | I-19 | 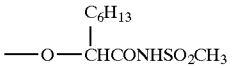 |
| MA-79 | 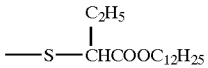 | I-1 | 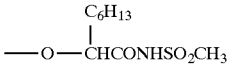 |
| MA-80 | 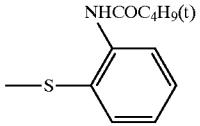 | I-1 | $—OC_{18}H_{37}$ |
| MA-81 | 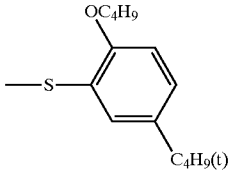 | I-28 | $—OCH_3$ |
| MA-82 | $—S—CH_2CH_2COOH$ | I-28 | $—OCH_3$ |
| MA-83 | $—S—CH_2COOH$ | I-28 | $—OCH_3$ |

-continued
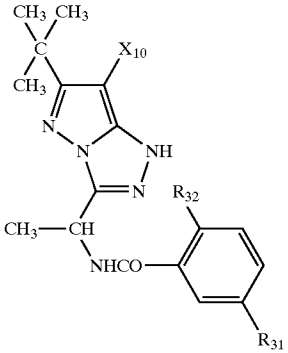
| Exemplified Coupler No. | $X_{10}$ | $R_{31}$ | $R_{32}$ |
|---|---|---|---|
| MA-84 | —S—$CH_2CH_2OH$ | I-28 | —$OCH_3$ |
| MA-85 | 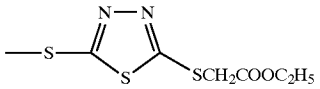 | I-28 | —$OCH_3$ |
| MA-86 | 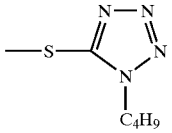 | I-28 | —$OCH_3$ |
| MA-87 | 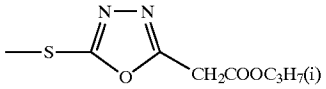 | I-28 | —$OCH_3$ |
| MA-88 | 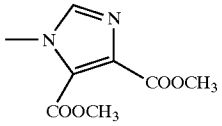 | I-28 | 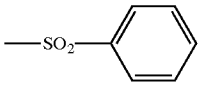 |
| MA-89 | —H | I-1 | —$OC_{18}H_{37}$ |
| MA-90 | —H | I-19 | —$OC_{18}H_{37}$ |
| MA-91 | —H | I-24 | —$OC_{18}H_{37}$ |
| MA-92 | —H | I-28 | —Cl |
| MA-93 | —H | I-28 | —$OCH_3$ |

-continued
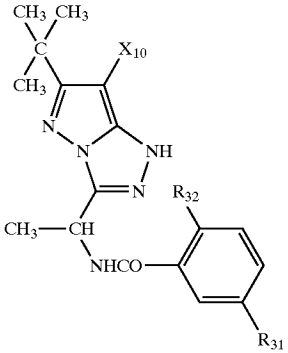
| Exemplified Coupler No. | $X_{10}$ | $R_{31}$ | $R_{32}$ |
|---|---|---|---|
| MA-94 | —H | I-1 | $—SO_2C_{18}H_{37}$ |
| MA-95 | —H | I-19 | $—SO_2C_{18}H_{37}$ |
| MA-96 | —H | I-28 | 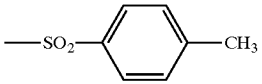 |
| MA-97 | —H | I-1 | $—SC_{18}H_{37}$ |
| MA-98 | —H | I-19 | $—SC_{18}H_{37}$ |
| MA-99 | —H | I-1 | 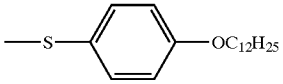 |
| MA-100 | —H | I-19 | 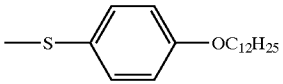 |
| MA-101 | —H | I-19 | $—SCH_2COOC_{12}H_{25}$ |
| MA-102 | —Cl | I-19 | $—OC_{18}H_{37}$ |
| MA-103 | —Cl | I-28 | —Cl |
| MA-104 | —Cl | I-24 | $—SO_2C_{18}H_{37}$ |
| MA-105 | —Cl | I-28 | 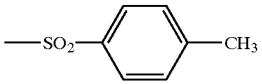 |

-continued
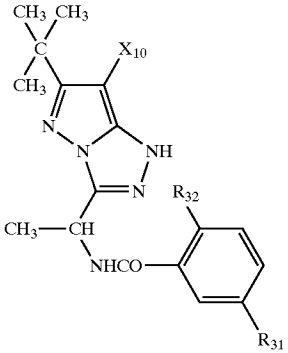
| Exemplified Coupler No. | $X_{10}$ | $R_{31}$ | $R_{32}$ |
|---|---|---|---|
| MA-106 | 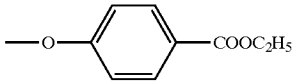 | I-19 | $—OC_{18}H_{37}$ |
| MA-107 | 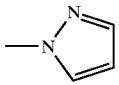 | I-1 | $—OC_{18}H_{37}$ |
| MA-108 | $—S—CH_2COOH$ | I-1 | $—OC_{18}H_{37}$ |
| MA-109 | 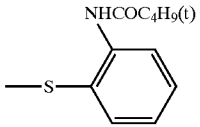 | I-1 | $—OC_{18}H_{37}$ |
| MA-110 | 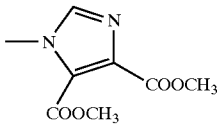 | I-1 | $—OC_{18}H_{37}$ |
| MA-111 | —H | I-1 | $—OC_{18}H_{37}$ |
| MA-112 | —H | I-19 | $—OC_{18}H_{37}$ |
| MA-113 | —H | I-24 | $—OC_{18}H_{37}$ |
| MA-114 | —H | I-28 | —Cl |
| MA-115 | —H | I-28 | $—OCH_3$ |
| MA-116 | —H | I-1 | $—SO_2C_{18}H_{37}$ |

-continued
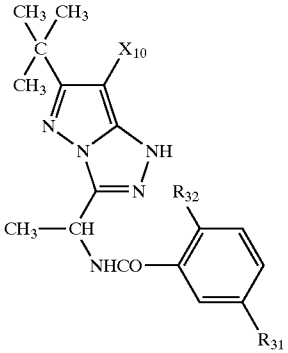
| Exemplified Coupler No. | $X_{10}$ | $R_{31}$ | $R_{32}$ |
|---|---|---|---|
| MA-117 | —H | I-19 | $—SO_2C_{18}H_{37}$ |
| MA-118 | —H | I-28 | 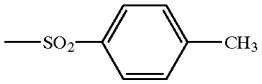 |
| MA-119 | —H | I-1 | $—SC_{18}H_{37}$ |
| MA-120 | —H | I-19 | $—SC_{18}H_{37}$ |
| MA-121 | —H | I-1 | 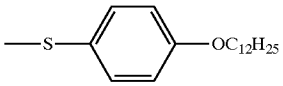 |
| MA-122 | —H | I-19 | 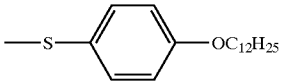 |
| MA-123 | —H | I-19 | $—SCH_2COOC_{12}H_{25}$ |
| MA-124 | —Cl | I-19 | $—OC_{18}H_{33}$ |
| MA-125 | —Cl | I-28 | —Cl |
| MA-126 | —Cl | I-24 | $—SO_2C_{18}H_{37}$ |
| MA-127 | —Cl | I-28 | 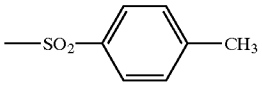 |

-continued
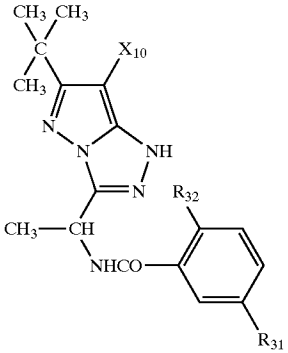
| Exemplified Coupler No. | $X_{10}$ | $R_{31}$ | $R_{32}$ |
|---|---|---|---|
| MA-128 | 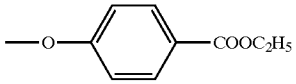 | I-19 | $—OC_{18}H_{37}$ |
| MA-129 | 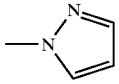 | I-1 | $—OC_{18}H_{37}$ |
| MA-130 | $—S—CH_2COOH$ | I-1 | $—OC_{18}H_{37}$ |
| MA-131 | 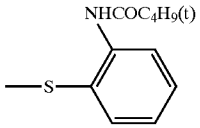 | I-1 | $—OC_{18}H_{37}$ |
| MA-132 | 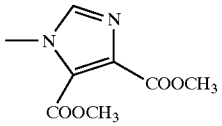 | I-1 | $—OC_{18}H_{37}$ |

-continued
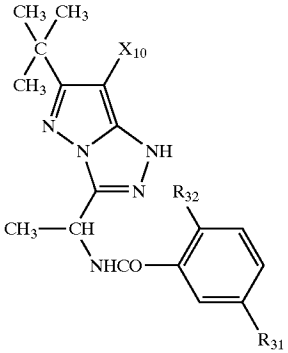
| Exemplified Coupler No. | $X_{10}$ | $R_{31}$ | $R_{32}$ |
|---|---|---|---|
| MA-133 | 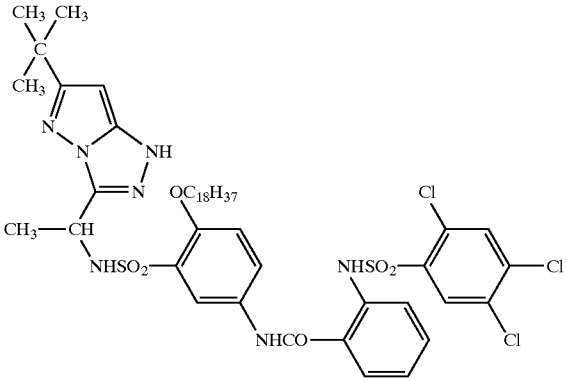 | | |

-continued
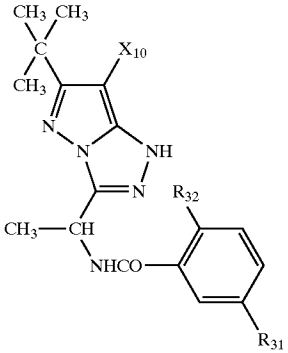
| Exemplified Coupler No. | $X_{10}$ | $R_{31}$ | $R_{32}$ |
|---|---|---|---|
| MA-134 | 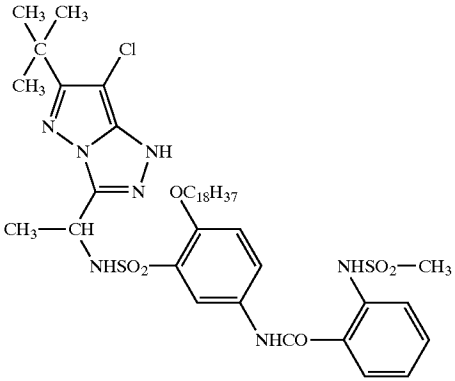 | | |

-continued
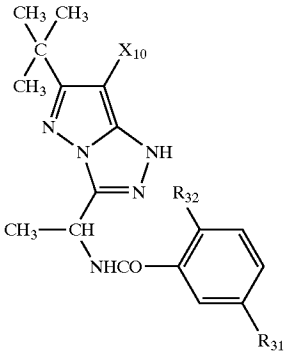
| Exemplified Coupler No. | $X_{10}$ | $R_{31}$ | $R_{32}$ |
|---|---|---|---|
| MA-135 | 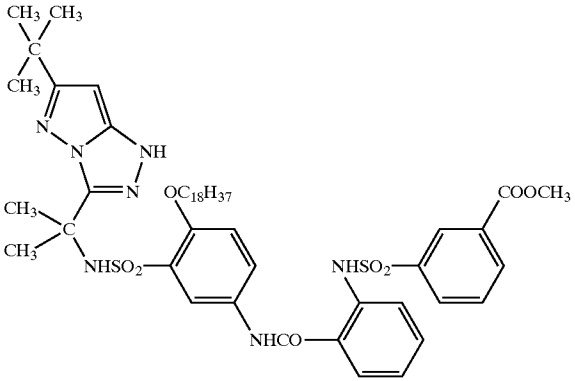 | | |

-continued
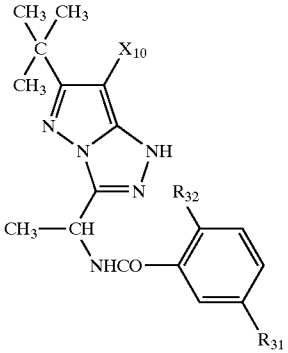
| Exemplified Coupler No. | $X_{10}$ | $R_{31}$ | $R_{32}$ |
|---|---|---|---|
| MA-136 | 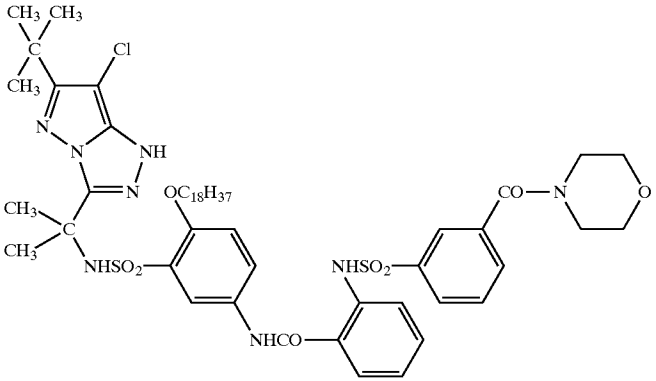 | | |

-continued
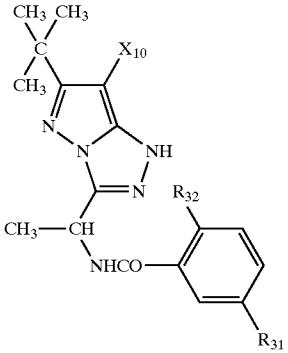
| Exemplified Coupler No. | $X_{10}$ | $R_{31}$ | $R_{32}$ |
|---|---|---|---|
| MA-137 | 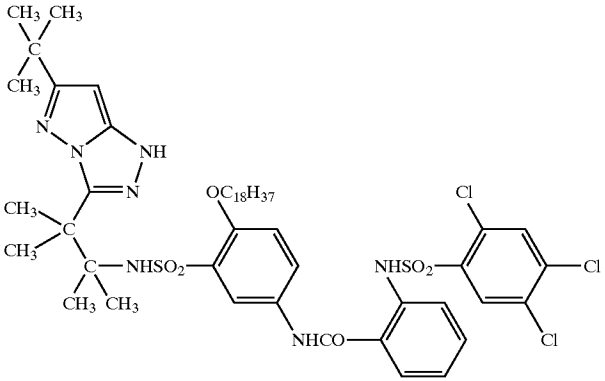 | | |

-continued
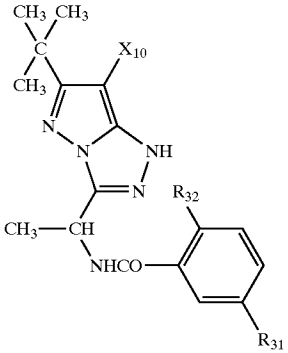
| Exemplified Coupler No. | $X_{10}$ | $R_{31}$ | $R_{32}$ |
|---|---|---|---|
| MA-138 | 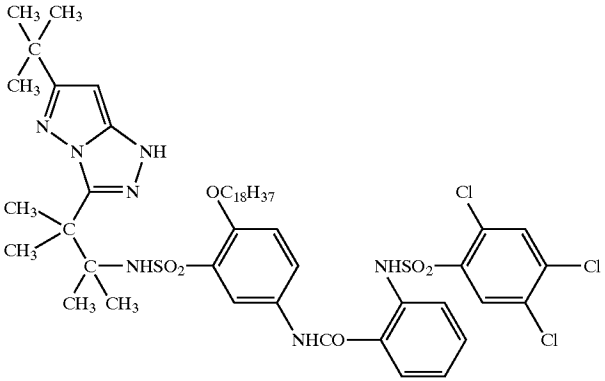 | | |

-continued
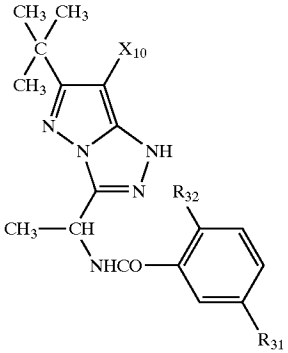
| Exemplified Coupler No. | $X_{10}$ | $R_{31}$ | $R_{32}$ |
|---|---|---|---|
| MA-139 | 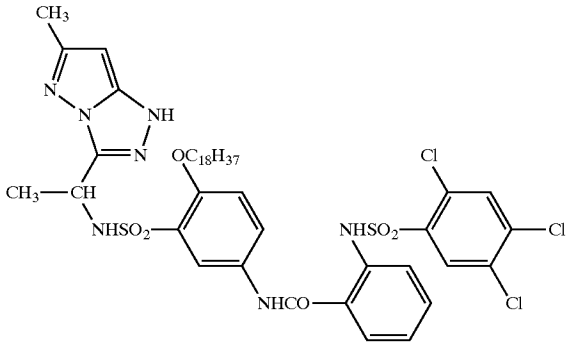 | | |
| MA-140 | 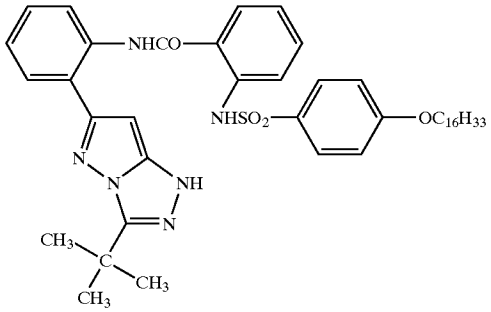 | | |

-continued
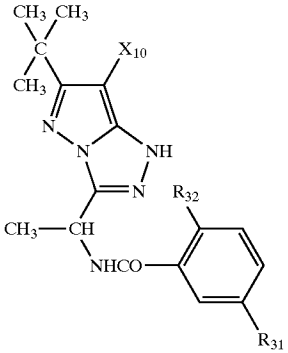
| Exemplified Coupler No. | $X_{10}$ | $R_{31}$ | $R_{32}$ |
|---|---|---|---|
| MA-141 | 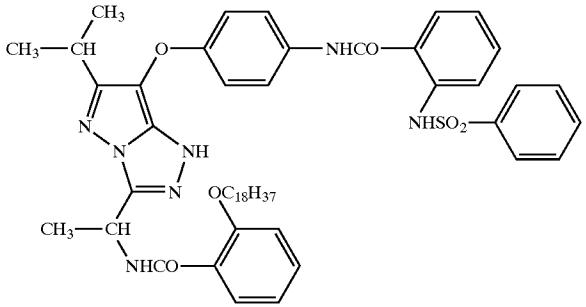 | | |

-continued
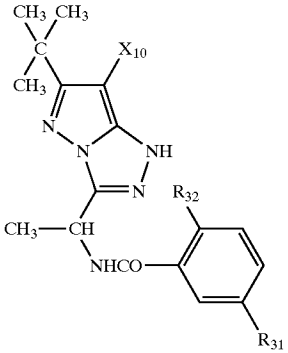
| Exemplified Coupler No. | $X_{10}$ | $R_{31}$ | $R_{32}$ |
|---|---|---|---|
| MA-142 | 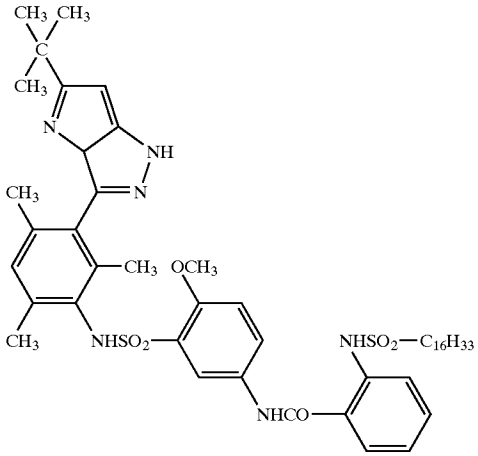 | | |

-continued
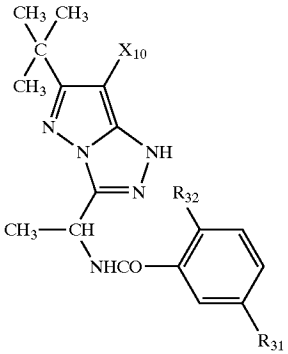
| Exemplified Coupler No. | $X_{10}$ | $R_{31}$ | $R_{32}$ |
|---|---|---|---|
| MA-143 | 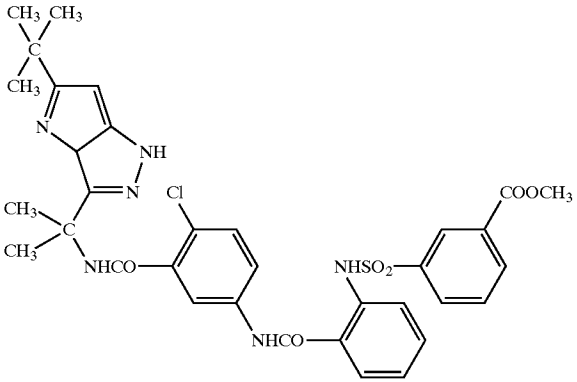 | | |

-continued
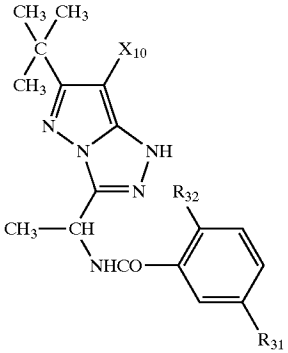
| Exemplified Coupler No. | $X_{10}$ | $R_{31}$ | $R_{32}$ |
|---|---|---|---|
| MA-144 | 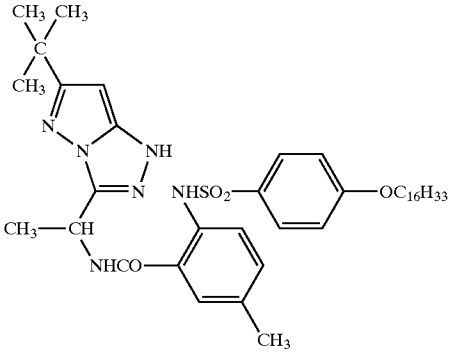 | | |

-continued
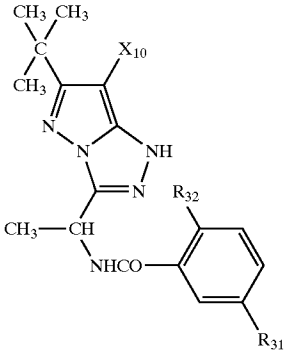
| Exemplified Coupler No. | $X_{10}$ | $R_{31}$ | $R_{32}$ |
|---|---|---|---|
| MA-145 | 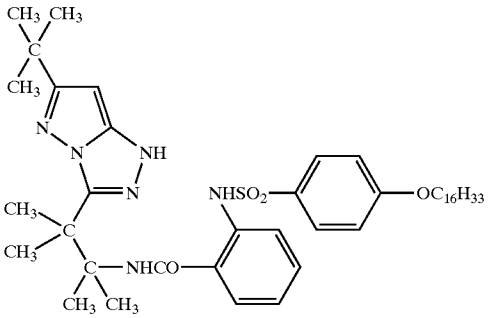 | | |

-continued
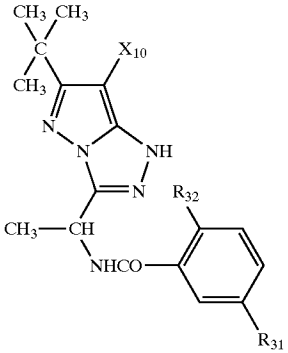
| Exemplified Coupler No. | $X_{10}$ | $R_{31}$ | $R_{32}$ |
|---|---|---|---|
| MA-146 | 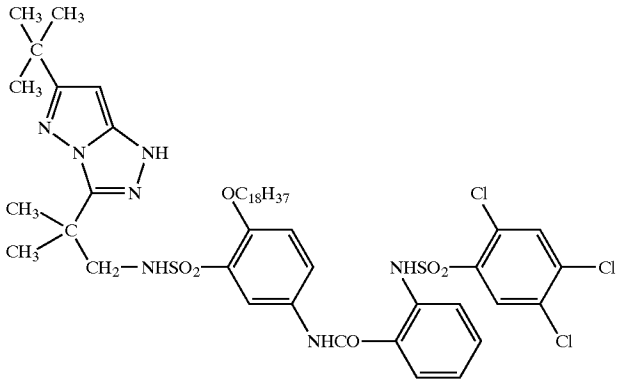 | | |

-continued
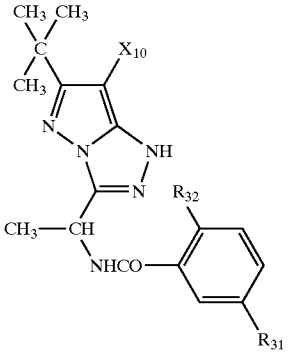
| Exemplified Coupler No. | $X_{10}$ | $R_{31}$ | $R_{32}$ |
|---|---|---|---|
| MA-147 | 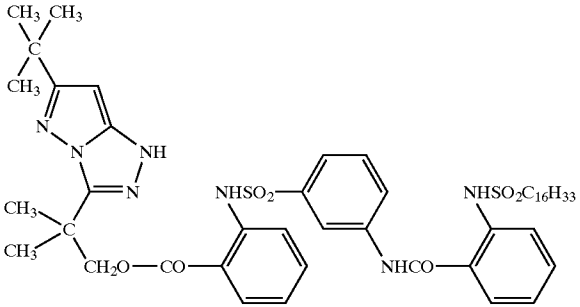 | | |
| MA-148 | 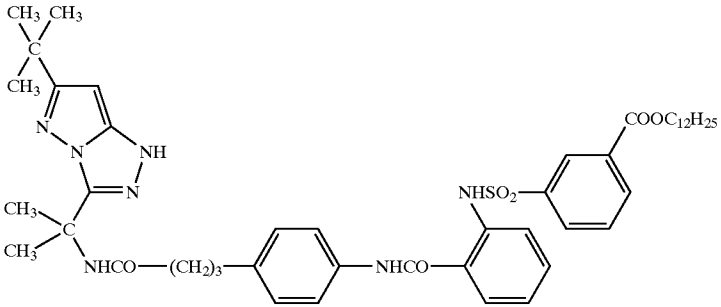 | | |

-continued
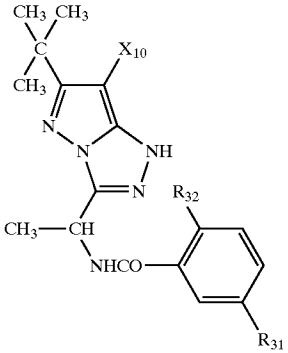
| Exemplified Coupler No. | $X_{10}$ | $R_{31}$ | $R_{32}$ |
|---|---|---|---|
| MA-149 | 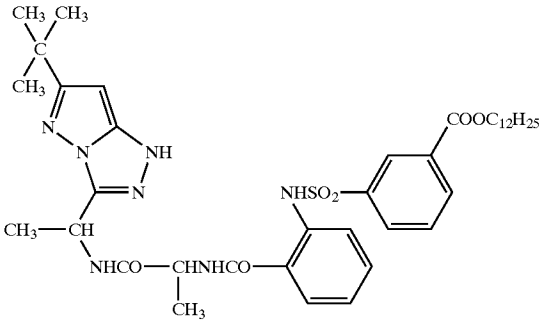 | | |

-continued
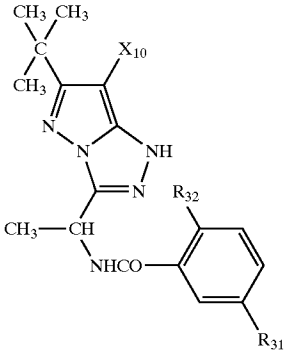
| Exemplified Coupler No. | $X_{10}$ | $R_{31}$ | $R_{32}$ |
|---|---|---|---|
| MA-150 | 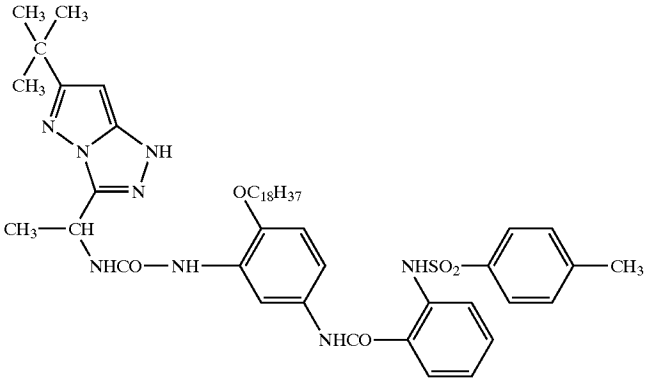 | | |

-continued
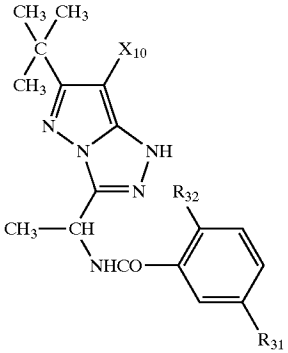
| Exemplified Coupler No. | $X_{10}$ | $R_{31}$ | $R_{32}$ |
|---|---|---|---|
| MA-151 | 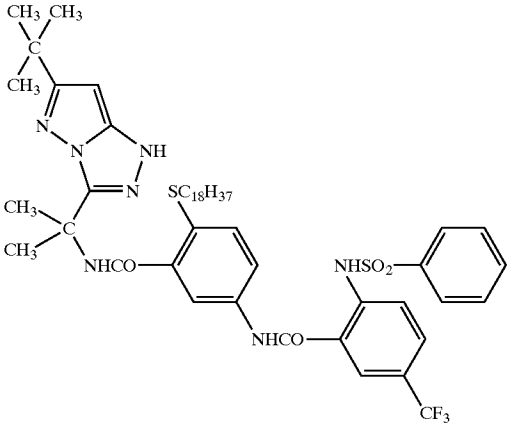 | | |

-continued
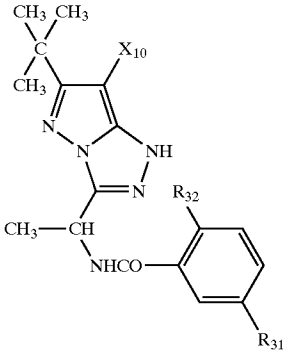
| Exemplified Coupler No. | $X_{10}$ | $R_{31}$ | $R_{32}$ |
|---|---|---|---|
| MA-152 | 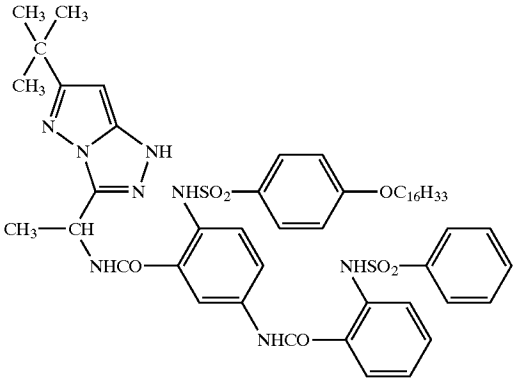 | | |

-continued
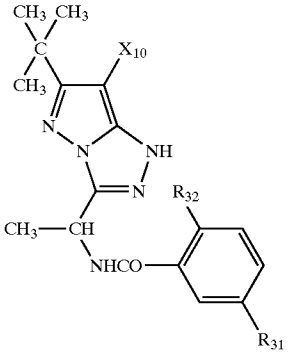
| Exemplified Coupler No. | $X_{10}$ | $R_{31}$ | $R_{32}$ |
|---|---|---|---|
| MA-153 | 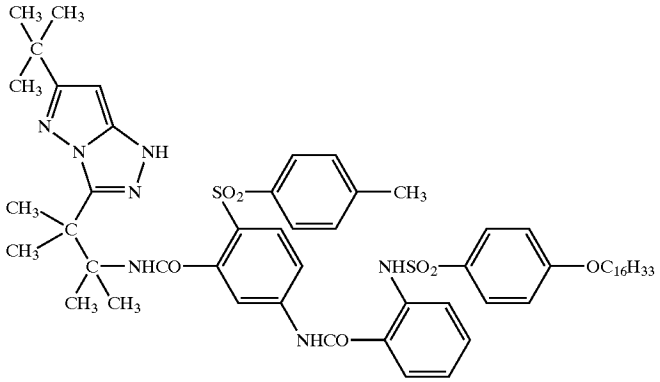 | | |

-continued
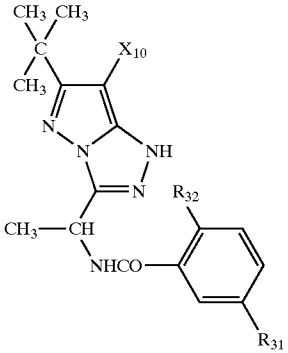
| Exemplified Coupler No. | $X_{10}$ | $R_{31}$ | $R_{32}$ |
|---|---|---|---|
| MA-154 | 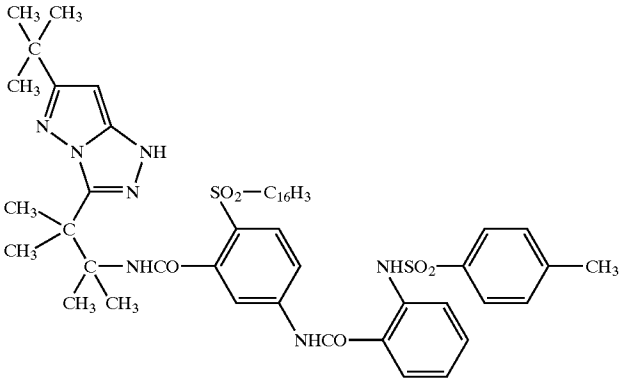 | | |

-continued
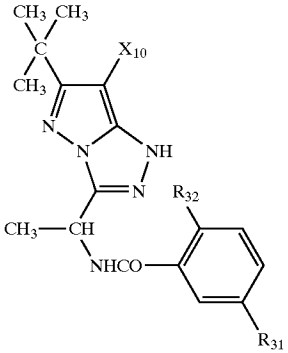
| Exemplified Coupler No. | $X_{10}$ | $R_{31}$ | $R_{32}$ |
|---|---|---|---|
| MA-155 | 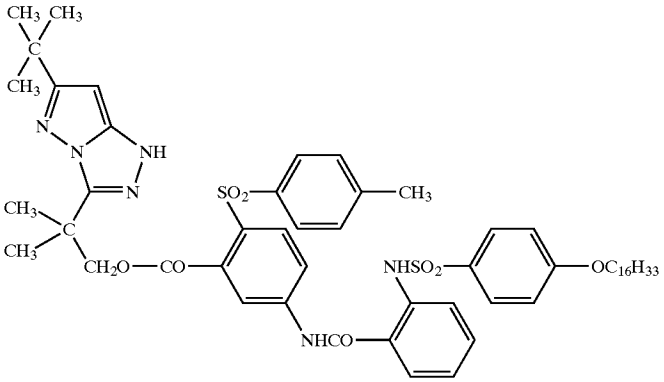 | | |

-continued
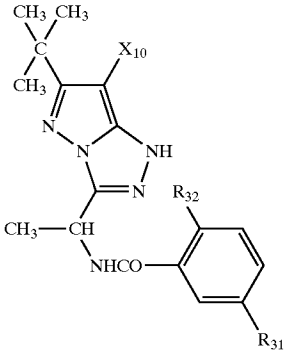
| Exemplified Coupler No. | $X_{10}$ | $R_{31}$ | $R_{32}$ |
|---|---|---|---|
| MA-156 | 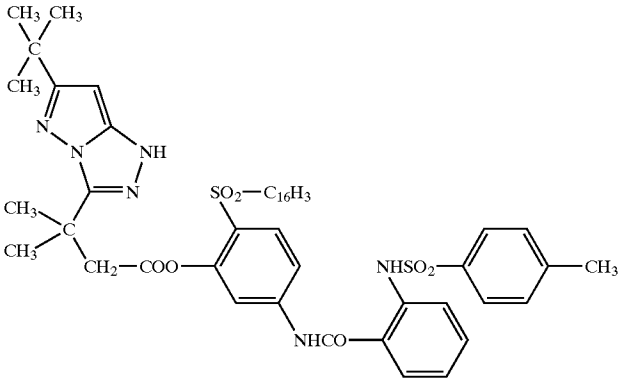 | | |

-continued
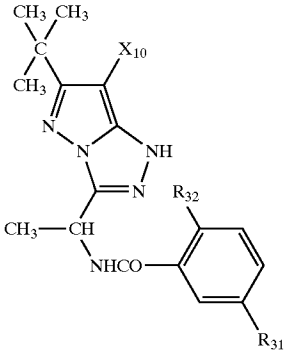
| Exemplified Coupler No. | $X_{10}$ | $R_{31}$ | $R_{32}$ |
|---|---|---|---|
| MA-157 | 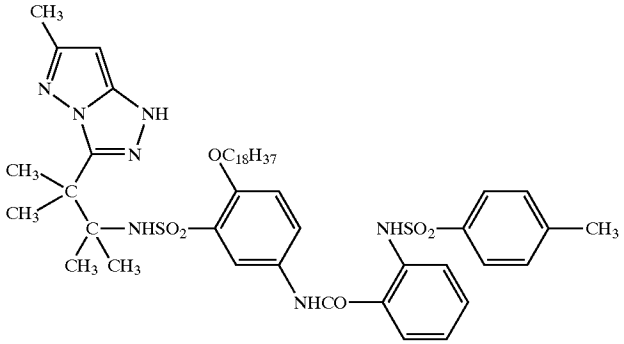 | | |

-continued
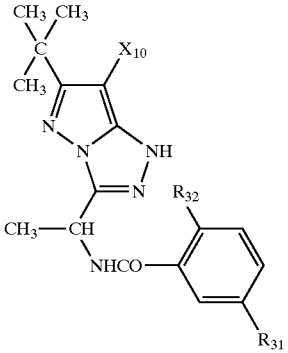
| Exemplified Coupler No. | $X_{10}$ | $R_{31}$ | $R_{32}$ |
|---|---|---|---|
| MA-158 | 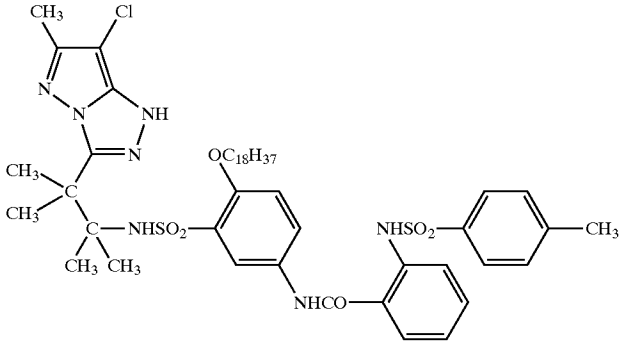 | | |

-continued
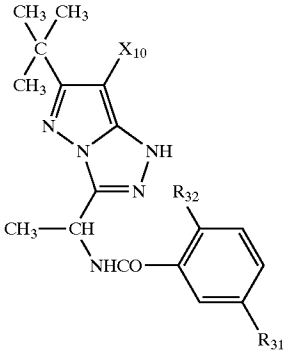
| Exemplified Coupler No. | $X_{10}$ | $R_{31}$ | $R_{32}$ |
|---|---|---|---|
| MA-159 | 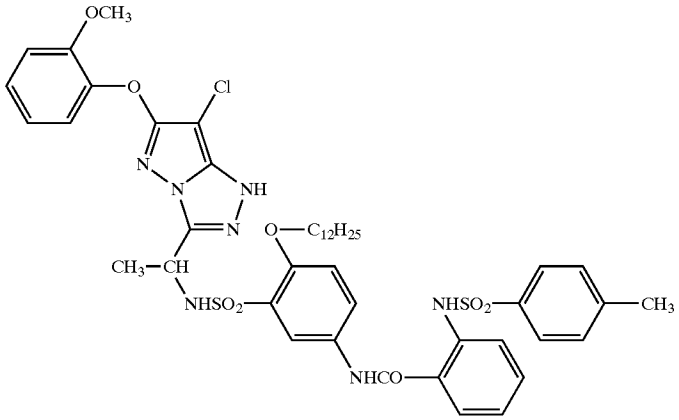 | | |

-continued
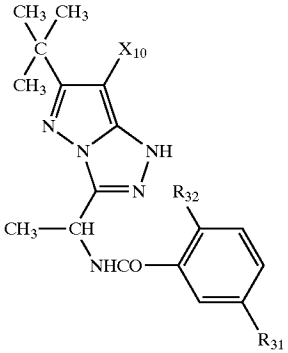
| Exemplified Coupler No. | $X_{10}$ | $R_{31}$ | $R_{32}$ |
|---|---|---|---|
| MA-160 | 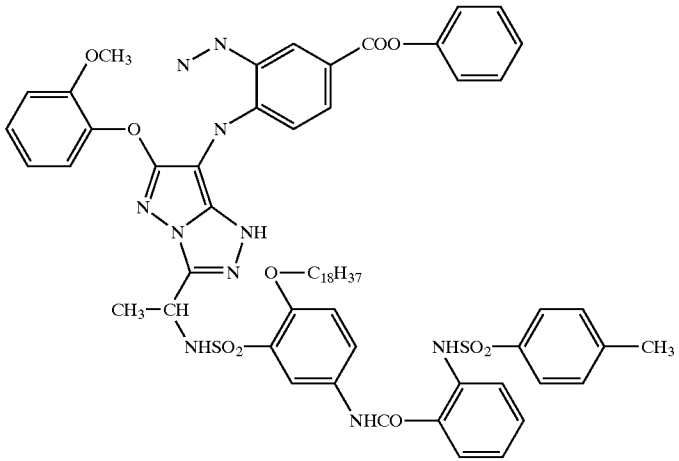 | | |

-continued
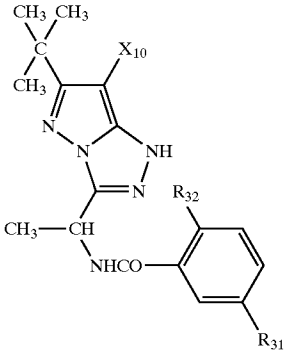
| Exemplified Coupler No. | $X_{10}$ | $R_{31}$ | $R_{32}$ |
|---|---|---|---|
| MA-161 | 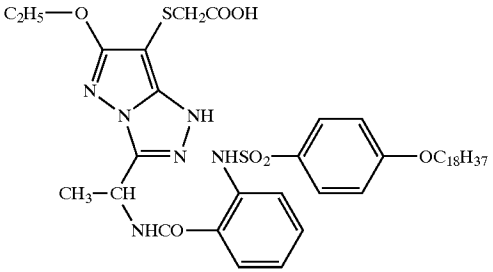 | | |
| MA-162 | 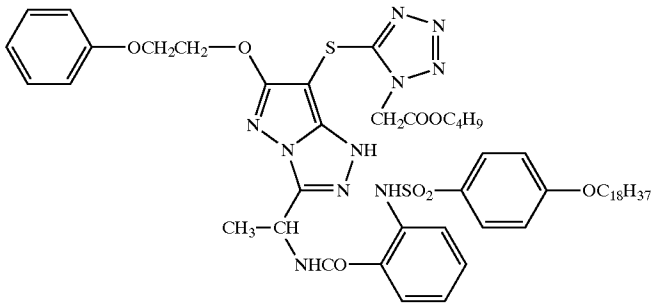 | | |

-continued
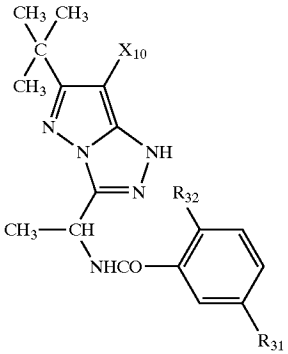
| Exemplified Coupler No. | $X_{10}$ | $R_{31}$ | $R_{32}$ |
|---|---|---|---|
| MA-163 | 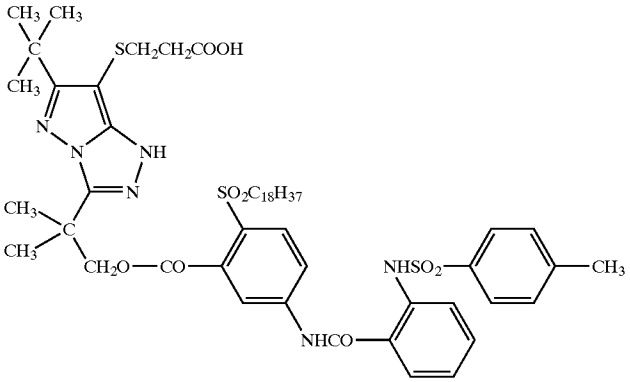 | | |

-continued
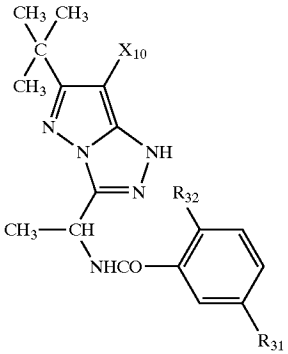
| Exemplified Coupler No. | $X_{10}$ | $R_{31}$ | $R_{32}$ |
|---|---|---|---|
| MA-164 | 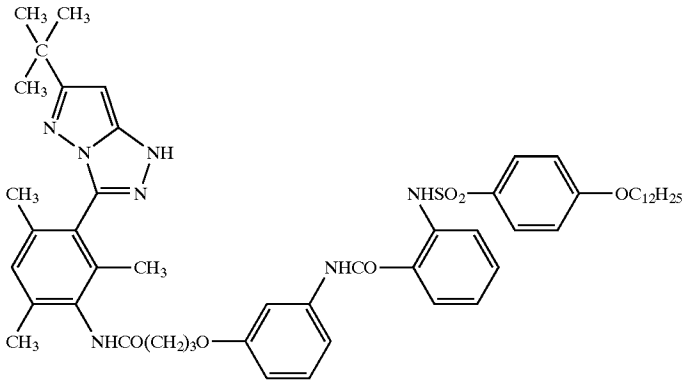 | | |

Next, the coupler represented by the general formula (III) and general formula (IV) will be described in detail.

$R_8$ in the general formula (III) and general formula (IV) represents a substituent, which has the same meaning as the group described above as $R_3$. When the substituent represented by $R_8$ represents a group capable of having a further substituent, $R_8$ may be substituted with a substituent described above as $R_1$. When $R_8$ is substituted with two or more substituents, those substituents may be the same or different.

$X_2$ in the general formula (III) and general formula (IV) represents a hydrogen atom or a group capable of splitting-off group upon reaction with an oxidized developing agent, which has the same meaning as the above $X_1$. $X_2$ may be substituted with a substituent described above as $R_1$. When $X_2$ is substituted with two or more substituents those substituents may be the same or different.

$L_2$ in the general formula (III) represents an alkylene group or aralkylene group. The alkylene group, aralkylene group and arylene group have the same meaning as the alkylene group, aralkylene group or arylene group, respectively, described above as $L_1$. When the alkylene group and aralkylene group represented by $L_2$ are groups capable of being further substituted, $L_2$ may be substituted with a substituent described above as $R_1$. When $L_2$ is substituted with two or more substituents, those substituents may be the same or different.

$Y_1$ in the general formula (III) and general formula (IV) represents a divalent linking group, for example, an alkylene group, aralkylene group, arylene group, —O—, —S—, —$SO_2$—, —N($R_{21}$)C(=O)—, —N($R_{21}$)C(=O)O—, —N($R_{21}$)C(=O)N($R_{22}$)—, —N($R_{21}$)$SO_2$—, —C(=O)O—, —C(=O)N($R_{21}$)— or —$SO_2$N($R_{22}$)—, wherein each of the linking groups bonds, through its left hand bonding, toward the direction of $Z_1$ of the general formula (III) or toward the direction of —NH$SO_2$— of the general formula (IV). Further, a plurality of the above divalent groups may be bonded to each other thereby forming a new divalent linking group. When two or more groups are bonded thereby forming a new divalent linking group, those groups may be the same or different. When the divalent group represented by $Y_1$ represents a group capable of being further substituted, $Y_1$ may be substituted with a substituent described above as $R_1$. When $Y_1$ represents substituted with two or more substituents, those substituents may be the same or different.

$R_{21}$ and $R_{22}$ each independently represents a hydrogen atom, alkyl group or aryl group. Preferable ranges of the alkyl group and aryl group represented by $R_{21}$ and $R_{22}$ are the same as the alkyl group and aryl group which are described above as $R_1$, respectively. The alkyl group and aryl group represented by $R_{21}$ and $R_{22}$ may be substituted by a substituent described above as $R_1$. When the alkyl group and aryl group represented by $R_{21}$ and $R_{22}$ are substituted by two or more substituents, those substituents may be the same or different.

q represents 0 or 1.

$Z_1$ in the general formula (III) represents —N($R_9$)C(=O)—, —N($R_9$)C(=O)O—, —N($R_9$)C(=O)N($R_{10}$)—, —OC(=O)—, —OC(=O)N($R_9$)—, —C(=O)N($R_9$)— or —C(=O)O—, wherein each of the groups bonds to $L_2$ of the general formula (III) through its left hand bonding. $R_9$ and $R_{10}$ independently represents a hydrogen atom, alkyl group or aryl group. Preferable ranges of the alkyl group and aryl group represented by $R_9$ and $R_{10}$ are the same as the alkyl group and aryl group which are described above as $R_1$, respectively. The alkyl group and aryl group represented by $R_9$ and $R_{10}$ may be substituted by a substituent described above as $R_1$. When the alkyl group and aryl group represented by $R_9$ and $R_{10}$ are substituted by two or more substituents, those substituents may be the same or different.

$R_{11}$ and $R_{12}$ in the general formula (IV) each independently represents a hydrogen atom, alkyl group or aryl group. Preferable ranges of the alkyl group and aryl group are the same as the alkyl group and aryl group described above as $R_1$, respectively.

$A_1$ in the general formula (III) and general formula (IV) is represented by the general formula (V).

$R_{13}$, $R_{14}$, $R_{15}$, $Z_2$, s and t of the general formula (V) will be described.

$R_{13}$ and $R_{14}$ in the general formula (V) each independently represents a substituent. The substituent represented by $R_{13}$ and $R_{14}$ has the same meaning as the substituent described above as R1. When the substituent represented by $R_{13}$ and $R_{14}$ represents a group capable of having a further substituent, $R_{13}$ and $R_{14}$ may have a substituent described above as $R_1$. When $R_{13}$ and $R_{14}$ have two or more substituents, those substituents may be the same or different.

s represents an integer of 0 to 5. t represents an integer of 0 to 3. t preferably represents 0.

$R_{15}$ in the general formula (V) represents an alkyl group or aryl group. Preferable ranges of the alkyl group and aryl group represented by $R_{15}$ are the same as the alkyl group and aryl group which are described above as $R_1$, respectively. The alkyl group and aryl group represented by $R_{15}$ may be substituted by a substituent described above as $R_1$. When the alkyl group and aryl group represented by $R_{15}$ are substituted by two or more substituents, those substituents may be the same or different.

$Z_2$ in the general formula (V) represents —C(=O)—, —$SO_2$—, —C(=O)N($R_{16}$)—, —C(=O)O— or —$SO_2$N($R_{16}$)—, wherein each of the groups bonds to —NH— of the general formula (V) through its left hand bonding. $R_{16}$ represents a hydrogen atom, alkyl group or aryl group. Preferable ranges of the alkyl group and aryl group represented by $R_{16}$ are the same as the alkyl group and aryl group described above as $R_1$, respectively. The alkyl group and aryl group represented by $R_{16}$ may be substituted by a substituent that is described above as $R_1$. When the alkyl group and aryl group represented by $R_{16}$ are substituted by two or more substituents, those substituents may be the same or different.

The substitution positions of the three substituents, —NH—($Z_2$)—$R_{15}$, —$(R_{14})_t$, and —O-phenylene-$(R_{13})_s$, are not particularly limited, but —O-phenylene-$(R_{13})_s$ preferably substitute at ortho-position, and —NH—($Z_2$)—$R_{15}$ preferably substitute at meta-position. In the group of —O-phenylene —$(R_{13})_s$, —$R_{13}$ may be substituted at any position from a viewpoint of the performance of the coupler. From a viewpoint of availability of a raw material for the coupler, —$R_{13}$ preferably substitutes at ortho- and/or para-position, and more preferably substitutes at para-position.

$L_2$ in the general formula (III) is preferably represented by the general formula (VI).

$R_{17}$, $R_{18}$, $R_{19}$ and $R_{20}$ in the general formula (VI) each independently represents a hydrogen atom, alkyl group or aryl group. Preferable ranges of the alkyl group and aryl group are the same as the alkyl group and aryl group described above as $R_1$, respectively. The alkyl group and aryl group represented by $R_{17}$, $R_{18}$, $R_{19}$ and $R_{20}$ may be substituted with a substituent described above as $R_1$. When $R_{17}$, $R_{18}$, $R_{19}$ and $R_{20}$ have two or more substituents, those substituents may be the same or different.

a in the general formula (VI) represents an integer of 0 to 2.

represents the position at which it attaches to the pyrazolotriazole skeleton of the general formula (III). * represents the position to which $Z_1$ in the general formula (III) attaches.

$A_1$ in the general formula (III) and the general formula (IV) preferably represents the group represented by the general formula (VII).

$R_{13}$, $R_{14}$, $R_{15}$, $R_{16}$, $Z_2$, s and t of the general formula (VII) have the same meaning as those in the general formula (V), respectively.

Next, the general formula (VIII) will be described.

$R_1$, m and $R_2$ of the general formula (VIII) have the same meaning as those described above for the general formula (I), respectively.

$R_3$, $R_4$, $R_5$, $X_1$ and M of the general formula (VIII) have the same meaning as those described above for the general formula (II), respectively.

$R_{13}$, $R_{14}$, s and t of the general formula (V) have the same meaning as those described above for the general formula (V), respectively.

Next, preferable range of the coupler represented by the general formula (III) and general formula (IV) will be described.

Preferable coupler is, in the general formula (III) and general formula (IV), $R_8$ represents an alkyl group, aryl group, alkoxy group, aryloxy group, anilino group, carbonamido group, alkoxycarbonylamino group or sulfonamido group, $X_2$ represents a hydrogen atom, halogen atom, aryloxy group, alkylthio group, arylthio group, heterocyclic thio group or aromatic heterocyclic group with its nitrogen atom attached to the pyrazolotriazole ring, $L_2$ represents an alkylene group, $Z_1$ represents —N($R_9$)C(=O)—, —N($R_9$)C(=O)O—, —OC(=O)— or —OC(=O)N($R_9$)—, $Y_1$ represents an alkylene group, aralkylene group or arylene group, q represents 0 or 1, and $A_1$ is represented by the general formula (V).

More preferable coupler is, in the general formula (III) and general formula (IV), $R_8$ represents an alkyl group, aryl group, alkoxy group or aryloxy group, $X_2$ represents a hydrogen atom, halogen atom, aryloxy group, alkylthio group, arylthio group, heterocyclic thio group or aromatic heterocyclic group with its nitrogen atom attached to the pyrazolotriazole ring, $L_2$ represents an alkylene group, $Z_1$ represents —N($R_9$)C(=O)—, —N($R_9$)C(=O)O—, —OC(=O)— or —OC(=O)N($R_9$)—, $Y_1$ represents an alkylene group, aralkylene group or arylene group, q represents 0 or 1, and $A_1$ is represented by the general formula (V).

Still more preferable coupler is, in the general formula (III) and general formula (IV), $R_8$ represents an alkyl group, aryl group, alkoxy group or aryloxy group, $X_2$ represents a hydrogen atom, halogen atom, aryloxy group, alkylthio group, arylthio group, heterocyclic thio group or aromatic heterocyclic group with its nitrogen atom attached to the pyrazolotriazole ring, $L_2$ is represented by the general formula (VI), $Z_1$ represents —N($R_9$)C(=O)—, —N($R_9$)C(=O)O—, —OC(=O)— or —OC(=O)N($R_9$)—, $Y_1$ represents an alkylene group, aralkylene group or arylene group, q represents 0 or 1, and $A_1$ is represented by the general formula (V).

Still more preferable coupler is, in the general formula (III) and general formula (IV), $R_8$ represents an alkyl group, $X_2$ represents a hydrogen atom or halogen atom, $L_2$ is represented by the general formula (VI), $Z_1$ represents —N($R_9$)C(=O)—, —N($R_9$)C(=O)O—, —OC(=O)— or —OC(=O)N($R_9$)—, $Y_1$ represents an alkylene group, aralkylene group or arylene group, q represents 0 or 1, and $A_1$ is represented by the general formula (V).

Still more preferable coupler is, in the general formula (III) and general formula (IV), $R_8$ represents a tertiary alkyl group, $X_2$ represents a hydrogen atom or halogen atom, $L_2$ is represented by the general formula (VI), $Z_1$ represents —N($R_9$)C(=O)—, —N($R_9$)C(=O)O—, —OC(=O)— or —OC(=O)N($R_9$)—, $Y_1$ represents an alkylene group, aralkylene group or arylene group, q represents 0 or 1, and $A_1$ is represented by the general formula (V).

Still more preferable coupler is, in the general formula (III) and general formula (IV), $R_8$ represents a tertiary alkyl group, $X_2$ represents a hydrogen atom or halogen atom, $L_2$ is represented by the general formula (VI), $Z_1$ represents —N($R_9$)C(=O)—, —N($R_9$)C(=O)O—, —OC(=O)— or —OC(=O)N($R_9$)—, wherein $R_9$ represents a hydrogen atom, $Y_1$ represents an alkylene group, aralkylene group or arylene group, q represents 0 or 1, and $A_1$ is represented by the general formula (VII).

Still more preferable coupler is, in the general formula (III) and general formula (IV), $R_8$ represents a tertiary alkyl group, $X_2$ represents a hydrogen atom, $L_2$ is represented by the general formula (VI), wherein each of $R_{17}$, $R_{18}$, $R_{19}$, and $R_{20}$ independently represents a hydrogen atom or methyl group, and a represents 0, $Z_1$ represents —N($R_9$)C(=O)—, —N($R_9$)C(=O)O— or —OC(=O)—, wherein $R_9$ represents a hydrogen atom, q represents 0, and $A_1$ is represented by the general formula (VII).

Still more preferable coupler is, in the general formula (III) and general formula (IV), $R_8$ represents a tertiary alkyl group, $X_2$ represents a hydrogen atom, $L_2$ is represented by the general formula (VI), wherein each of $R_{17}$, $R_{18}$, $R_{19}$, and $R_{20}$ independently represents a hydrogen atom or methyl group, and a represents 0, $Z_1$ represents —N($R_9$)C(=O)— or —OC(=O)—, wherein $R_9$ represents a hydrogen atom, q represents 0, and $A_1$ is represented by the general formula (VII).

Still more preferable coupler is, in the general formula (III) and general formula (IV), $R_8$ represents a tertiary alkyl group, $X_2$ represents a hydrogen atom, $L_2$ is represented by the general formula (VI), wherein each of $R_{17}$, $R_{18}$, $R_{19}$, and $R_{20}$ independently represents a hydrogen atom or methyl group, and a represents 0, $Z_1$ represents —N($R_9$)C(=O)— or —OC(=O)—, wherein $R_9$ represents a hydrogen atom, q represents 0, and $A_1$ is represented by the general formula (VII), wherein $R_{13}$ represents an alkyl group, halogen atom, aryl group, alkoxy group, aryloxy group, carbonamido group, sulfonamido group, alkoxycarbonyl group, sulfonyl group, cyano group or imido group, s represents an integer of 0 to 2, t represents 0, $Z_2$ represents —C(=O)— or —$SO_2$—, and $R_{15}$ represents an alkyl group or aryl group.

Still more preferable coupler is, in the general formula (III) and general formula (IV), $R_8$ represents a tertiary alkyl group, $X_2$ represents a hydrogen atom, $L_2$ is represented by the general formula (VI), wherein each of $R_{17}$, $R_{18}$, $R_{19}$, and $R_{20}$ independently represents a hydrogen atom or methyl group, and a represents 0, $Z_1$ represents —N($R_9$)C(=O)— or —OC(=O)—, wherein $R_9$ represents a hydrogen atom, q represents 0, and $A_1$ is represented by the general formula (VII), wherein $R_{13}$ represents an alkyl group, halogen atom, alkoxy group, carbonamido group, sulfonamido group, alkoxycarbonyl group or sulfonyl group, s represents an integer of 0 to 2, t represents 0, $Z_2$ represents —C(=O)— or —$SO_2$—, and $R_{15}$ represents an alkyl group or aryl group.

Most preferable coupler is, in the general formula (III) and general formula (IV), $R_8$ represents a tertiary alkyl group, $X_2$ represents a hydrogen atom, $L_2$ is represented by the general formula (VI), wherein each of $R_{17}$, $R_{18}$, $R_{19}$, and $R_{20}$ independently represents a hydrogen atom or methyl group, and a represents 0, $Z_1$ represents —N($R_9$)C(=O)— or —OC(=O)—, wherein $R_9$ represents a hydrogen atom, q represents 0, and $A_1$ is represented by the general formula (VII), wherein $R_{13}$ represents an alkyl group, halogen atom, alkoxycarbonyl group or alkoxy group, s represents an integer of 0 to 2, t represents 0, $Z_2$ represents —C(=O)— or —$SO_2$—, and $R_{15}$ represents an alkyl group or aryl group.

Preferable range of the couplers represented by the general formula (VIII) will be described.

Preferable coupler is, in the general formula (VIII), $R_1$ represents a halogen atom, alkyl group, alkoxy group, alkoxycarbonyl group, acylamino group, alkoxycarbonylamino group, aminocarbonylamino group, sulfonamido group or imido group, m represents an integer of 0 to 2, $R_2$ represents an alkyl group or aryl group, $R_3$ represents an alkyl group, aryl group, alkoxy group, aryloxy group, acylamino group, anilino group, alkylthio group, arylthio group or carbamoyl group, $R_4$ and $R_5$ each independently represents a hydrogen atom, alkyl group or aryl group, n represents an :integer of 0 to 3, M represents —OC(=O)—, —N($R_6$)C(=O)—, —N($R_6$)$SO_2$—, —N($R_6$)C(=O)N($R_7$)— or —N($R_6$)C(=O)O—, wherein $R_6$ and $R_7$ each independently represents a hydrogen atom or alkyl group, $R_{13}$ represents a substituent, s represents an integer of 0 to 3, $R_{14}$ represents a substituent, t represents in integer of 0 to 2, and $X_1$ represents a hydrogen atom, halogen atom, aryloxy group, alkylthio group, arylthio group, imido group or aromatic heterocyclic group with its nitrogen atom attached to the pyrazolotriazole ring.

Still more preferable coupler is, in the general formula (VIII), $R_1$ represents a halogen atom, alkyl group, alkoxy group, alkoxycarbonyl group, acylamino group, alkoxycarbonylamino group, aminocarbonylamino group or sulfonamido group, m represents an integer of 0 to 1, $R_2$ represents an alkyl group or aryl group, $R_3$ represents an alkyl group, aryl group, alkoxy group, aryloxy group or acylamino group, $R_4$ and $R_5$ each independently represents a hydrogen atom or alkyl group, n represents an integer of 0 to 2, M represents —OC(=O)—, —N($R_6$)C(=O)—, —N($R_6$)$SO_2$—, —N($R_6$)C(=O)N($R_7$)— or —N($R_6$)C(=O)O—, wherein $R_6$ and $R_7$ each independently represents a hydrogen atom or alkyl group, $R_{13}$ represents a substituent, $R_{14}$ represents a substituent, t represents 0 or 1, and $X_1$ represents a hydrogen atom, halogen atom, aryloxy group, alkylthio group, arylthio group, imido group or aromatic heterocyclic group with its nitrogen atom attached to the pyrazolotriazole ring.

Still more preferable coupler is, in the general formula (VIII), $R_1$ represents a halogen atom, alkyl group, alkoxy group, alkoxycarbonyl group, acylamino group, alkoxycarbonylamino group, aminocarbonylamino group or sulfonamido group, m represents an integer of 0 to 1, $R_2$ represents an alkyl group or aryl group, $R_3$ represents an alkyl group, $R_4$ and $R_5$ each independently represents a hydrogen atom or methyl group, n represents an integer of 0 to 2, M represents. —OC(=O)—, —N($R_6$)C(=O)—, —N($R_6$)$SO_2$—, —N($R_6$)C(=O)N($R_7$)— or —N($R_6$)C(=O)O—, wherein $R_6$ and $R_7$ each represents a hydrogen atom, $R_{13}$ represents a substituent, s represents an integer of 0 to 3, $R_{14}$ represents a substituent, t represents 0 or 1, and $X_1$ represents a hydrogen atom, halogen atom, aryloxy group, alkylthio group, arylthio group, imido group or aromatic heterocyclic group with its nitrogen atom attached to the pyrazolotriazole ring.

Still more preferable coupler is, in the general formula (VIII), $R_1$ represents a halogen atom, alkyl group, alkoxy group, alkoxycarbonyl group, acylamino group, alkoxycarbonylamino group, aminocarbonylamino group or sulfonamido group, m represents an integer of 0 to 1, $R_2$ represents an alkyl group or aryl group, $R_3$ represents a tertiary alkyl group, $R_4$ and $R_5$ each independently represents a hydrogen atom or methyl group, n represents an integer of 0 to 2, M represents —OC(=O)—, —N($R_6$)C(=O)—, —N($R_6$)$SO_2$—, —N($R_6$)C(=O)N($R_7$)— or —N($R_6$)C(=O)O—, $R_6$ arid $R_7$ each represents a hydrogen atom, $R_{13}$ represents a substituent, s represents an integer of 0 to 3, $R_{14}$ represents a substituent, t represents 0 or 1, and $X_1$ represents a hydrogen atom, halogen atom, aryloxy group, alkylthio group, arylthio group, imido group or aromatic heterocyclic group with its nitrogen atom attached to the pyrazolotriazole ring.

Still more preferable coupler is, in the general formula (VIII), m represents 0, $R_2$ represents an alkyl group or aryl group, $R_3$ represents a tertiary alkyl group, $R_4$ and $R_5$ each independently represents a hydrogen atom or methyl group, n represents 0 or 1, M represents —OC(=O)—, —N($R_6$)C(=O)— or —N($R_6$)$SO_2$—, wherein $R_6$ represents a hydrogen atom, $R_{13}$ represents a substituent, s represents an integer of 0 to 3, t represents 0, and $X_1$ represents a hydrogen atom, halogen atom, aryloxy group, alkylthio group, arylthio group, imido group or aromatic heterocyclic group with its nitrogen atom attached to the pyrazolotriazole ring.

Most preferable coupler is, in the general formula (VIII), m represents 0, $R_2$ represents an alkyl group or aryl group, $R_3$ represents a tertiary alkyl group, $R_4$ and $R_5$ each independently represents a hydrogen atom or methyl group, n represents 0 or 1, M represents —OC(=O)—, —N($R_6$)C(=O)— or —N($R_6$)$SO_2$—, $R_6$ represents a hydrogen atom, $R_{13}$ represents a substituent, s represents an integer of 0 to 3, t represents 0, and $X_1$ represents a hydrogen atom.

Next, representative specific examples of the couplers represented by the general formula (III), general formula (IV) and general formula (VIII) are shown, but the present invention is not limited to these.

| Exemplified Coupler No | $X_{10}$ | $R_{60}$ | $R_{61}$ |
|---|---|---|---|
| | | 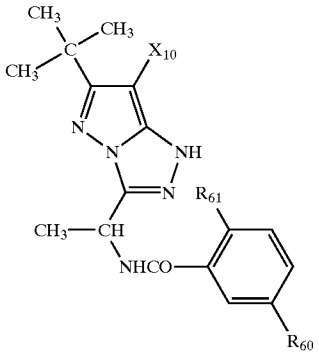 | |
| M-1 | —H | —$NHSO_2CH_3$ | 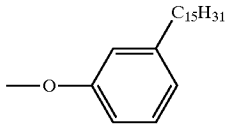 |
| M-2 | " | —$NHSO_2C_4H_9$ | " |
| M-3 | " | —$NHSO_2CH_2CH(C_2H_5)C_4H_9$ | " |
| M-4 | " | —$NHSO_2C_{16}H_{33}$ | " |
| M-5 | " | —$NHSO_2CH(CH_2COOC_2H_5)COOC_2H_5$ | " |
| M-6 | " | 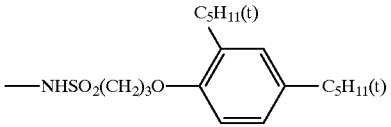 | " |
| M-7 | " | 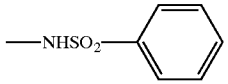 | " |

-continued
| | | | |
|---|---|---|---|
| M-8 | " | 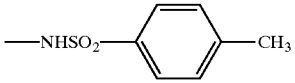 | " |
| M-9 | " | 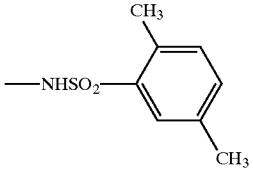 | " |
| M-10 | " | 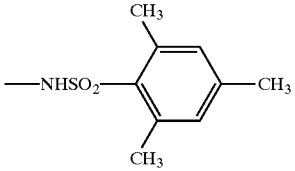 | " |
| M-11 | " | 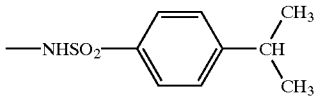 | " |
| M-12 | " | 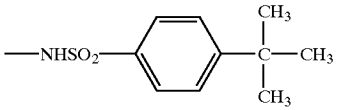 | " |
| M-13 | " | 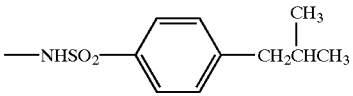 | " |
| M-14 | " | 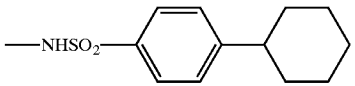 | " |
| M-15 | " | 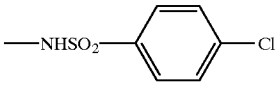 | " |

-continued
| | | | |
|---|---|---|---|
| M-16 | " | 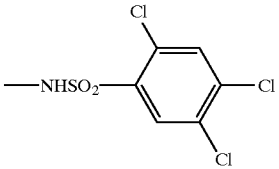 | " |
| M-17 | " | 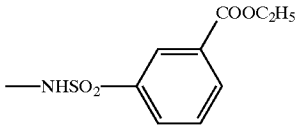 | " |
| M-18 | —H | 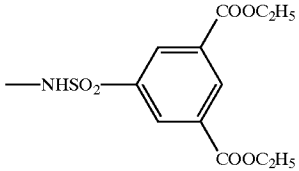 | 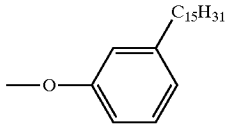 |
| M-19 | " | 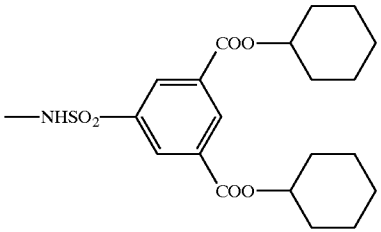 | " |
| M-20 | " | 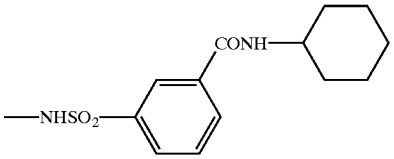 | " |
| M-21 | " | 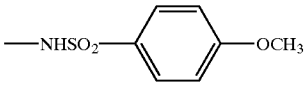 | " |

-continued
| | | | |
|---|---|---|---|
| M-22 | " | 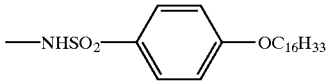 | " |
| M-23 | " | 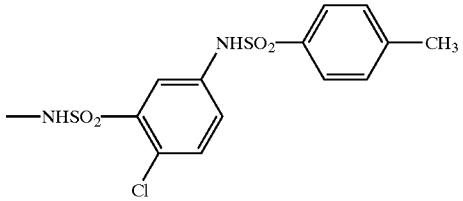 | " |
| M-24 | " | 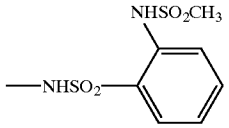 | " |
| M-25 | " | 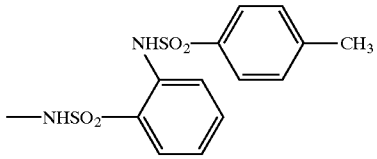 | " |
| M-26 | " | 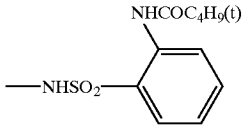 | " |
| M-27 | " | 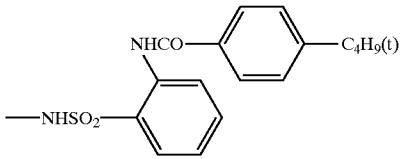 | " |

-continued
| | | | |
|---|---|---|---|
| M-28 | " | 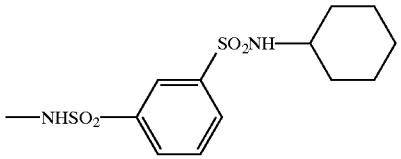 | " |
| M-29 | " | 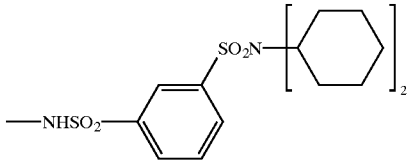 | " |
| M-30 | " | 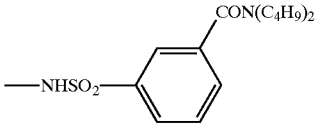 | " |
| M-31 | —H | I-1 | 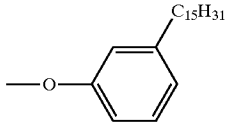 |
| M-32 | " | I-2 | " |
| M-33 | " | I-7 | " |
| M-34 | " | I-5 | " |
| M-35 | " | I-17 | " |
| M-36 | " | I-14 | " |
| M-37 | " | I-18 | " |
| M-38 | " | I-19 | " |
| M-39 | " | I-36 | " |
| M-40 | " | I-35 | " |
| M-41 | " | I-42 | " |
| M-42 | " | I-45 | " |
| M-43 | " | I-44 | " |
| M-44 | " | I-46 | " |
| M-45 | " | I-20 | " |
| M-46 | " | I-22 | " |
| M-47 | " | I-37 | " |
| M-48 | " | I-23 | " |
| M-49 | " | I-25 | " |
| M-50 | " | I-24 | " |
| M-51 | " | I-26 | " |
| M-52 | " | I-51 | " |

-continued
| | | | |
|---|---|---|---|
| M-53 | " | I-57 | " |
| M-54 | " | I-55 | " |
| M-55 | " | I-31 | " |
| M-56 | " | I-21 | " |
| M-57 | " | I-30 | " |
| M-58 | —H | 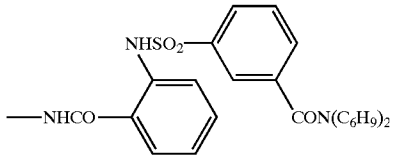 | 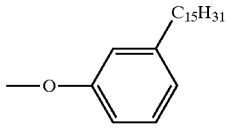 |
| M-59 | " | 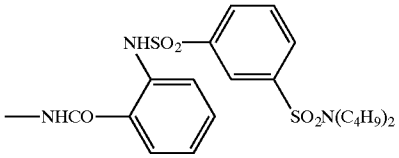 | " |
| M-60 | " | I-40 | " |
| M-61 | " | I-39 | " |
| M-62 | " | 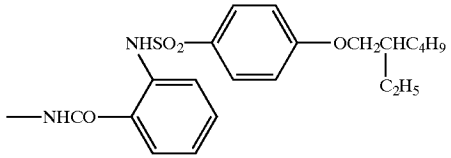 | 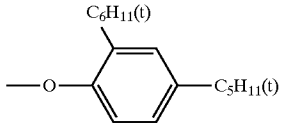 |
| M-63 | " | I-46 | " |
| M-64 | " | I-20 | " |
| M-65 | " | I-22 | " |
| M-66 | " | I-37 | " |
| M-67 | " | I-23 | " |
| M-68 | " | I-25 | " |
| M-69 | " | I-24 | " |
| M-70 | " | I-26 | " |
| M-71 | " | I-29 | " |
| M-72 | " | I-28 | 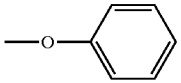 |

-continued
| | | | |
|---|---|---|---|
| M-73 | " | " | 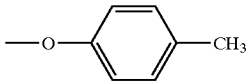 |
| M-74 | " | " | 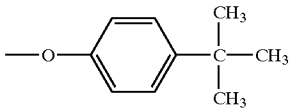 |
| M-75 | " | " | 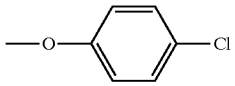 |
| M-76 | " | " | 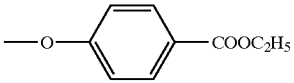 |
| M-77 | " | " | 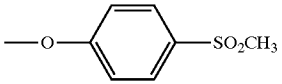 |
| M-78 | " | " | 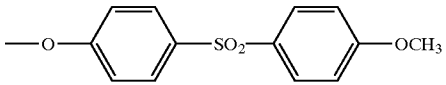 |
| M-79 | —H | I-28 | 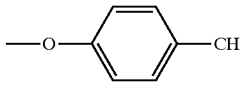 |
| M-80 | " | " | 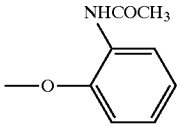 |
| M-81 | " | " | 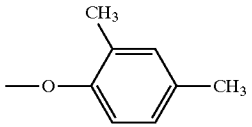 |

-continued
| | | | |
|---|---|---|---|
| M-82 | " | " | 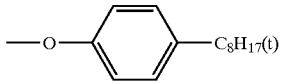 |
| M-83 | " | " | 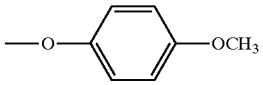 |
| M-84 | " | " | 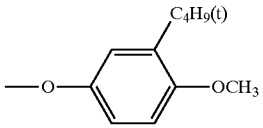 |
| M-85 | " | " | 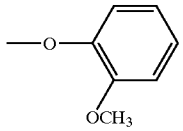 |
| M-86 | " | " | 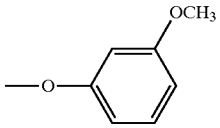 |
| M-87 | " | " | 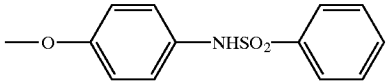 |
| M-88 | " | " | 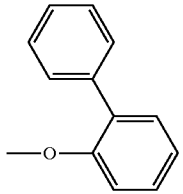 |
| M-89 | " | " | 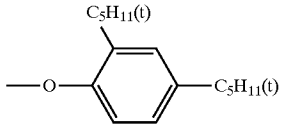 |

-continued
| | | | |
|---|---|---|---|
| M-90 | " | " | 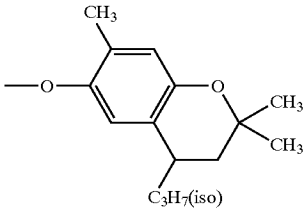 |
| M-91 | —Cl | I-19 | 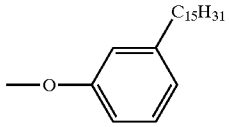 |
| M-92 | 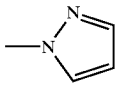 | " | " |
| M-93 | 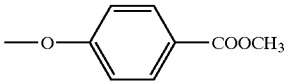 | " | " |
| M-94 | 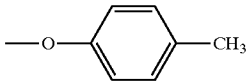 | " | " |
| M-95 | 13 $SCH_2COOH$ | I-28 | 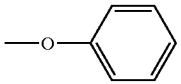 |
| M-96 | $—SCH_2CH_2COOH$ | " | " |
| M-97 | $—SCH_2CH_2OH$ | " | " |
| M-98 | 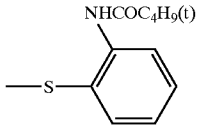 | " | " |

-continued
| | | | |
|---|---|---|---|
| M-99 | 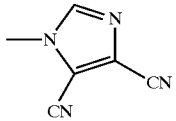 | " | " |
| M-100 | 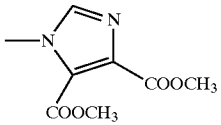 | " | " |
| M-101 | —Cl | —$NHSO_2CH_3$ | 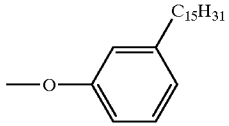 |
| M-102 | " | 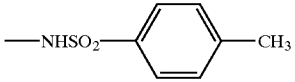 | " |
| M-103 | 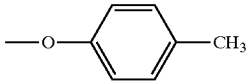 | " | " |
| M-104 | 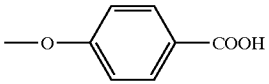 | " | " |
| M-105 | —$SCH_2COOH$ | " | " |
| M-106 | 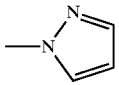 | " | " |
| M-107 | 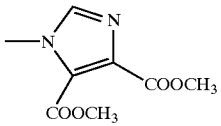 | " | " |

-continued
| | | | | |
|---|---|---|---|---|
| M-108 | 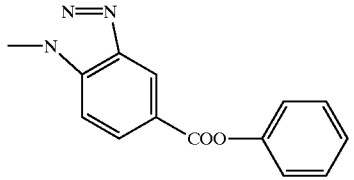 | | " | " |
| M-109 | 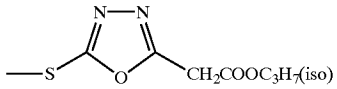 | | " | " |
| M-110 | 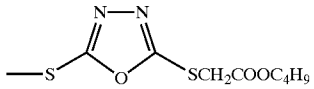 | | " | " |
| M-111 | 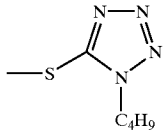 | 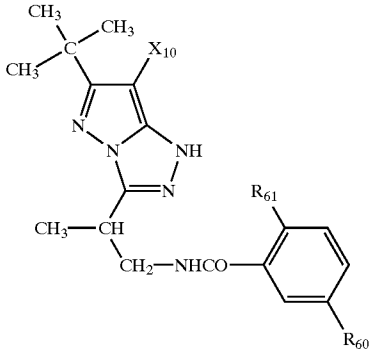 | " | " |
| M-112 | —H | | —$NHSO_2CH_3$ | 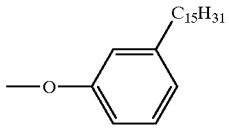 |

-continued
| | | | |
|---|---|---|---|
| M-113 | " | 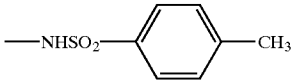 | " |
| M-114 | " | 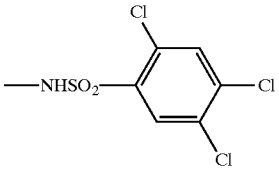 | " |
| M-115 | " | 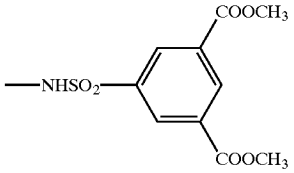 | " |
| M-116 | " | I-1 | " |
| M-117 | " | I-19 | " |
| M-118 | " | I-20 | " |
| M-119 | " | I-22 | " |
| M-120 | " | I-23 | " |
| M-121 | " | I-25 | " |
| M-122 | " | I-24 | " |
| M-123 | " | I-26 | " |
| M-124 | " | I-29 | " |
| M-125 | " | I-71 | " |
| M-126 | " | I-79 | " |
| M-127 | " | I-83 | " |
| M-128 | " | I-28 | 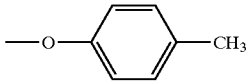 |
| M-129 | " | " | 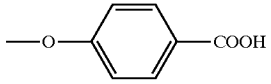 |
| M-130 | —Cl | I-1 | 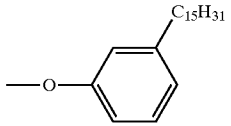 |

-continued
| | | | |
|---|---|---|---|
| M-131 | " | I-19 | " |
| M-132 | " | I-24 | " |
| M-133 | 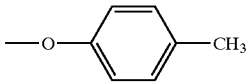 | I-19 | " |
| M-134 | —H | —$NHSO_2CH_3$ | 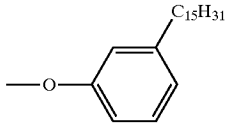 |
| M-135 | " | 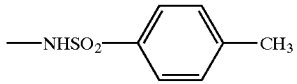 | " |
| M-136 | " | I-1 | " |
| M-137 | " | I-19 | " |
| M-138 | " | I-22 | " |
| M-139 | " | I-24 | " |
| M-140 | " | I-26 | " |
| M-141 | " | I-28 | " |
| M-142 | " | I-51 | " |
| M-143 | " | I-56 | " |
| M-144 | " | I-71 | " |
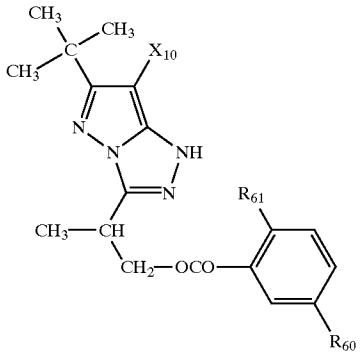

-continued
| | | | |
|---|---|---|---|
| M-145 | " | I-28 | 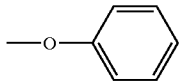 |
| M-146 | " | | " |
| M-147 | " | 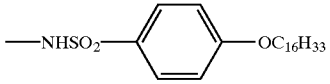 | " |
| M-148 | —Cl | —$NHSO_2CH_3$ | 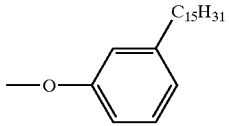 |
| M-149 | " | 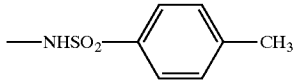 | " |
| M-150 | " | I-1 | " |
| M-151 | " | I-19 | " |
| M-152 | " | I-24 | " |
| M-153 | " | I-26 | " |
| M-154 | " | I-28 | 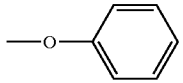 |
| M-155 | 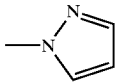 | " | " |
| M-156 | 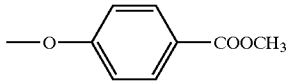 | " | " |

-continued
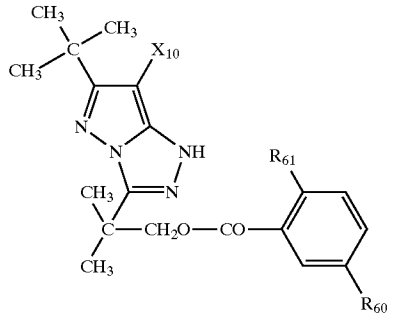
| | | | |
|---|---|---|---|
| M-157 | —H | —$NHSO_2CH_3$ | 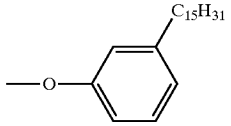 |
| M-158 | " | 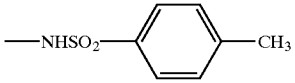 | " |
| M-159 | " | I-1 | " |
| M-160 | " | I-19 | " |
| M-161 | " | I-22 | " |
| M-162 | " | I-24 | " |
| M-163 | " | I-26 | " |
| M-164 | " | I-28 | " |
| M-165 | " | I-51 | " |
| M-166 | " | I-56 | " |
| M-167 | " | I-71 | " |
| M-168 | " | I-28 | 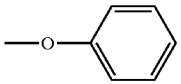 |
| M-169 | " | " | " |
| M-170 | " | 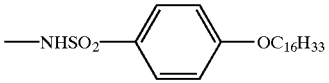 | " |

-continued
| | | | |
|---|---|---|---|
| M-171 | —Cl | —$NHSO_2CH_3$ | 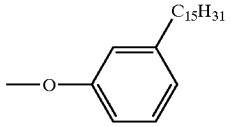 |
| M-172 | " | 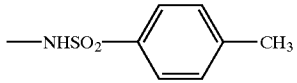 | " |
| M-173 | " | I-1 | " |
| M-174 | " | I-19 | " |
| M-175 | " | I-24 | " |
| M-176 | " | I-26 | " |
| M-177 | " | I-28 | 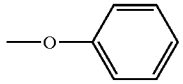 |
| M-178 | 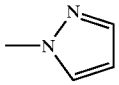 | " | " |
| M-179 | 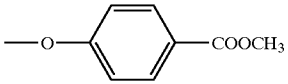 | " | " |
| M-180 | 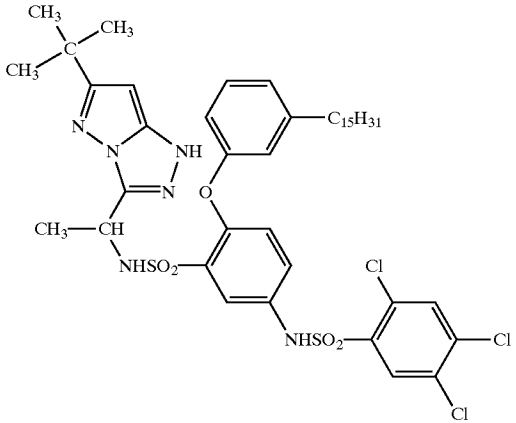 | | |

-continued
M-181
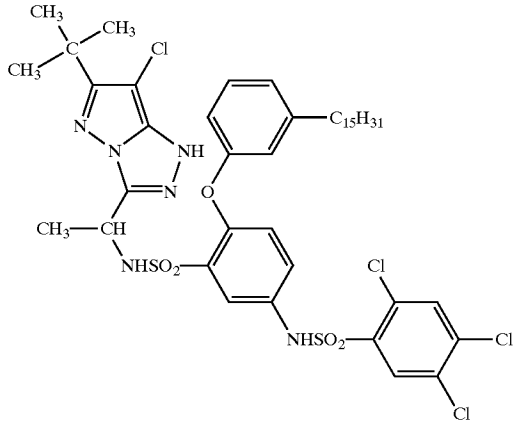
M-182
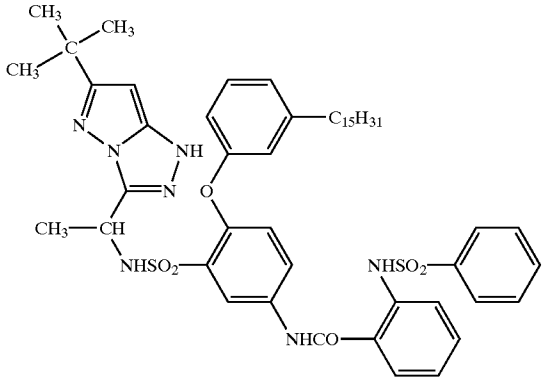

-continued
M-183
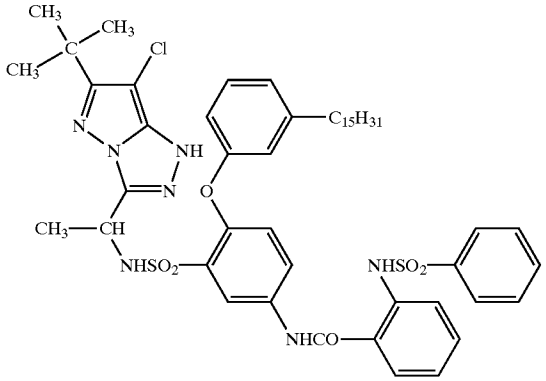
M-184
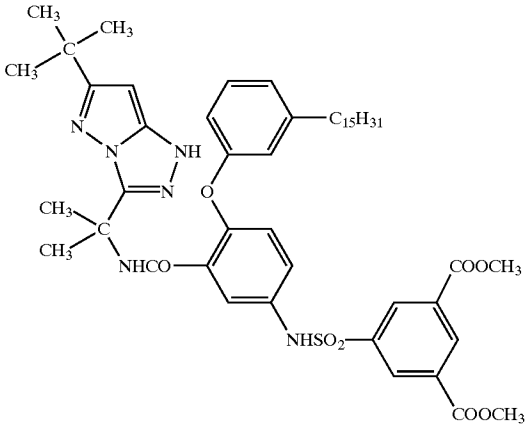

-continued
M-185
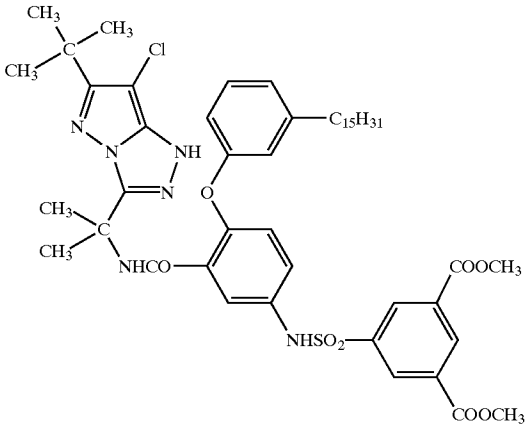
M-186
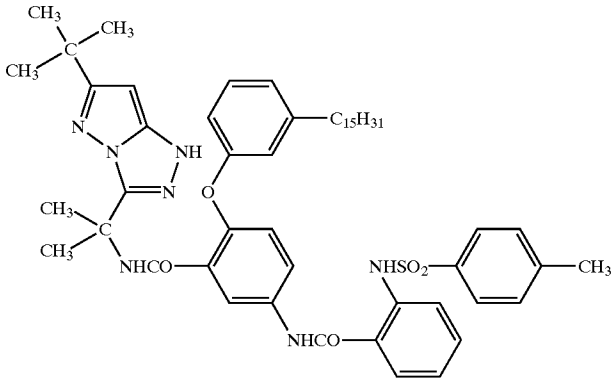

-continued
M-187
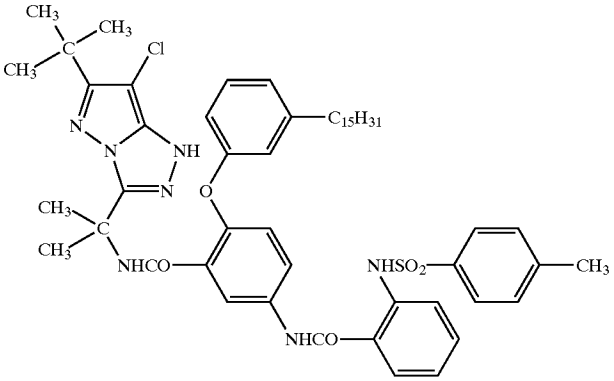
M-188
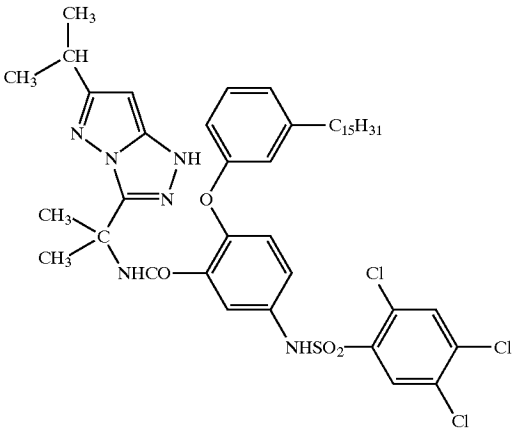

-continued
M-189
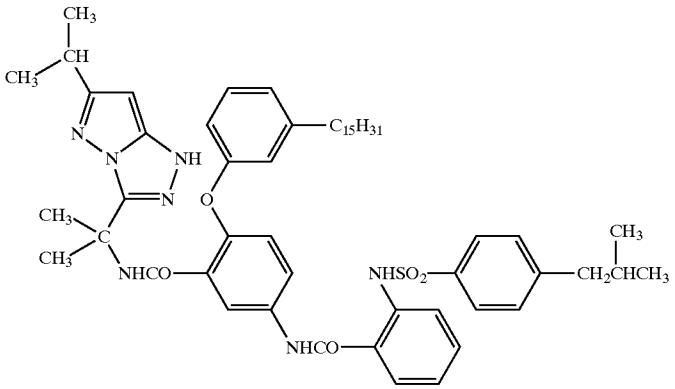
M-190
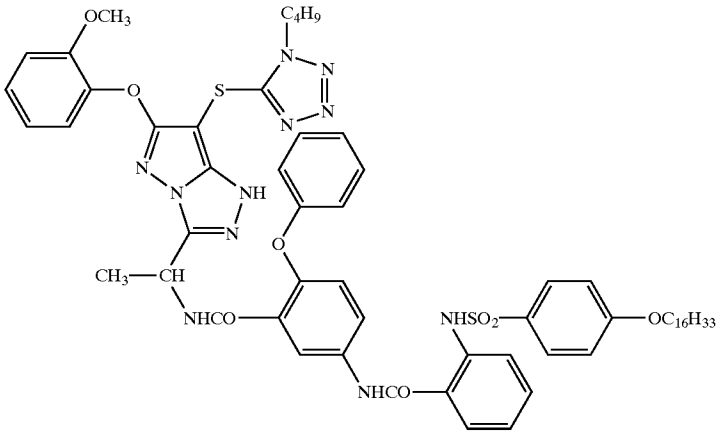

-continued
M-191
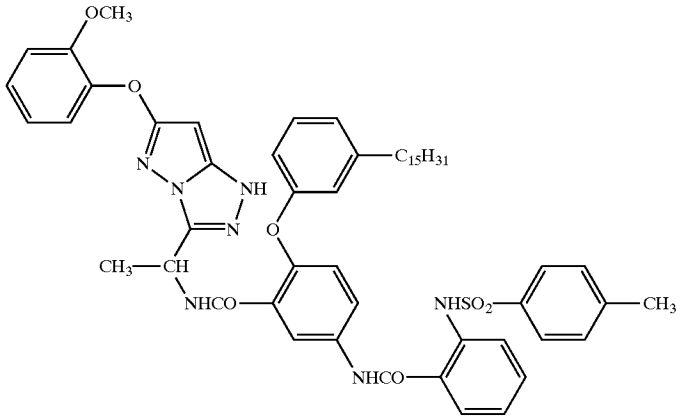
M-192
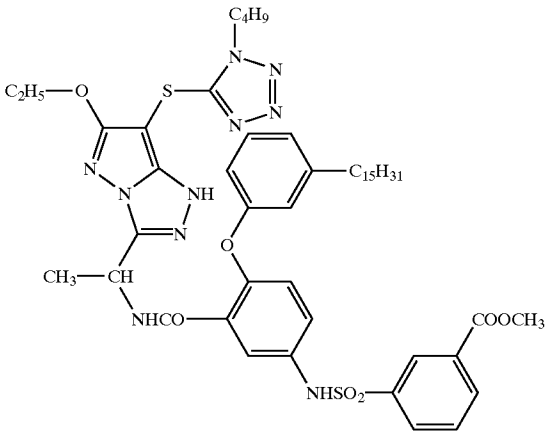

-continued
M-193
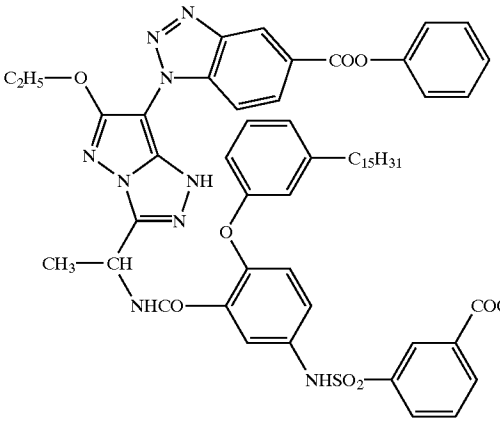
M-194
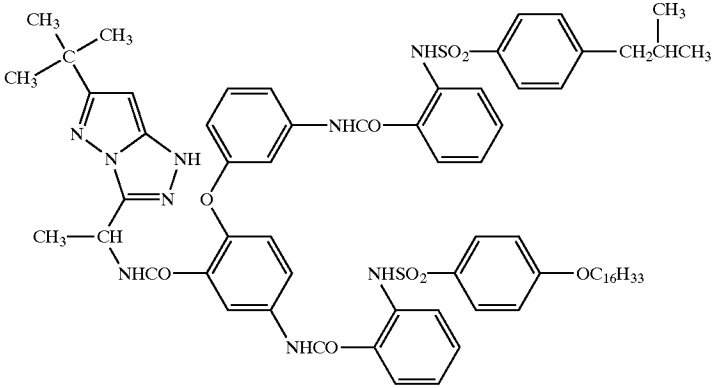

-continued
M-195
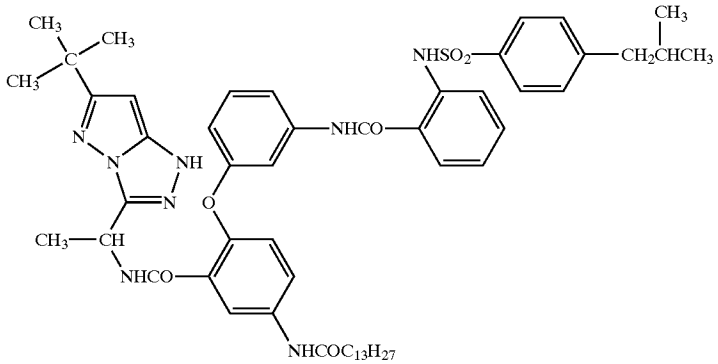
M-196
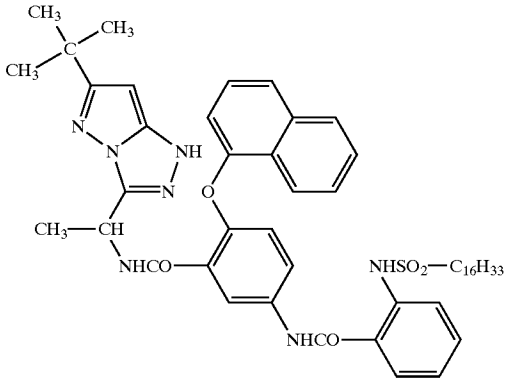

-continued
M-197
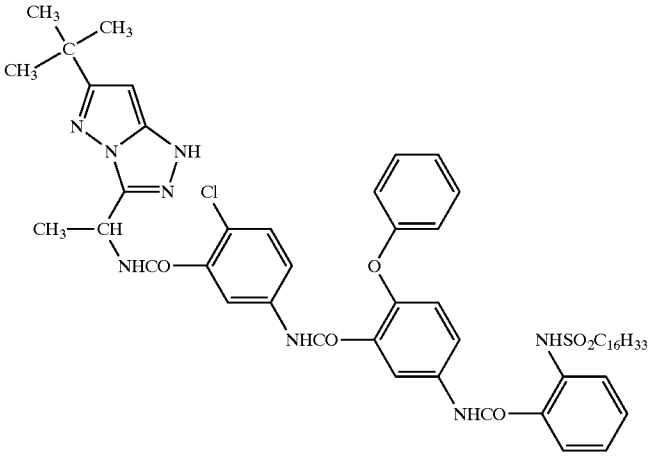
M-198
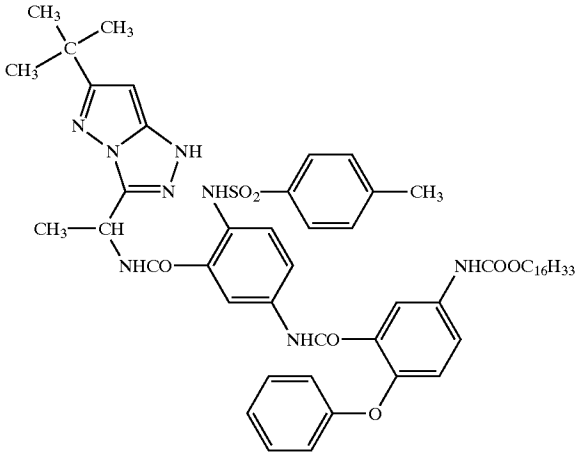

-continued
M-199
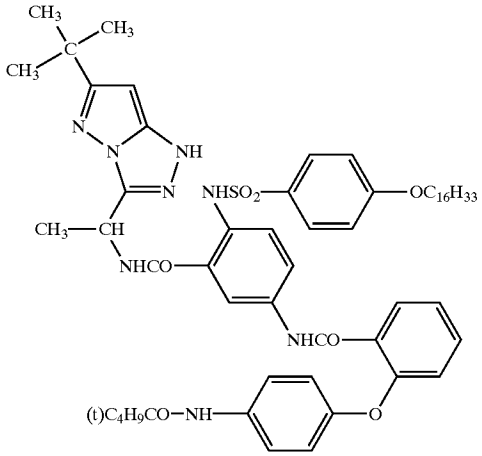
M-200
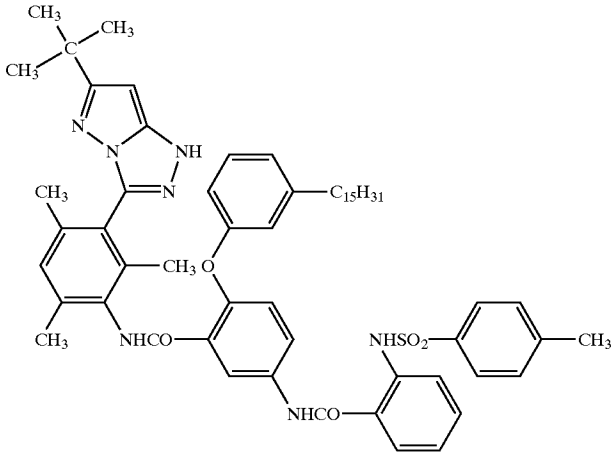

-continued
M-201
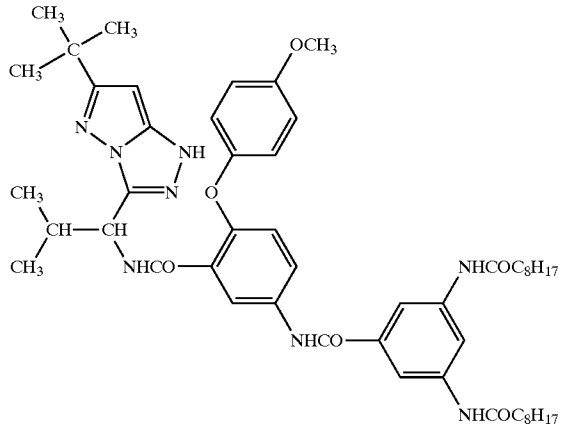
M-202
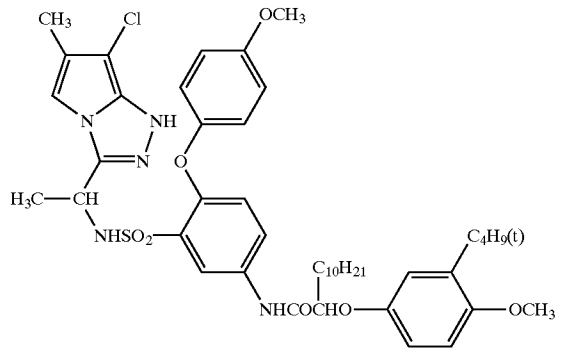

Next, a synthetic method of the coupler of the present invention will be described.

(Synthetic example 1)

Exemplified Coupler MA-7 was synthesized in accordance with the following reaction scheme A.

Reaction Scheme A

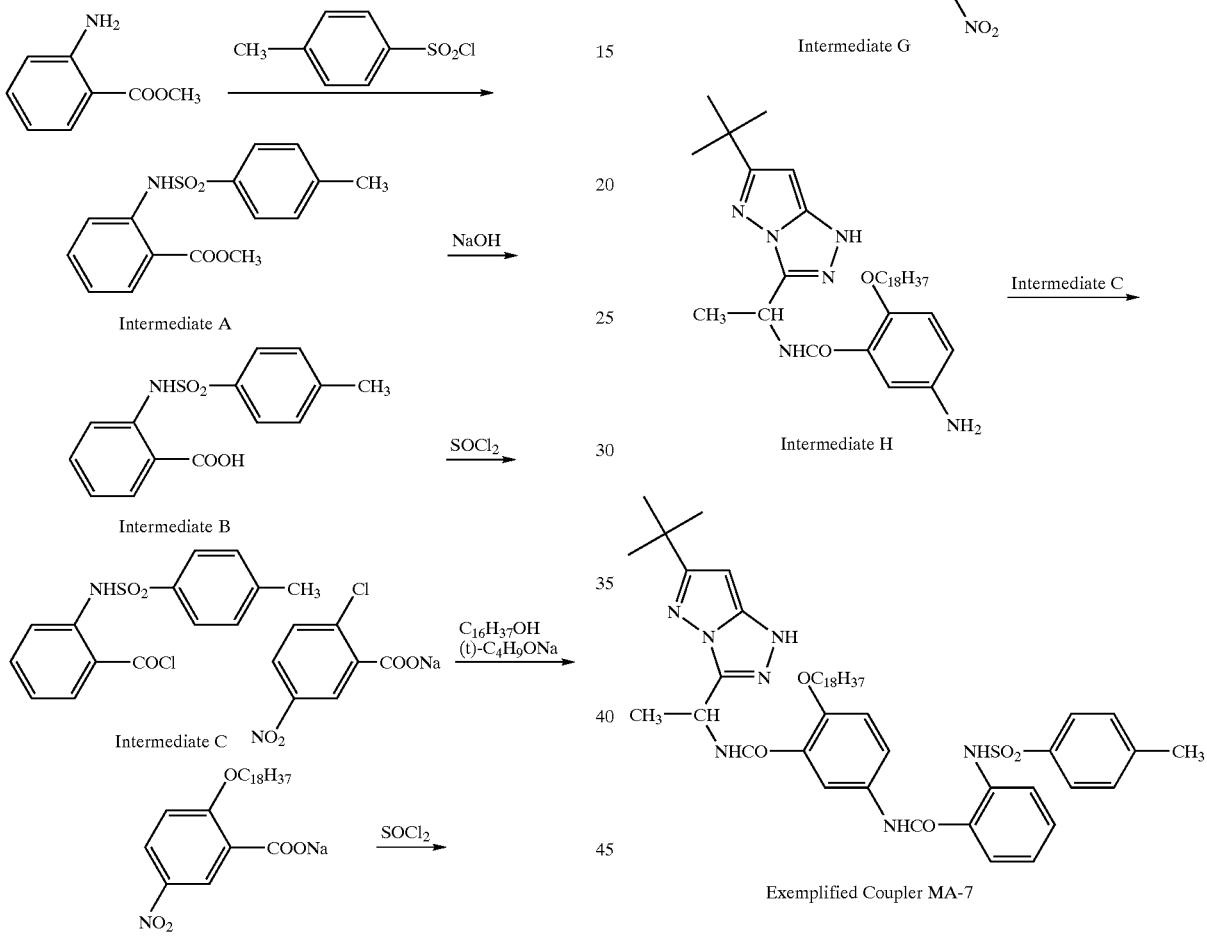

(Synthesis of Intermediate A)

400 milliliter (hereinafter milliliter is also referred to as "mL") of dimethylacetamide was added to 151.2 g (1.0 mol) of methyl anthranilate, and agitated at room temperature. To the solution, 190.65 (1.0 mol) of p-toluenesulfonyl chloride was added. After the completion of the addition, 89 mL (1.1 mol) of pyridine was dropped to the reaction solution. After the completion of the dropping, the solution was agitated at room temperature for 3 hr, to complete the reaction. The reaction solution was pored into 200 mL of water while agitating, to precipitate crystal. The reaction solution was filtered and the crystal was harvested, washed with water, dried to obtain 285.5 g (yield: 93.5%) of intermediate A.

(Synthesis of Intermediate B)

450 mL of methanol was added to 152.7 g (0.5 mol) of intermediate A obtained by the above procedure, and agitated at room temperature. To the solution, an aqueous solution obtained by dissolving 60.0 g (1.5 mol) of sodium hydroxide to 300 mL of water was added, and heated to 40° C. This reaction mixture was agitated for 2 hr to complete the reaction. After that, the reaction solution was cooled to room temperature and then 2000 mL of water was added. To the solution, 170 mL of concentrated hydrochloric acid was added to acidify the solution, thereby to precipitate crystal. The solution was filtered to obtain the crystal, washed with water, dried, to obtain 134.0 g (yield: 92.3%) of intermediate B.

(Synthesis of Intermediate C)

260 mL of toluene was added to 87.4 g (0.3 mol) of intermediate B obtained by the above procedure, heated to 80° C., and agitated. To this suspension, 28.5 mL of thionyl chloride was dropped. After the completion of the dropping, the intermediate B solution was heated to 80° C., and agitated for 2 hr. After the completion of the reaction, excessive thionyl chloride and toluene, solvent, were distilled-off. After cooling, crystal of intermediate C was obtained in a quantitative manner, which was subjected to the subsequent step of the reaction.

(Synthesis of Intermediate D)

1900 mL of dimethylformamide was added to 243.3 g (0.9 mol) of stearoyl alcohol, and agitated at room temperature. 95.1 g (0.99 mol) of sodium t-butoxide was added to this solution and heated to 80° C. to 90° C. for 2 hr. After cooling the solution to 50° C., 223.6 g (1.0 mol) of sodium 2-chloro-5-nitrobenzoate was added, and heated to 80° C. to 90° C., and agitated for 2 hr to complete the reaction. 2000 mL of acetonitrile was added to this reaction solution, and precipitated crystal. The reaction solution was cooled to 15° C., and agitated for 1 hr. The reaction solution was filtered-off, harvested the crystal, washed with 400 mL of acetonitrile and further with water, and dried to obtain 352 g (yield: 85.5%) of intermediate D.

(Synthesis of Intermediate E)

400 mL of acetonitril and 1.0 mL of dimethylformamide were added to 100 g (0.24 mol) of intermediate D obtained by the above procedure, and heated to 75° C. and agitated. 36.5 mL (0.5 mol) of thionyl chloride was dropped. After the completion of the dropping, the solution was heated and agitated for 2 hr to complete the reaction. After the completion of the reaction, excessive thionyl chloride and toluene, solvent, were distilled-off under reduced pressure. 100 mL of THF and 200 mL of ethyl acetate were added and dissolved the residue (intermediate E). This solution of intermediate E was subjected to the subsequent step of the reaction.

(Synthesis of Intermediate G)

250 mL of dimethylacetamide and 250 mL of acetonitrile were added to 51.8 g (0.25 mol) of intermediate F obtained in accordance with the procedure described in JP-A-2001-33921 and agitated at room temperature. 41.8 g (0.28 mol) of dimethylaniline was added to this solution. Then, a THF/ethyl acetate solution of intermediate E obtained by the above procedure was dropped to this solution. The reaction solution was agitated at 30° C. for 3 hr to complete the reaction. After the completion of the reaction, 10 mL of concentrated hydrochloric acid was added, then, extraction was effected by adding 700 mL of ethyl acetate and 2000 mL of water. This ethyl acetate solution was washed thrice with brine. The ethyl acetate solution was concentrated under reduce pressure to obtain oily intermediate G quantitatively. The oily substance (intermediate G) was dissolved to 500 mL of isopropanol, and subjected to the subsequent step of the reaction.

(Synthesis of Intermediate H)

40 mL of water and 700 mL of isopropanol were added to 160 g of reduced iron and 5 g of ammonium chloride, and heated to reflex while agitating. To the suspension, 1 mL of acetic acid was added. Then, the solution of intermediate G obtained by the above procedure was dropped thereinto. After the completion of the addition, 700 mL of ethyl acetate was added and heated while agitating. Insoluble materials were filtered of while the reaction solution was hot. The filtrate was washed with water, and the solvent was distilled-off under reduced pressure. 500 mL of ethyl acetate was added to the residue, and precipitated crystal. The crystal was harvested by filtration, and dried to obtain 86.0 g (yield: 57.8%) of intermediate H.

(Synthesis of Exemplified Coupler MA-7)

180 mL of dimethylacetamide was added to 59.5 g (0.1 mol) of intermediate H obtained by the above procedure, and agitated at room temperature. 100 mL of ethyl acetate solution to which 34.1 g (0.11 mol) of intermediate C obtained by the above procedure was dissolved, was dropped thereinto. After the completion of the dropping, the solution was agitated at room temperature for 2 hr to complete the reaction. After the completion of the reaction, 700 mL of water and 500 mL of ethyl acetate were added for extraction. The ethyl acetate solution was washed with water and dried. Ethyl acetated was concentrated under reduced pressure. 700 mL of acetonitril and 120 mL of ethyl acetate were added to the residue to precipitate crystal. The crystal was harvested by filtration and dried to obtain 67.0 g (yield: 77.2%) of the exemplified coupler MA-7. The melting point of thereof was 78° C. to 84° C.

Synthetic Example 2

Exemplified Coupler M-16 was synthesized in accordance with the following reaction scheme B.

Reaction Scheme B

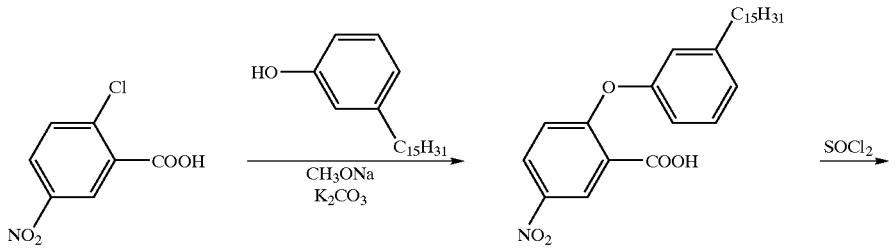

-continued

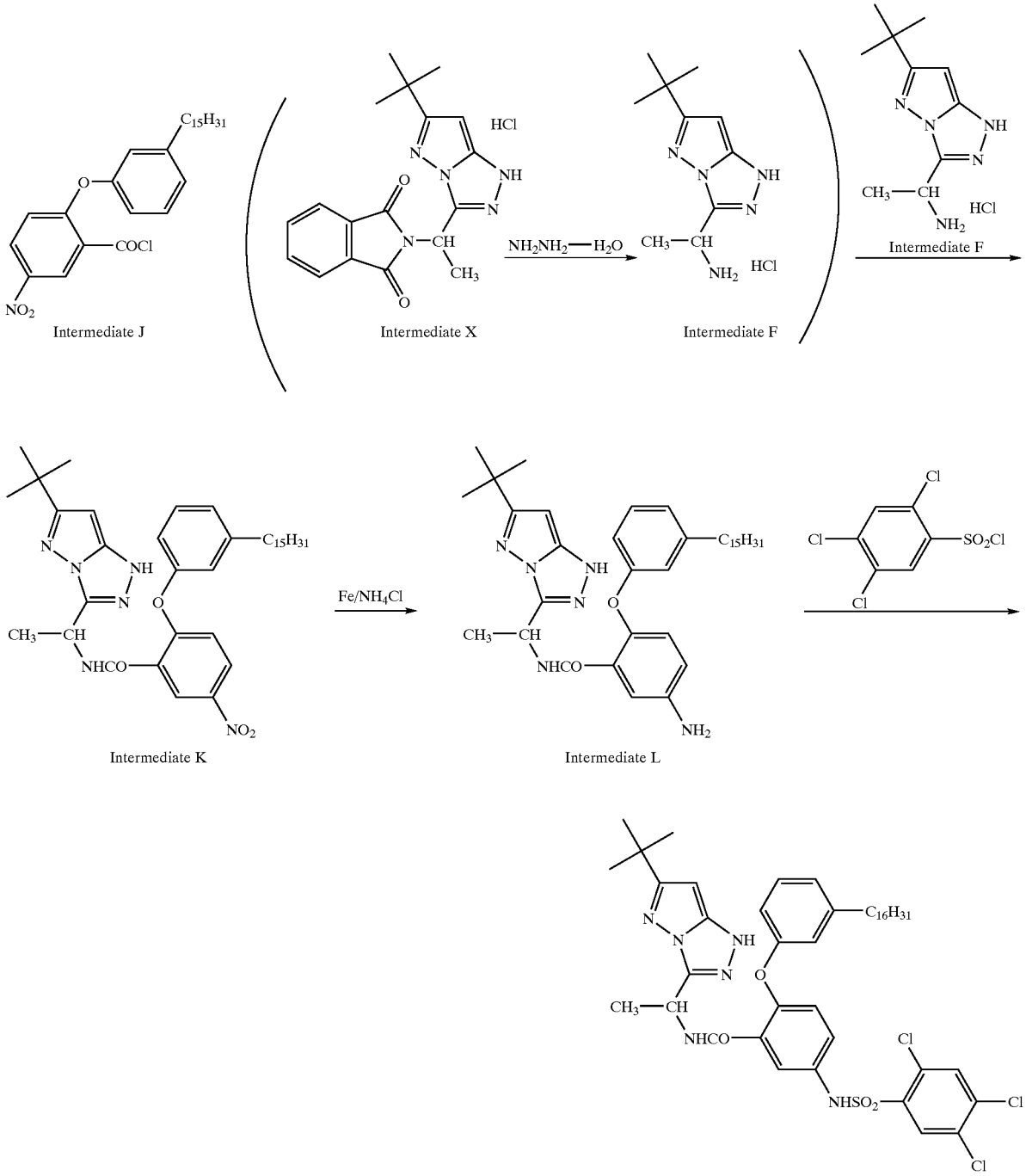

(Synthesis of Intermediate I)

900 mL of dimethylacetamide was added to 304.5 g (1.0 mol) of 3-pentadecylphenol, and agitated at room temperature. 210 mL of a 28% methanol solution of sodium methoxide was added to the 3-pentadecylphenol solution. 201.6 g (1.0 mol) of 2-chloro-5-nitrobenzoic acid was added to the resultant solution. Thereafter, 276 g of potassium carbonate was added to the solution, and heated at 130 to 138° C. and agitated. The heating and agitation was continued for 5 hr, and the resultant reaction mixture was cooled to room temperature. The thus formed crystal was filtered off, and the obtained filtrate was poured into 5000 mL of water, thereby obtaining an aqueous solution. 100 mL of concentrated hydrochloric acid was added to the aqueous solution under agitation, so that the aqueous solution was acidified, thereby effecting crystallization. The crystal was harvested by filtration, and washed with water. The obtained crystal was recrystallized from 1200 mL of acetonitrile, and dried. Thus, 400 g (yield: 85.2%) of intermediate I was obtained.

(Synthesis of Intermediate J)

450 mL of toluene was added to 140.9 g (0.3 mol) of intermediate I obtained in the above procedure, and heated at 90° C. and agitated. 33 mL of thionyl chloride was dropped into the intermediate I solution. After the completion of dropping, the mixture was heated and agitated for 2 hr to thereby complete the reaction. The resultant reaction mixture was cooled to room temperature, thereby obtaining a toluene solution of intermediate J. This solution was subjected to the subsequent step of reaction.

(Synthesis of Intermediate F)

330 mL of isopropyl alcohol was added to 111.3 g (0.33 mol) of intermediate X obtained in accordance with the procedure described in JP-A-2001-33921 and 30.2 g of sodium hydrogen carbonate, and heated and refluxed under agitation, thereby obtaining a solution. 18 g of hydrazine monohydrate was dropped into the solution. After the completion of dropping, the mixture was heated and refluxed under agitation for 2 hr to thereby complete the reaction. The resultant reaction mixture was cooled to room temperature, and 300 mL of water and 42.5 mL of concentrated hydrochloric acid were added thereto. The thus obtained solution was agitated for 1 hr, and crystals of phthalohydrazide were filtered off in vacuum. Thus, an aqueous solution of intermediate F hydrochloride was obtained, and subjected to the subsequent step of reaction.

(Synthesis of Intermediate K)

800 mL of ethyl acetate was added to the aqueous solution of intermediate F (0.33 mol) obtained in the above procedure, and agitated at room temperature. 250 g of sodium hydrogen carbonate was divided into portions and sequentially added to the intermediate F solution. Subsequently, the toluene solution of intermediate J (0.3 mol) obtained in the above procedure was dropped into the intermediate F solution. After the completion of dropping, the mixture was agitated at room temperature for 1 hr to thereby complete the reaction. After the completion of reaction, a water layer was removed from the reaction mixture, and the remaining ethyl acetate layer was washed with water. The resultant ethyl acetate solution was dried over anhydrous magnesium sulfate, and ethyl acetate was distilled off in vacuum. Thus, waxy intermediate K was obtained. 500 mL of isopropanol was added to the obtained waxy intermediate K, and heated to thereby effect dissolution. The isopropanol solution of intermediate K was subjected to the subsequent step of reaction.

(Synthesis of Intermediate L)

1 mL of acetic acid, 80 mL of water and 300 mL of isopropanol were added to 200 g of reduced iron and 20 g of ammonium chloride, and heated and agitated to thereby obtain a solution. The isopropanol solution of intermediate K obtained in the above procedure was dropped into the iron solution. After the completion of dropping, the mixture was heated and agitated for 2 hr to thereby complete the reaction. After the completion of reaction, 750 mL of ethyl acetate was added to the reaction mixture, and agitated. The resultant mixture was subjected to hot filtration in vacuum, thereby removing insoluble substance. Thereafter, water was added to the filtrate to thereby separate an ethyl acetate layer. Water layer was removed, and the ethyl acetate layer was further washed with water. The ethyl acetate solution was dried over anhydrous magnesium sulfate, and ethyl acetate was distilled off in vacuum. Thus, amorphous intermediate L was obtained in approximately a quantitative amount. Dimethylacetamide was added to the obtained amorphous intermediate L to thereby effect dissolution and to make the total amount to 600 mL. This dimethylacetamide solution was subjected to the subsequent step of reaction.

(Synthesis of Coupler Example M-16)

600 mL of the dimethylacetamide solution of intermediate L (0.3 mol) obtained in the above procedure was cooled and agitated at 10° C. 84.0 g (0.3 mol) of 2,4,5-trichlorobenzenesulfonyl chloride was divided into several portions and added to the intermediate L solution. Then, 29.0 mL (0.36 mol) of pyridine was dropped thereto. After the completion of dropping, the mixture was agitated at room temperature for 5 hr to thereby complete the reaction. After the completion of reaction, 800 mL of ethyl acetate and 1200 mL of water were added to the reaction mixture to thereby effect an extraction. Water ethyl acetate solution was washed with brine and dried over anhydrous magnesium sulfate. The ethyl acetate solution was concentrated under reduced pressure. 600 mL of acetonitrile and 200 mL of ethyl acetate were added to thereby effect crystallization. The crystal was recrystallized from a mixed solvent of acetonitrile and ethyl acetate, to obtain 153.8 g (yield: 58.8%) of Exemplified Coupler M-16. The melting point was 83 to 94° C.

Synthetic Example 3

Exemplified Coupler M-50 was synthesized in accordance with the following reaction scheme C.

Reaction Scheme C

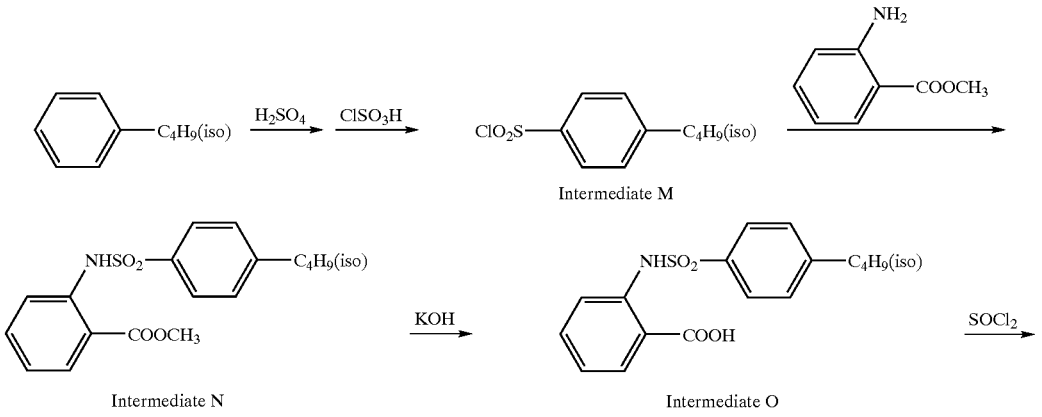

-continued

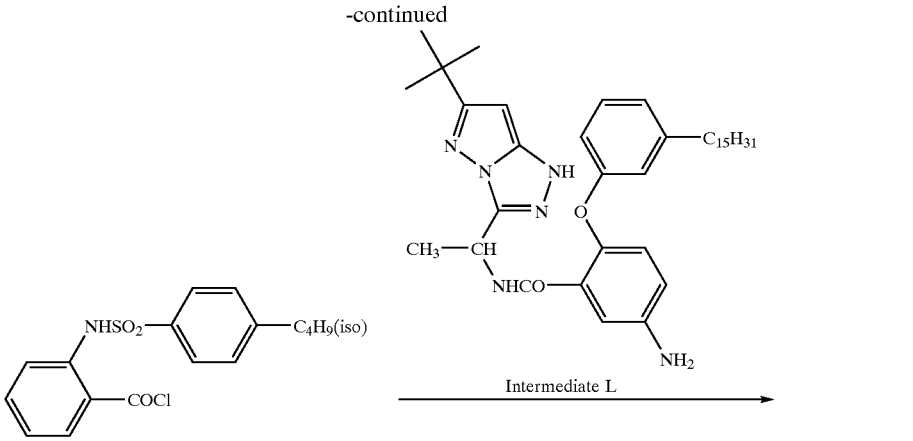

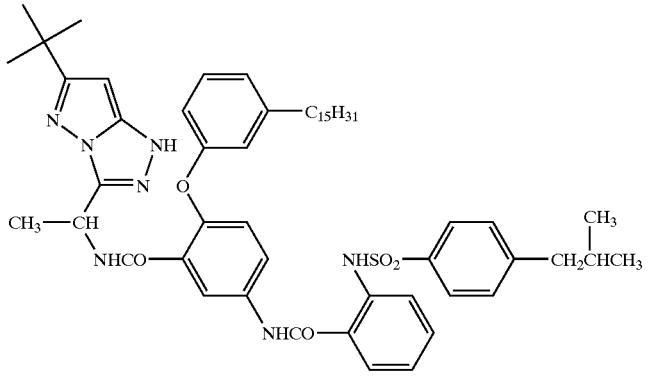

Exemplified Coupler M-16

(Synthesis of Compound M)

196 g of concentrated sulfuric acid was heated at 100° C. and agitated, and 134.2 g (1.0 mol) of isobutylbenzene was dropped thereinto. After the completion of dropping, the mixture was agitated at 110 to 115° C. for 2 hr. The resultant reaction mixture was cooled to 40° C., and 350 g of chlorosulfonic acid was dropped thereinto. After the completion of dropping, a reaction was effected at room temperature for 2 hr. After the completion of reaction, the reaction mixture was poured into 3 liter (hereinafter liter is also referred to as "L") of ice water under agitation. 800 mL of n-hexane and 200 mL of ethyl acetate were added to the thus obtained aqueous solution to thereby effect an extraction. The thus obtained n-hexane/ethyl acetate mixture solution was washed with water, and dried over anhydrous sodium sulfate. The resultant n-hexane/ethyl acetate solution was concentrated in vacuum. Thus, 163 g (yield: 70%) of oily intermediate M was obtained.

(Synthesis of Intermediate N)

300 mL of acetonitrile was added to 75.6 g (0.5 mol) of methyl anthranilate, and agitated at room temperature. 116.4 g (0.5 mol) of intermediate M obtained in the above procedure was dropped into the acetonitrile solution. Subsequently, 44.5 mL (0.55 mol) of pyridine was dropped thereinto. After the completion of dropping, a reaction was effected at room temperature for 5 hr. After the completion of reaction, the reaction mixture was poured into 1500 mL of water under agitation, thereby attaining crystallization. The crystal was harvested by filtration, washed with water, dispersed in 300 mL of methanol to thereby effect washing, harvested by filtration, and dried. Thus, 160 g (yield: 92.1%) of intermediate N was obtained.

(Synthesis of Intermediate O)

450 mL of methanol was added to 139 g (0.4 mol) of intermediate N obtained in the above procedure, and agitated at room temperature. An aqueous solution obtained by dissolving 67.2 g of potassium hydroxide in 130 mL of water was added to the compound N solution. After the completion of addition, the reaction mixture was heated and refluxed to thereby effect further reaction for 1 hr. After the completion of reaction, the reaction mixture was cooled to room temperature, and poured into an aqueous solution of hydrochloric acid obtained by adding 200 mL of water to 110 mL of concentrated hydrochloric acid, thereby effecting crystallization. The thus obtained crystal was harvested by filtration, washed with water and dried. Thus, 124 g (yield: 93%) of intermediate O was obtained.

(Synthesis of Intermediate P)

300 mL of toluene was added to 100 g (0.3 mol) of intermediate O obtained in the above procedure, and heated at 100° C. and agitated. 32.9 mL (0.45 mol) of thionyl chloride was dropped into the intermediate O solution. After the completion of dropping, the mixture was agitated at 100° C. for 2 hr to continue reaction. After the completion of reaction, the reaction mixture was cooled to room temperature, thereby obtaining a toluene solution of intermediate P. This solution was subjected to the subsequent step of reaction.

(Synthesis of Exemplified Coupler M-50)

The dimethylacetamide solution of intermediate L (0.3 mol) obtained in the above procedure was agitated at room temperature. The toluene solution of intermediate P (0.3 mol) obtained in the above procedure was dropped into the compound J solution. After the completion of dropping, the mixture was agitated at room temperature for 3 hr to thereby complete the reaction. After the completion of reaction, 800 mL of ethyl acetate and 800 mL of water were added to the reaction mixture to thereby effect an extraction. Water layer was removed, and the ethyl acetate/toluene mixture layer was washed with water and dried over anhydrous magnesium sulfate. Ethyl acetate and toluene were distilled off in vacuum. 1000 mL of acetonitrile was added to the distillation residue to thereby effect crystallization. The crystal was harvested by filtration and purified by recrystallization from a solvent composed of a 6/1 mixture of acetonitrile/ethyl acetate. Thus, 207.9 g (yield: 72.0%) of Exemplified Coupler M-50 was obtained.

$^1$HNMR ($CDCl_3$) 10.42 (s, 1H), 9.18 (s, 1H), 8.72 (d, 1H), 8.25 (s, 1H), 8.04 (d, 1H), 7.99 (d, 1H), 7.73–7.50 (m, 4H), 7.40 (t, 1H), 7.30–7.20 (m, 1H), 7.16–6.97 (m, 4H), 6.95–6.78 (m, 3H), 5.75–5.58 (m, 1H), 5.51 (s, 1H), 2.59 (t, 2H), 2.38 (d, 2H), 1.85–1.68 (m, 1H), 1.65–1.48 (m, 5H), 1.41–1.15 (m, 33H), 0.88 (t, 3H), 0.80 (d, 6H).

The photosensitive material of the present invention is characterized in that at least one 1H-pyrazolo[3,2-c]-1,2,4-triazole type coupler having a substituent represented by the general formula (I) is contained, preferably in at least one silver halide emulsion layer. The photosensitive material of the present invention is also characterized in that at least one coupler represented by the general formula (III) or general formula (IV) is contained, preferably in at least one silver halide emulsion layer.

The total content of the couplers of the present invention in the photosensitive material is preferably in the range of 0.01 to 10 g, more preferably 0.1 to 2 g, per $m^2$ of the photosensitive material. The suitable total content per mol of silver halides contained in emulsion layers of identical lightsensitivity is in the range of $1\times10^{-3}$ to 1 mol, preferably $3\times10^{-3}$ to $3\times10^{-1}$ mol.

It is preferred that the compound SR-1 and couplers of the present invention be used in the same layer. Although compounds as obtained by changing a substituent of the compound SR-1, for example, those as obtained by changing t-octyl of the compound SR-1 to n-octyl, n-hexadecyl, t-butyl or the like and as obtained by changing isopropyl of the compound SR-1 to methyl, ethyl or the like can be used in the same manner, the compound SR-1 itself is most preferred.

The amount of compound SR-1 used can be in the range of 0.1 to 200 mol % per mol of couplers of the present invention. The amount is preferably in the range of 5 to 100 mol %, more preferably 5 to 20 mol %.

The process for synthesizing the compound SR-1 is described in Jpn. Pat. Appln. KOKOKU Publication No. (hereinafter referred to as JP-B-) 45-14034.

In the silver halide color photosensitive material of the present invention, various additives can be used in conformity with the object thereof.

These additives are described in detail in Research Disclosure Item 17643 (December 1978), Item 18716 (November 1979) and Item 308119 (December 1989), all the contents of which are incorporated herein by reference. A summary of the locations where they are described will be listed in the following table.

| | Types of additives | RD17643 | RD18716 | RD308119 |
|---|---|---|---|---|
| 1 | Chemical sensitizers | page 23 | page 648 right column | page 996 |
| 2 | Sensitivity increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column |

With respect to the layer arrangement and related techniques, silver halide emulsions, dye-forming couplers, DIR couplers and other functional couplers, various additives and development processing which can be used in the photosensitive material of the present invention, reference can be made to EP 0565096A1 (published on Oct. 13, 1993) and patents cited therein, all the contents of which are incorporated herein by reference. Individual particulars and the locations where they are described will be listed below.

1. Layer arrangement: page 61 lines 23 to 35, page 61 line 41 to page 62 line 14,
2. Interlayers: page 61 lines 36 to 40,
3. Interlayer effect-imparting layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62, lines 41 to 42,
9. Tabular grains: page 62 lines 43 to 46,
10. Internal structures of grains: page 62 lines 47 to 53, 11. Emulsions of latent image-forming types: page 62 line 54 to page 63 to line 5,
12. Physical ripening and chemical sensitization of emulsion: page 63 lines 6 to 9,
13. Emulsion mixing: page 63 lines 10 to 13,
14. Fogged emulsions: page 63 lines 14 to 31,
15. Nonlightsensitive emulsions: page 63 lines 32 to 43,
16. Silver coating amounts: page 63 lines 49 to 50,
17. Formaldehyde scavengers: page 64 lines 54 to 57,
18. Mercapto-type antifoggants: page 65 lines 1 to 2,
19. Fogging agent, etc.-releasing agents: page 65 lines 3 to 7,
20. Dyes: page 65, lines 7 to 10,
21. Color coupler summary: page 65 lines 11 to 13,
22. Yellow, magenta and cyan couplers: page 65 lines 14 to 25,
23. Polymer couplers: page 65 lines 26 to 28,
24. Diffusive dye forming couplers: page 65 lines 29 to 31,
25. Colored couplers: page 65 lines 32 to 38,
26. Functional coupler summary: page 65 lines 39 to 44,
27. Bleaching accelerator-releasing couplers: page 65 lines 45 to 48,
28. Development accelerator release couplers: page 65 lines 49 to 53,
29. Other DIR couplers: page 65, line 54 to page 66 to line 4,
30. Method of dispersing couplers: page 66 lines 5 to 28,
31. Antiseptic and mildewproofing agents: page 66 lines 29 to 33,
32. Types of sensitive materials: page 66 lines 34 to 36,
33. Thickness and swelling speed of lightsensitive layer: page 66 line 40 to page 67 line 1,
34. Back layers: page 67 lines 3 to 8,
35. Development processing summary: page 67 lines 9 to 11,
36. Developers and developing agents: page 67 lines 12 to 30,
37. Developer additives: page 67 lines 31 to 44,
38. Reversal processing: page 67 lines 45 to 56,
39. Processing solution open ratio: page 67 line 57 to page 68 line 12,
40. Development time: page 68 lines 13 to 15,
41. Bleach-fix, bleaching and fixing: page 68 line 16 to page 69 line 31,
42. Automatic processor: page 69 lines 32 to 40,
43. Washing, rinse and stabilization: page 69 line 41 to page 70 line 18,
44. Processing solution replenishment and recycling: page 70 lines 19 to 23,
45. Developing agent built-in photosensitive material: page 70 lines 24 to 33,
46. Development processing temperature: page 70 lines 34 to 38, and
47. Application to film with lens: page 70 lines 39 to 41

EXAMPLE

The present invention will be described in more detail by examples. However, the present invention is not limited to these examples.

Example 1

Preparation of Sample 101

A color photosensitive material composed of two layers having the following compositions on an undercoated cellulose triacetate film support was prepared to name Sample 101. The numbers indicate the addition amount per $m^2$ of the photosensitive material. The amount of silver halide is shown in terms of silver amount.

1st layer: Silver halide emulsion layer

| | |
|---|---|
| Silver iodobromide monodisperse tabular grain emulsion silver amount | 1.00 g |
| Equivalent sphere average grain diameter | 0.3 μm |
| Coefficient of variation | 18% |
| Average silver iodide content | 4.0 mol % |
| Gelatin | 3.00 g |
| Comparative coupler A | 0.28 g |
| High-boiling organic solvent | 0.08 g |
| Surfactant W-5 | 25 mg |

2nd layer: Protective layer

| | |
|---|---|
| Gelatin | 2.00 g |
| Poly(methyl methacrylate) (Average grain diameter 2.0 μm) | 0.10 g |
| Surfactant W-1 | 0.15 g |
| Gelatin hardener H-1 | 0.15 g |

Oil-1

Tricresyl phosphate

W-1

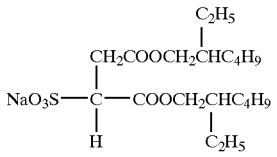

W-5

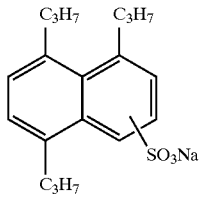

H-1

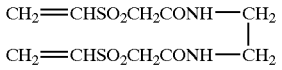

Preparation of Samples 102 to 149

Samples 102 to 149 were prepared in the same manner as Sample 101, except that the magenta coupler (Comparative coupler A) used in the 1st layer of Sample 101 was replaced with other couplers as set forth in Table 1 below.

Comparative Coupler A

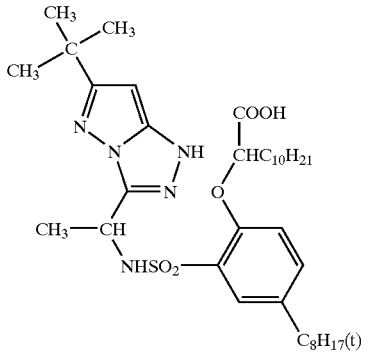

-continued

Comparative Coupler B
described in U.S.P. 6,468,729

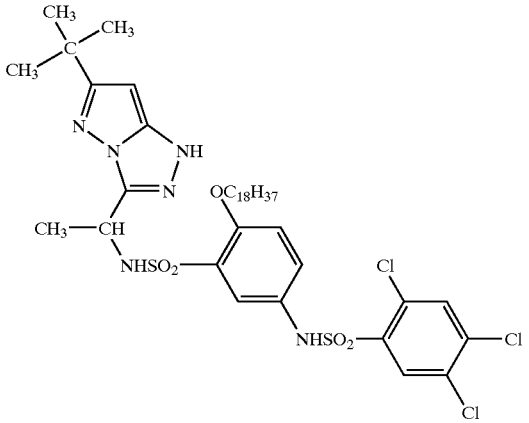

Comparative Coupler C described in
JP-A-2001-33921

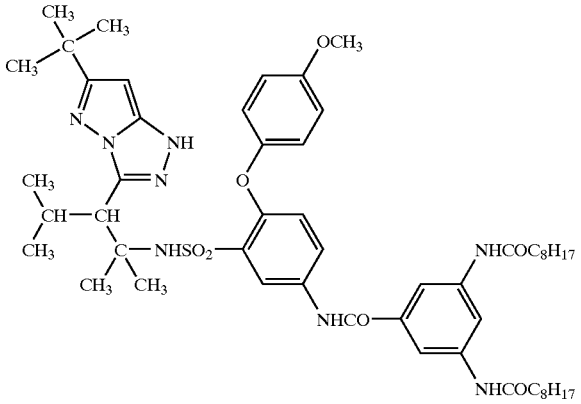

Comparative Coupler C described in JP-A-4-194846

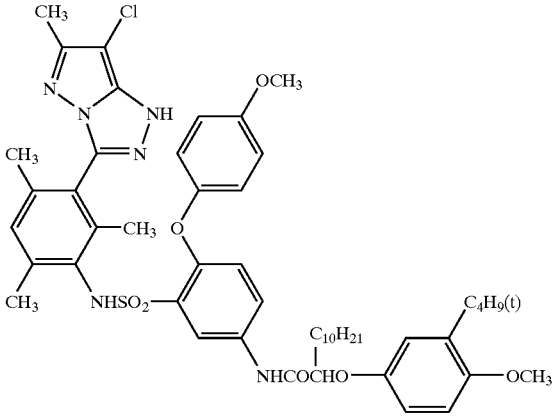

(Evaluation of Color-forming Property and Photographic Speed)

Each sample was exposed to white light of 4800° color temperature through a wedge of continuous density change and subjected to the development processing described later. The maximum color density (Dmax) with respect to magenta image density thereof was measured. The higher the Dmax value, the higher the color-forming property. The photographic speed was based on that determined from the inverse number of exposure quantity realizing a color formation density of 0.5 and expressed as a relative value to that of sample 101 regarded as 100. The greater the relative value, the higher the photographic speed.

(Evaluation of Dependence on pH of Color Developer)

Each of the samples obtained in Example 1 was exposed to white light of 4800° color temperature through a wedge of continuous density change and subjected to the development processing described later. The magenta density of the sample after the development processing was measured. In this processing, use was made of color developers whose pH values were regulated at two points, namely, 11.6 and 12.1 in consideration of the extent of fluctuation in market labos. In the estimation of pH dependence, the magenta density at pH=12.1 processing when the exposure quantity was such as to realize a magenta density of 1.0 at pH=11.6 processing was measured, and the ratio of change (%) was calculated by the formula:

(density at pH=12.1 processing−1.0)×100=ratio of change (%).

The smaller the change ratio value, the smaller the color formation density change according to pH fluctuation of the color developer.

(Evaluation of Dependence on Addition Amount of Color Developing Agent)

Each of the above samples was subjected to the development processing using the color developer which was the same as the below described color developer except that the addition amount of color developing agent [N-ethyl-N-(2-methanesulfonamidoethyl)-3-methyl-4-aminoaniline.3/2 sulfate.monohydrate] was regulated at two points, namely, 13.0 g and 5.0 g per liter, and the magenta density thereof was measured. The magenta density at processing wherein the amount of color developing agent was 5.0 g per liter when the exposure quantity was such as to realize a magenta density of 1.0 at processing wherein the amount of color developing agent was 13.0 g per liter was measured, and the ratio of change (%) was calculated by the formula:

{1.0−(density at processing using 5.0 g/L color developing agent)}×100=ratio of change (%).

The smaller the change ratio value, the smaller the color formation density change according to the fluctuation of amount of color developing agent.

(Evaluation of Yellow Stain)

Each of the above samples was exposed to white light of 500 lux for 1 sec and subjected to the following development processing. The thus obtained samples were stored in 70° C./70% RH atmosphere for 4 weeks, and the density of yellow stain having occurred on the samples was measured. The evaluation of yellow stain was made on the basis of the value of increased yellow density minus blank density. The smaller this value, the less the occurrence of yellow stain and the greater the superiority in image storage.

The results are set forth in Tables 1-1 and 1-2.

TABLE 1-1

| Sample No. | 1st layer Magenta coupler | Oil/Coupler ratio (wt.) | Color-forming property | Speed | Dependence on pH of color developer | Dependence on addition amount of color developer | Yellow stain |
|---|---|---|---|---|---|---|---|
| 101 (Comp.) | Comparative Coupler A | 0.3 | 1.52 | 100 | 7 | 4 | 0.11 |
| 102 (Comp.) | Comparative Coupler A | 0.0 | 1.49 | 101 | 8 | 5 | 0.09 |
| 103 (Comp.) | Comparative Coupler B | 0.3 | 1.36 | 101 | 17 | 10 | 0.04 |
| 104 (Comp.) | Comparative Coupler B | 0.0 | 0.89 | 104 | 15 | 8 | 0.03 |
| 105 (Comp.) | Comparative Coupler C | 0.3 | 1.20 | 101 | 19 | 15 | 0.09 |
| 106 (Comp.) | Comparative Coupler C | 0.0 | 0.76 | 106 | 18 | 13 | 0.08 |
| 107 (Comp.) | Comparative Coupler D | 0.3 | 1.65 | 90 | 5 | 3 | 0.02 |
| 108 (Comp.) | Comparative Coupler D | 0.0 | 1.00 | 91 | 8 | 5 | 0.02 |
| 109 (Inv.) | MA-1 | 0.3 | 1.66 | 100 | 4 | 4 | 0.03 |
| 110 (Inv.) | MA-1 | 0.0 | 1.62 | 101 | 5 | 5 | 0.03 |
| 111 (Inv.) | MA-7 | 0.3 | 1.65 | 100 | 4 | 5 | 0.03 |
| 112 (Inv.) | MA-7 | 0.0 | 1.63 | 101 | 5 | 5 | 0.03 |
| 113 (Inv.) | MA-11 | 0.3 | 1.64 | 101 | 5 | 4 | 0.03 |
| 114 (Inv.) | MA-26 | 0.3 | 1.66 | 100 | 5 | 4 | 0.03 |
| 115 (Inv.) | MA-62 | 0.0 | 1.65 | 93 | 2 | 2 | 0.02 |
| 116 (Inv.) | MA-64 | 0.0 | 1.63 | 93 | 2 | 2 | 0.02 |
| 117 (Inv.) | MA-90 | 0.3 | 1.65 | 100 | 4 | 4 | 0.03 |
| 118 (Inv.) | MA-104 | 0.3 | 1.66 | 93 | 2 | 2 | 0.02 |
| 119 (Inv.) | MA-117 | 0.3 | 1.66 | 101 | 4 | 3 | 0.03 |
| 120 (Inv.) | MA-124 | 0.3 | 1.65 | 93 | 2 | 2 | 0.02 |
| 121 (Inv.) | M-1 | 0.3 | 1.65 | 101 | 4 | 4 | 0.03 |
| 122 (Inv.) | M-1 | 0.0 | 1.66 | 101 | 5 | 5 | 0.02 |
| 123 (Inv.) | M-8 | 0.3 | 1.62 | 100 | 4 | 4 | 0.03 |
| 124 (Inv.) | M-8 | 0.0 | 1.58 | 101 | 5 | 4 | 0.02 |

TABLE 1-2

| Sample No. | 1st layer Magenta coupler | Oil/Coupler ratio (wt.) | Color-forming property | Speed | Dependence on pH of color developer | Dependence on addition amount of color developer | Yellow stain |
|---|---|---|---|---|---|---|---|
| 125 (Inv.) | M-16 | 0.3 | 1.66 | 101 | 3 | 2 | 0.02 |
| 126 (Inv.) | M-16 | 0.0 | 1.63 | 101 | 3 | 2 | 0.02 |
| 127 (Inv.) | M-18 | 0.3 | 1.65 | 100 | 3 | 3 | 0.02 |
| 128 (Inv.) | M-18 | 0.0 | 1.63 | 100 | 4 | 3 | 0.01 |
| 129 (Inv.) | M-31 | 0.3 | 1.67 | 100 | 3 | 1 | 0.02 |
| 130 (Inv.) | M-31 | 0.0 | 1.68 | 101 | 3 | 1 | 0.01 |
| 131 (Inv.) | M-38 | 0.3 | 1.66 | 101 | 3 | 2 | 0.02 |
| 132 (Inv.) | M-38 | 0.0 | 1.66 | 101 | 3 | 2 | 0.01 |
| 133 (Inv.) | M-46 | 0.3 | 1.66 | 101 | 3 | 2 | 0.02 |
| 134 (Inv.) | M-48 | 0.3 | 1.67 | 101 | 3 | 2 | 0.02 |
| 135 (Inv.) | M-49 | 0.3 | 1.68 | 101 | 3 | 2 | 0.02 |
| 136 (Inv.) | M-50 | 0.3 | 1.67 | 101 | 3 | 2 | 0.02 |
| 137 (Inv.) | M-50 | 0.0 | 1.66 | 101 | 3 | 2 | 0.01 |
| 138 (Inv.) | M-51 | 0.3 | 1.67 | 100 | 3 | 2 | 0.02 |
| 139 (Inv.) | M-51 | 0.0 | 1.65 | 101 | 3 | 2 | 0.01 |
| 140 (Inv.) | M-54 | 0.3 | 1.60 | 100 | 4 | 3 | 0.02 |
| 141 (Inv.) | M-55 | 0.3 | 1.64 | 101 | 3 | 2 | 0.02 |
| 142 (Inv.) | M-65 | 0.3 | 1.65 | 101 | 4 | 3 | 0.02 |
| 143 (Inv.) | M-68 | 0.3 | 1.63 | 101 | 4 | 3 | 0.02 |
| 144 (Inv.) | M-90 | 0.3 | 1.64 | 101 | 3 | 2 | 0.02 |
| 145 (Inv.) | M-101 | 0.3 | 1.65 | 94 | 2 | 2 | 0.02 |
| 146 (Inv.) | M-101 | 0.0 | 1.63 | 94 | 2 | 2 | 0.02 |
| 147 (Inv.) | M-180 | 0.3 | 1.65 | 100 | 5 | 5 | 0.03 |
| 148 (Inv.) | M-201 | 0.3 | 1.55 | 100 | 8 | 5 | 0.03 |
| 149 (Inv.) | M-202 | 0.0 | 1.58 | 98 | 5 | 4 | 0.01 |

The development processing is described below.

(Processing Steps)

| Processing Step | Time | Temperature | Tank volume | Replenishment rate |
|---|---|---|---|---|
| 1st development | 6 min | 38° C. | 37 L | 2,000 mL/m$^2$ |
| 1st washing | 2 min | 38° C. | 16 L | 4,000 mL/m$^2$ |
| Reversal | 2 min | 38° C. | 17 L | 1,100 mL/m$^2$ |
| Color development | 6 min | 38° C. | 30 L | 2,200 mL/m$^2$ |
| Pre-bleaching | 2 min | 38° C. | 19 L | 1,100 mL/m$^2$ |
| Bleaching | 6 min | 38° C. | 30 L | 2,200 mL/m$^2$ |
| Fixing | 4 min | 38° C. | 29 L | 1,100 mL/m$^2$ |
| 2nd washing | 4 min | 38° C. | 35 L | 4,000 mL/m$^2$ |

The compositions of the processing solutions were as follows.

| <1st developer> | <Tank solution> | <Replenisher> |
|---|---|---|
| Nitrilo-N,N,N-trimethylene phosphonic acid. pentasodium salt | 1.5 g | 1.5 g |
| Diethylenetriamine pentaacetic acid. pentasodium salt | 2.0 g | 2.0 g |
| Sodium sulfite | 30 g | 30 g |
| Hydroquinone.potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid. pentasodium salt | 3.0 g | 3.0 g |
| Stannous chloride.dihydrate | 1.0 g | 1.0 g |
| p-aminophenol | 0.1 g | 0.1 g |
| Sodium hydroxide | 8 g | 8 g |
| Glacial acetic acid | 15 mL | 15 mL |
| Water to make | 1,000 mL | 1,000 mL |
| pH | 6.00 | 6.0 |

The pH was adjusted by acetic acid or potassium hydroxide.

| <Color developer> | <Tank solution> | <Replenisher> |
|---|---|---|
| Nitrilo-N,N,N-trimethylene phosphonic acid. pentasodium salt | 2.0 g | 2.0 g |
| Sodium sulfite | 7.0 g | 7.0 g |
| Trisodium phosphate. dodecahydrate | 36 g | 36 g |
| Potassium bromide | 1.0 g | — |

-continued

| <Color developer> | <Tank solution> | <Replenisher> |
|---|---|---|
| Potassium iodide | 90 mg | — |
| Sodium hydroxide | 3.0 g | 3.0 g |
| Citrazinic acid | 1.5 g | 1.5 g |
| N-ethyl-N-(2-methanesulfon amidoethyl)-3-methyl-4 aminoaniline.3/2 sulfuric acid.monohydrate | 11 g | 11 g |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Bleaching solution> | <Tank solution> | <Replenisher> |
|---|---|---|
| Ethylenediaminetetraacetic acid.disodium salt. dihydrate | 2.0 g | 4.0 g |
| Ethylenediaminetetraacetic acid.Fe(III).ammonium. dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | 80 g |
| Sodium sulfite | 5.0 g | 5.0 g |
| Sodium bisulfite | 5.0 g | 5.0 g |
| Water to make | 1,000 mL | 1,000 mL |
| pH | 6.60 | 6.60 |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

In the above described development processing steps, each bath was stirred by continuously circulating the solutions, and further, the bottom surface of each tank was provided with a bubbling tube having apertures of 0.3 mm diameter in an interval of 1 cm, by which nitrogen gas was continuously bubbled to sire the solutions.

It is apparent from the results of Tables 1-1 and 1-2 that the samples 101 and 102 containing comparative coupler A, although the color-forming property and other properties are satisfactory, have a problem of yellow stain in storability in heat and humidity. The samples 103 and 104 containing comparative coupler B, although satisfactory results have been obtained with respect to yellow stain, exhibit low color-forming property in oilless condition and suffer extensive changes of color-forming property upon fluctuation of the pH value of color developer or upon fluctuation of the amount of color developing agent. The samples 105 and 106 containing comparative coupler C exhibit extensive yellow stain, exhibit low color-forming property in oilless condition, and suffer extensive changes of color-forming property upon pH fluctuation in processing and upon fluctuation of the amount of color developing agent. The samples 107 and 108 containing comparative coupler D suffer extensive changes of color-forming property depending on the amount of oil and suffer graininess deterioration attributed to the 2-equivalent coupler. By contrast, the samples of the present invention have exhibited satisfactory results with respect to all the test items, so that it is apparent that the objects of the present invention have been attained. In particular, the samples 115, 116, 118, 120, 145, 146 and 149 of the present invention containing 2-equivalent couplers, although a decrease of photographic speed was exhibited, were slight in changes of color-forming property depending on the amount of oil, thereby attaining satisfactory results for the objects of the present invention.

Example 2

Preparation of Sample 201

<Formation of Triacetylcellulose Film>

Triacetylcellulose film was formed according to the band method by subjecting to customary solution casting a solution wherein triacetylcellulose (13% by weight) was dissolved in a 92:8 (weight ratio) mixture of dichloromethane and methanol, with the plasticizer changed to a 2:1 by weight mixture of triphenyl phosphate and biphenyldiphenyl phosphate amounting to 14% based on triacetylcellulose. The support after drying had a thickness of 97 μm.

<Components of Undercoat Layer>

The two surfaces of the triacetylcellulose film were subjected to undercoating treatment. Numbers represent weight contained per liter of an undercoat solution. The two surfaces of the triacetylcellulose film were subjected to corona discharge treatment before undercoating treatment.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

<Coating of Back Layers>

One surface of the undercoated support was coated with the following back layers.

1st Layer

| | |
|---|---|
| Binder: acid-processed gelatin (isoelectric point: 9.0) | 1.00 g |
| Polymeric latex: P-2 (average grain size: 0.1 μm) | 0.13 g |
| Polymeric latex: P-3 (average grain size 0.2 μm) | 0.23 g |
| Ultraviolet absorbent U-1 | 0.03 g |
| Ultraviolet absorbent U-3 | 0.01 g |
| Ultraviolet absorbent U-4 | 0.02 g |
| High-boiling organic solvent Oil-2 | 0.03 g |

-continued

| | |
|---|---|
| Surfactant W-1 | 0.01 g |
| Surfactant W-6 | 3.0 mg |

2nd Layer

| | |
|---|---|
| Binder: acid-processed gelatin (isoelectric point: 9.0) | 3.10 g |
| Polymeric latex: P-3 (average grain size: 0.2 μm) | 0.11 g |
| Ultraviolet absorbent U-1 | 0.03 g |
| Ultraviolet absorbent U-3 | 0.01 g |
| Ultraviolet absorbent U-4 | 0.02 g |
| High-boiling organic solvent Oil-2 | 0.03 g |
| Surfactant W-1 | 0.01 g |
| Surfactant W-6 | 3.0 mg |
| Dye D-2 | 0.1 g |
| Dye D-10 | 0.12 g |
| Potassium sulfate | 0.25 g |
| Calcium chloride | 0.5 mg |
| Sodium hydroxide | 0.03 g |

3rd Layer

| | |
|---|---|
| Binder: acid-processed gelatin (isoelectric point: 9.0) | 3.30 g |
| Surfactant W-1 | 0.02 g |
| Potassium sulfate | 0.3 g |
| Sodium hydroxide | 0.03 g |

4th Layer

| | |
|---|---|
| Binder: lime-processed gelatin (isoelectric point: 5.4) | 1.15 g |
| 1:9 copolymer of methacrylic acid and methylmethacrylate (average grain size: 2.0 μm) | 0.04 g |
| 6:4 copolymer of methacrylic acid and methylmethacrylate (average grain size: 2.0 μm) | 0.03 g |
| Surfactant W-1 | 0.06 g |
| Surfactant W-2 | 7.0 mg |
| Hardener H-1 | 0.23 g |

<Coating of Photosensitive Emulsion Layers>

Sample 101 was prepared by coating lightsensitive emulsion layers presented below on the side opposite, against the support, to the side having the back layers. Numbers represent addition amounts per $m^2$ of the coating surface. Note that the effects of added compounds are not restricted to the described purposes.

1st Layer: Antihalation Layer

| | | |
|---|---|---|
| Black colloidal silver | silver amount | 0.25 g |
| Gelatin | | 2.4 g |
| Ultraviolet absorbent U-1 | | 0.15 g |
| Ultraviolet absorbent U-3 | | 0.15 g |
| Ultraviolet absorbent U-4 | | 0.1 g |
| Ultraviolet absorbent U-5 | | 0.1 g |
| High-boiling organic solvent Oil-1 | | 0.1 g |
| High-boiling organic solvent Oil-2 | | 0.1 g |
| High-boiling organic solvent Oil-5 | | 0.010 g |
| Dye D-4 | | 1.0 mg |
| Dye D-8 | | 2.5 mg |

-continued

| | |
|---|---|
| Fine crystal solid dispersion of dye E-1 | 0.05 g |

2nd Layer: Interlayer

| | |
|---|---|
| Gelatin | 0.50 g |
| Compound Cpd-A | 0.2 mg |
| Compound Cpd-K | 3.0 mg |
| Compound Cpd-M | 0.03 g |
| High-boiling organic solvent Oil-3 | 6.0 mg |
| High-boiling organic solvent Oil-4 | 0.01 g |
| High-boiling organic solvent Oil-7 | 0.01 g |
| Dye D-7 | 4.0 mg |

3rd Layer: Interlayer

| | | |
|---|---|---|
| Yellow colloidal silver | silver amount | 0.02 g |
| Silver iodobromide emulsion whose surface and inside are previously fogged (Cubic grains; average silver iodide content: 1 mol %; average equivalent sphere diameter: 0.06 μm) | silver amount | 0.01 g |
| Gelatin | | 0.6 g |
| Compound Cpd-D | | 0.02 g |
| High-boiling organic solvent Oil-3 | | 0.01 g |

4th Layer: Low-speed Red-sensitive Emulsion Layer

| | | |
|---|---|---|
| Emulsion A | silver amount | 0.1 g |
| Emulsion B | silver amount | 0.15 g |
| Emulsion C | silver amount | 0.15 g |
| Gelatin | | 0.8 g |
| Coupler C-1 | | 0.15 g |
| Coupler C-2 | | 7.0 mg |
| Coupler C-6 | | 3.0 mg |
| Coupler C-7 | | 2.0 mg |
| Ultraviolet absorbent U-3 | | 0.01 g |
| Compound Cpd-I | | 0.02 g |
| Compound Cpd-D | | 3.0 mg |
| Compound Cpd-J | | 2.0 mg |
| High-boiling organic solvent Oil-10 | | 0.03 g |
| Additive P-1 | | 5.0 mg |

5th Layer: Medium-speed Red-sensitive Emulsion Layer

| | | |
|---|---|---|
| Emulsion C | silver amount | 0.15 g |
| Emulsion D | silver amount | 0.15 g |
| Gelatin | | 0.7 g |
| Coupler C-1 | | 0.15 g |
| Coupler C-2 | | 7.0 mg |
| Coupler C-6 | | 3.0 mg |
| Compound Cpd-D | | 3.0 mg |
| Ultraviolet absorbent U-3 | | 0.01 g |
| High-boiling organic solvent Oil-10 | | 0.03 g |
| Additive P-1 | | 7.0 mg |

6th Layer: High-speed Red-sensitive Emulsion Layer

| | | |
|---|---|---|
| Emulsion E | silver amount | 0.15 g |
| Emulsion F | silver amount | 0.2 g |
| Gelatin | | 1.5 g |

-continued

| | |
|---|---|
| Coupler C-1 | 0.6 g |
| Coupler C-2 | 0.015 g |
| Coupler C-3 | 0.03 g |
| Coupler C-6 | 5.0 mg |
| Ultraviolet absorbent U-1 | 0.01 g |
| Ultraviolet absorbent U-2 | 0.01 g |
| High-boiling organic solvent Oil-6 | 0.03 g |
| High-boiling organic solvent Oil-9 | 0.02 g |
| High-boiling organic solvent Oil-10 | 0.05 g |
| Compound Cpd-D | 5.0 mg |
| Compound Cpd-K | 1.0 mg |
| Compound Cpd-F | 0.03 g |
| Additive P-1 | 0.01 g |
| Additive P-4 | 0.03 g |

7th Layer: Interlayer

| | |
|---|---|
| Gelatin | 0.7 g |
| Additive P-2 | 0.1 g |
| Dye D-5 | 0.02 g |
| Dye D-9 | 6.0 mg |
| Compound Cpd-I | 0.01 g |
| Compound Cpd-M | 0.04 g |
| Compound Cpd-O | 3.0 mg |
| Compound Cpd-P | 5.0 mg |
| Compound Cpd-S | 0.05 g |
| High-boiling organic solvent Oil-6 | 0.05 g |

8th Layer: Interlayer

| | | |
|---|---|---|
| Yellow colloidal silver | silver amount | 0.02 g |
| Gelatin | | 1.0 g |
| Additive P-2 | | 0.05 g |
| Ultraviolet absorbent U-1 | | 0.01 g |
| Ultraviolet absorbent U-3 | | 0.01 g |
| Compound Cpd-A | | 0.05 g |
| Compound Cpd-D | | 0.03 g |
| Compound Cpd-M | | 0.05 g |
| Compound Cpd-S | | 0.01 g |
| High-boiling organic solvent Oil-3 | | 0.01 g |
| High-boiling organic solvent Oil-6 | | 0.05 g |

9th Layer: Low-speed Green-sensitive Emulsion Layer

| | | |
|---|---|---|
| Emulsion G | silver amount | 0.25 g |
| Emulsion H | silver amount | 0.3 g |
| Emulsion I | silver amount | 0.25 g |
| Gelatin | | 1.3 g |
| Comparative coupler A | | 0.13 g |
| Coupler C-8 | | 0.03 g |
| Compound Cpd-A | | 5.0 mg |
| Compound Cpd-B | | 0.03 g |
| Compound Cpd-D | | 5.0 mg |
| Compound Cpd-E | | 0.015 g |
| Compound Cpd-G | | 2.5 mg |
| Compound Cpd-F | | 0.01 g |
| Compound Cpd-K | | 2.0 mg |
| Compound SR-1 | | 0.02 g |
| Ultraviolet absorbent U-6 | | 5.0 mg |
| High-boiling organic solvent Oil-2 | | 0.04 g |
| Additive P-1 | | 5.0 mg |

10th Layer: Medium-speed Green-sensitive Emulsion Layer

| | | |
|---|---|---|
| Emulsion I | silver amount | 0.3 g |
| Emulsion J | silver amount | 0.3 g |

-continued

| | | |
|---|---|---|
| Internally fogged silver bromide emulsion (cubic grains, average equivalent sphere diameter: 0.11 μm) | silver amount | 3.0 mg |
| Gelatin | | 0.7 g |
| Comparative coupler A | | 0.2 g |
| Coupler C-8 | | 0.04 g |
| Compound Cpd-A | | 5.0 mg |
| Compound Cpd-B | | 0.03 g |
| Compound Cpd-F | | 0.01 g |
| Compound Cpd-G | | 2.0 mg |
| Compound SR-1 | | 0.04 g |
| High-boiling organic solvent Oil-2 | | 0.04 g |
| High-boiling organic solvent Oil-9 | | 0.02 g |

11th Layer: High-speed Green-sensitive Emulsion Layer

| | | |
|---|---|---|
| Emulsion K | silver amount | 0.4 g |
| Gelatin | | 0.8 g |
| Comparative coupler A | | 0.65 g |
| Coupler C-8 | | 0.12 g |
| Compound Cpd-A | | 5.0 mg |
| Compound Cpd-B | | 0.03 g |
| Compound Cpd-F | | 0.01 g |
| Compound SR-1 | | 0.0065 g |
| High-boiling organic solvent Oil-2 | | 0.15 g |
| High-boiling organic solvent Oil-9 | | 0.05 g |

12th Layer: Yellow Filter Layer

| | | |
|---|---|---|
| Yellow colloidal silver | silver amount | 0.01 g |
| Gelatin | | 1.0 g |
| Compound Cpd-C | | 0.01 g |
| Compound Cpd-M | | 0.1 g |
| Compound Cpd-S | | 0.05 g |
| High-boiling organic solvent Oil-1 | | 0.02 g |
| High-boiling organic solvent Oil-6 | | 0.1 g |
| Fine crystal solid dispersion of dye E-2 | | 0.2 g |

13th Layer: Interlayer

| | |
|---|---|
| Gelatin | 0.4 g |
| Compound Cpd-Q | 0.2 g |

14th Layer: Low-speed Blue-sensitive Emulsion Layer

| | | |
|---|---|---|
| Emulsion L | silver amount | 0.15 g |
| Emulsion M | silver amount | 0.2 g |
| Emulsion N | silver amount | 0.1 g |
| Gelatin | | 0.8 g |
| Coupler C-4 | | 0.02 g |
| Coupler C-5 | | 0.3 g |
| Coupler C-6 | | 5.0 mg |
| Compound Cpd-B | | 0.1 g |
| Compound Cpd-I | | 8.0 mg |
| Compound Cpd-K | | 1.0 mg |
| Compound Cpd-M | | 0.01 g |
| Ultraviolet absorbent U-6 | | 0.01 g |
| High-boiling organic solvent Oil-2 | | 0.01 g |

15th Layer: Medium-speed Blue-sensitive Emulsion Layer

| | | |
|---|---|---|
| Emulsion N | silver amount | 0.2 g |
| Emulsion O | silver amount | 0.2 g |
| Gelatin | | 0.8 g |
| Coupler C-4 | | 0.02 g |
| Coupler C-5 | | 0.25 g |
| Coupler C-6 | | 0.01 g |
| Compound Cpd-B | | 0.1 g |
| Compound Cpd-N | | 2.0 mg |
| High-boiling organic solvent Oil-2 | | 0.01 g |

16th Layer: High-speed Blue-sensitive Emulsion Layer

| | | |
|---|---|---|
| Emulsion P | silver amount | 0.2 g |
| Emulsion Q | silver amount | 0.25 g |
| Gelatin | | 2.00 g |
| Coupler C-3 | | 5.0 mg |
| Coupler C-4 | | 0.1 g |
| Coupler C-5 | | 1.0 g |
| Coupler C-6 | | 0.02 g |
| High-boiling organic solvent Oil-2 | | 0.1 g |
| High-boiling organic solvent Oil-3 | | 0.02 g |
| Ultraviolet absorbent U-6 | | 0.1 g |
| Compound Cpd-B | | 0.2 g |
| Compound Cpd-N | | 5.0 mg |

17th Layer: 1st Protective Layer

| | |
|---|---|
| Gelatin | 1.00 g |
| Ultraviolet absorbent U-1 | 0.15 g |
| Ultraviolet absorbent U-2 | 0.05 g |
| Ultraviolet absorbent U-5 | 0.2 g |
| Compound Cpd-O | 5.0 mg |
| Compound Cpd-A | 0.03 g |
| Compound Cpd-H | 0.2 g |
| Dye D-1 | 8.0 mg |
| Dye D-2 | 0.01 g |
| Dye D-3 | 0.01 g |
| High-boiling organic solvent Oil-3 | 0.1 g |

18th Layer: 2nd Protective Layer

| | | |
|---|---|---|
| Colloidal silver | silver amount | 2.5 mg |
| Fine grain silver iodobromide emulsion (average equivalent sphere diameter: 0.06 μm, average silver iodide content: 1 mol %) | Silver amount | 0.1 g |
| Gelatin | | 0.8 g |
| Ultraviolet absorbent U-1 | | 0.03 g |
| Ultraviolet absorbent U-6 | | 0.03 g |
| High-boiling organic solvent Oil-3 | | 0.01 g |

19th Layer: 3rd Protective Layer

| | |
|---|---|
| Gelatin | 1.00 g |
| Polymethylmethacrylate (average grain size 1.5 μm) | 0.1 g |
| 6:4 copolymer of methylmethacrylate and methacrylic acid (average grain size 1.5 μm) | 0.15 g |
| Silicone oil SO-1 | 0.2 g |
| Surfactant W-3 | 3.0 mg |
| Surfactant W-2 | 8.0 mg |

-continued

| | |
|---|---|
| Surfactant W-1 | 0.04 g |
| Surfactant W-7 | 0.015 g |

In addition to the above compositions, additives F-1 to F-9 were added to all emulsion layers. Also, a gelatin hardener H-1 and surfactants W-1, W-4, W-5, and W-6 for coating and emulsification were added to each layer.

Furthermore, phenol, 1,2-benzisothiazoline-3-one, 2-phenoxyethanol, phenethyl alcohol, and p-(n)-butyl benzoate were added as antiseptic and mildewproofing agents.

TABLE 2-1

Silver iodobromide emulsions used in sample 201

| Emulsion | Characteristics | Av. ESD (μm) | COV (%) | Av. AgI content (mol %) | Structure in halide composition of silver halide grains | AgI content at grains surface (mol %) | Other characteristics (1) | (2) | (3) | (4) | (5) |
|---|---|---|---|---|---|---|---|---|---|---|---|
| A | Monodispersed tetradecahedral grains | 0.24 | 9 | 2.5 | Triple structure | 0.2 | | ○ | | | |
| B | Monodispersed (111) tabular grains Av. aspect ratio 4.0 | 0.25 | 10 | 2.5 | Quadruple structure | 1.0 | ○ | | ○ | ○ | ○ |
| C | Monodispersed (111) tabular grains Av. aspect ratio 8.0 | 0.30 | 19 | 2.5 | Triple structure | 0.1 | ○ | ○ | | ○ | ○ |
| D | Monodispersed (111) tabular grains Av. aspect ratio 8.0 | 0.35 | 21 | 2.5 | Triple structure | 1.0 | ○ | ○ | | ○ | ○ |
| E | Monodispersed (111) tabular grains Av. aspect ratio 9.0 | 0.40 | 10 | 1.5 | Quadruple structure | 1.0 | | ○ | | | |
| F | Monodispersed (111) tabular grains Av. aspect ratio 12.0 | 0.55 | 12 | 1.6 | Triple structure | 0.6 | ○ | ○ | | | ○ |
| G | Monodispersed cubic grains | 0.15 | 9 | 3.0 | Quadruple structure | 1.5 | | | ○ | | |

TABLE 2-2

Silver iodobromide emulsions used in sample 201

| Emulsion | Characteristics | Av. ESD (μm) | COV (%) | Av. AgI content (mol %) | Structure in halide composition of silver halide grains | AgI content at grains surface (mol %) | Other characteristics (1) | (2) | (3) | (4) | (5) |
|---|---|---|---|---|---|---|---|---|---|---|---|
| H | Monodispersed cubic grains | 0.24 | 12 | 3.0 | Quadruple structure | 0.9 | ○ | ○ | | ○ | |
| I | Monodispersed (111) tabular grains Av. aspect ratio 8.0 | 0.30 | 12 | 3.0 | Quintuple structure | 1.5 | ○ | ○ | | ○ | ○ |
| J | Monodispersed (111) tabular grains Av. aspect ratio 9.0 | 0.45 | 21 | 3.0 | Quadruple structure | 1.2 | ○ | ○ | | ○ | ○ |
| K | Monodispersed (111) tabular grains Av. aspect ratio 10.5 | 0.60 | 13 | 1.7 | Triple structure | 0.8 | ○ | ○ | | | ○ |
| L | Monodispersed tetradecahedral grains | 0.31 | 9 | 4.5 | Triple structure | 3.0 | | | ○ | | ○ |
| M | Monodispersed (111) tabular grains Av. aspect ratio 8.0 | 0.31 | 9 | 4.5 | Quadruple structure | 2.5 | ○ | ○ | ○ | | |
| N | Monodispersed (111) tabular grains Av. aspect ratio 8.0 | 0.33 | 13 | 2.1 | Quadruple structure | 2.0 | ○ | ○ | ○ | | |

TABLE 2-3

Silver iodobromide emulsions used in sample 201

| Emulsion | Characteristics | Av. ESD (μm) | COV (%) | Av. AgI content (mol %) | Structure in halide composition of silver halide grains | AgI content at grains surface (mol %) | Other characteristics (1) | (2) | (3) | (4) | (5) |
|---|---|---|---|---|---|---|---|---|---|---|---|
| O | Monodispersed (111) tabular grains Av. aspect ratio 9.0 | 0.43 | 9 | 2.0 | Quadruple structure | 1.0 | ○ | ○ | | ○ | ○ |
| P | Monodispersed (111) tabular grains Av. aspect ratio 10.0 | 0.75 | 21 | 2.0 | Triple structure | 0.5 | ○ | ○ | | | ○ |
| Q | Monodispersed (111) tabular grains Av. aspect ratio 12.0 | 0.90 | 8 | 1.0 | Quadruple structure | 0.3 | ○ | ○ | | | ○ |

Av. ESD = Equivalent sphere average grain size; COV = Coefficient of variation
(Other characteristics)
The mark "○" means each of the conditions set forth below is satisfied.
(1) A reduction sensitizer was added during grain formation;
(2) A selenium sensitizer was used as an after-ripening agen;
(3) A rhodium salt was added during grain formation;
(4) A shell was provided subsequent to after-ripening by using silver nitrate in an amount of 10%, in terms of silver molar ratio, of the emulsion grains at that time, together with the equimolar amount of potassium bromide; and
(5) The presence of dislocation lines in an average number of ten or more per grain was observed by a transmission electron microscope.
Note that all the lightsensitive emulsion were after-ripped by the use of sodium thiosulfate, sodium thiocyanate, and sodium aurichloride.
Note, also, a iridium salt was added during grain formation.
Note, also, that chemically-modified gelatin whose amino groups were partially converted to phthalic acid amide, was added to emulsions B, C, E, H, J, N, and Q.

TABLE 3-1

| Emulsion | Spectral sensitizer added | Addition amount per mol of silver halide (g) | Timing of the addition of the spectral sensitizer |
|---|---|---|---|
| A | S-1 | 0.01 | Subsequent to after-ripening |
| | S-2 | 0.35 | Before after-ripening |
| | S-3 | 0.02 | " |
| | S-8 | 0.03 | " |
| | S-13 | 0.015 | " |
| | S-14 | 0.01 | " |
| B | S-2 | 0.35 | Before after-ripening |
| | S-3 | 0.02 | " |
| | S-8 | 0.03 | " |
| | S-13 | 0.015 | " |
| | S-14 | 0.01 | " |
| C | S-2 | 0.45 | Before after-ripening |
| | S-8 | 0.04 | " |
| | S-13 | 0.02 | " |
| D | S-2 | 0.5 | Subsequent to after-ripening |
| | S-3 | 0.05 | " |
| | S-8 | 0.05 | Before after-ripening |
| | S-13 | 0.015 | " |
| E | S-1 | 0.01 | Before after-ripening |
| | S-2 | 0.45 | " |
| | S-8 | 0.05 | " |
| | S-13 | 0.01 | Subsequent to after-ripening |
| F | S-2 | 0.4 | Before after-ripening |
| | S-3 | 0.04 | " |
| | S-8 | 0.04 | " |
| G | S-4 | 0.3 | Subsequent to after-ripening |
| | S-5 | 0.05 | " |
| | S-12 | 0.1 | " |
| H | S-4 | 0.2 | Before after-ripening |
| | S-5 | 0.05 | Subsequent to after-ripening |
| | S-9 | 0.15 | Before after-ripening |
| | S-14 | 0.02 | Subsequent to after-ripening |

TABLE 3-2

| Emulsion | Spectral sensitizer added | Addition amount per mol of silver halide (g) | Timing of the addition of the spectral sensitizer |
|---|---|---|---|
| I | S-4 | 0.3 | Before after-ripening |
| | S-9 | 0.2 | " |
| | S-12 | 0.1 | " |
| J | S-4 | 0.35 | Before after-ripening |
| | S-5 | 0.05 | Subsequent to after-ripening |
| | S-12 | 0.1 | Before after-ripening |
| K | S-4 | 0.3 | Before after-ripening |
| | S-9 | 0.05 | " |
| | S-12 | 0.1 | " |
| | S-14 | 0.02 | " |
| L, M | S-6 | 0.1 | Subsequent to after-ripening |
| | S-10 | 0.2 | " |
| | S-11 | 0.05 | " |
| N | S-6 | 0.05 | Subsequent to after-ripening |
| | S-7 | 0.05 | " |
| | S-10 | 0.25 | " |
| | S-11 | 0.05 | " |
| O | S-10 | 0.4 | Subsequent to after-ripening |
| | S-11 | 0.15 | " |
| P | S-6 | 0.05 | Subsequent to after-ripening |
| | S-7 | 0.05 | " |
| | S-10 | 0.3 | Before after-ripening |
| | S-11 | 0.1 | " |
| Q | S-6 | 0.05 | Before after-ripening |
| | S-7 | 0.05 | " |
| | S-10 | 0.2 | " |
| | S-11 | 0.25 | " |

CP-1
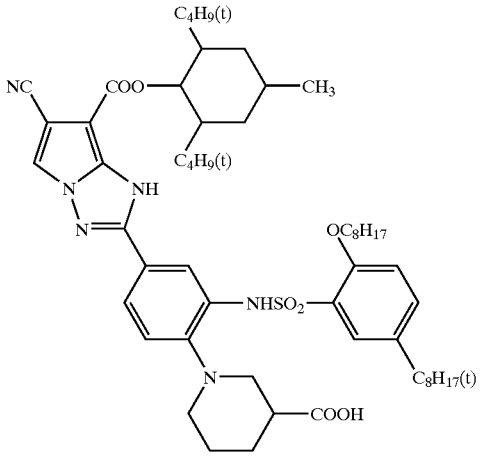
CP-2
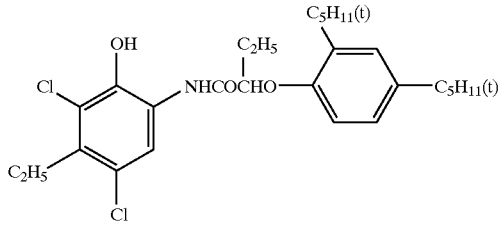
CP-3
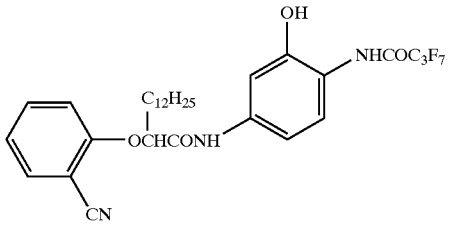
CP-4
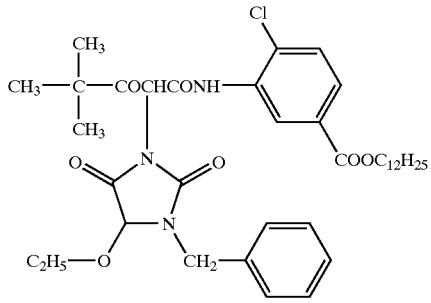
CP-5
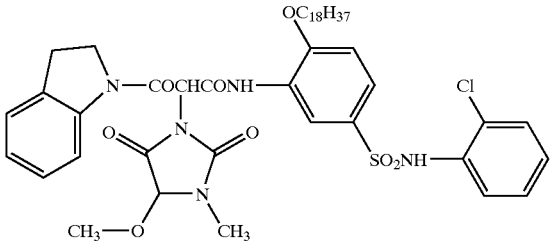
CP-6
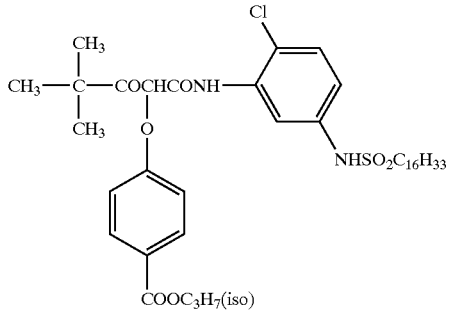
CP-7
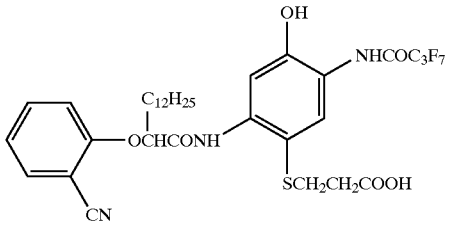
CP-8
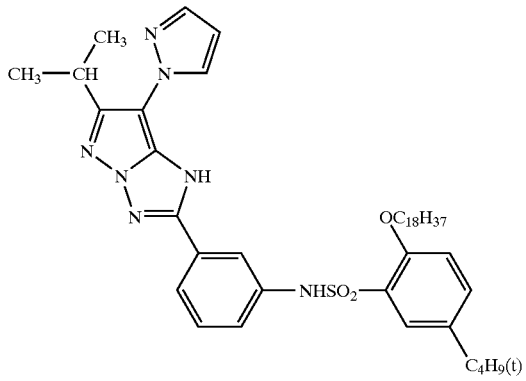
Tri-n-hexyl-phosphate
Oil-2
Oil-3
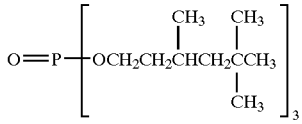

-continued
Oil-4
Tricyclohexyl phosphate
Oil-5
Bis (2-ethylhexyl) sccucinate
Oil-6
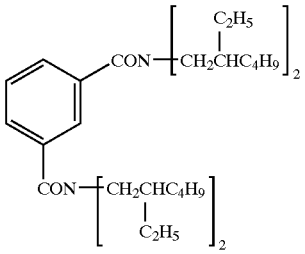
Oil-7
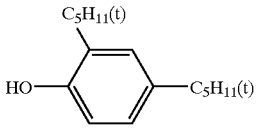
Oil-9
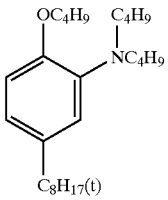
Oil-10
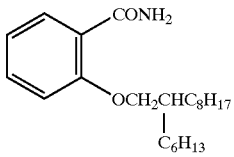
Cpd-A
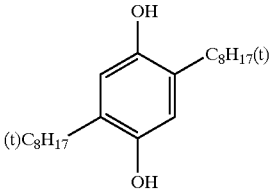
Cpd-B
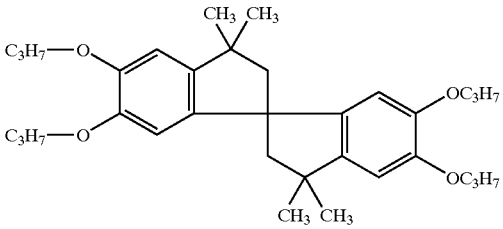
Cpd-C
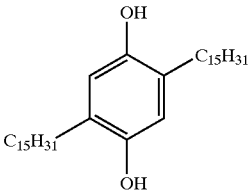
Cpd-D
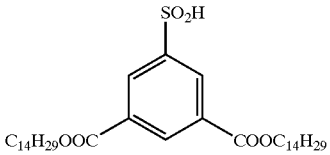
Cpd-E
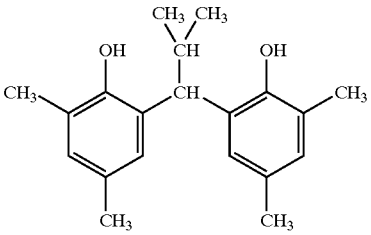
Cpd-F
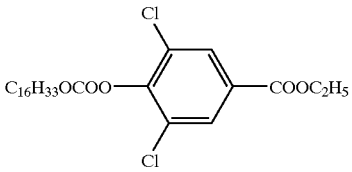
Cpd-G
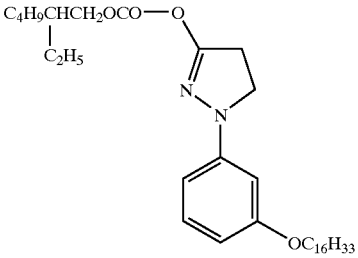
Cpd-H
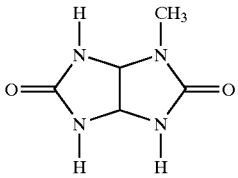

-continued
Cpd-I
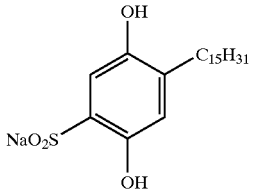
Cpd-J
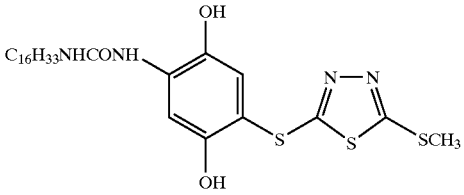
Cpd-K
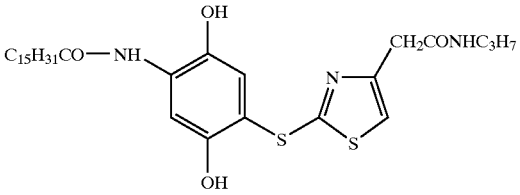
Cpd-M
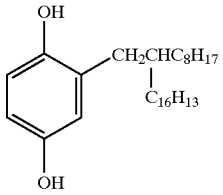
Cpd-N
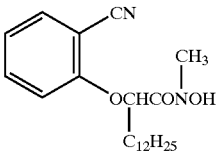
Cpd-O
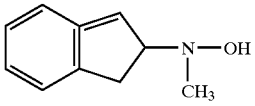
Cpd-P
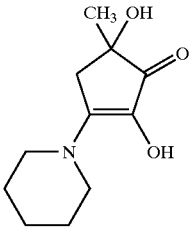
Cpd-Q
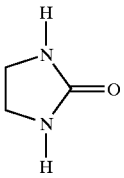
Cpd-R
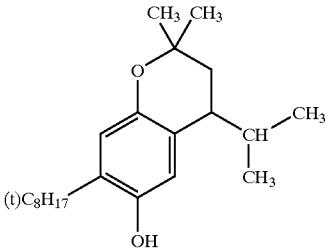
Cpd-S
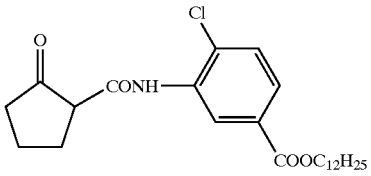
U-1
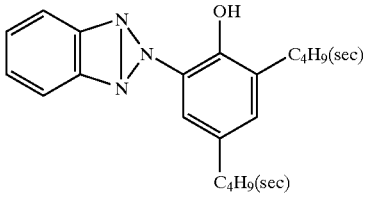
U-2
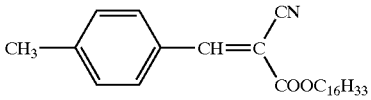
U-3
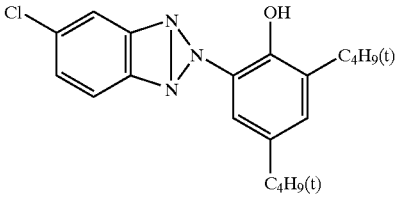
U-4
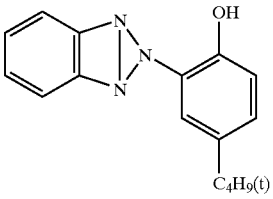

-continued
U-5
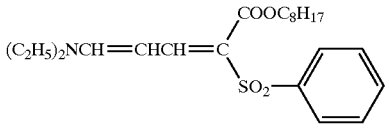
U-6
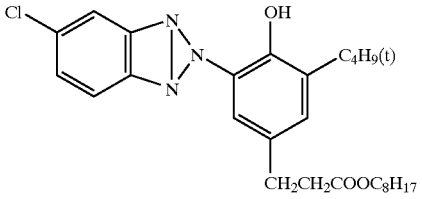
S-1
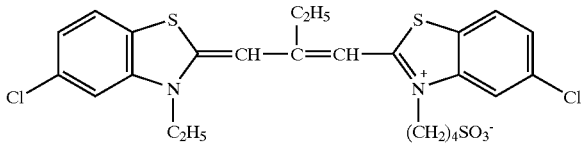
S-2
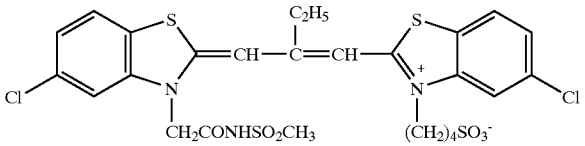
S-3
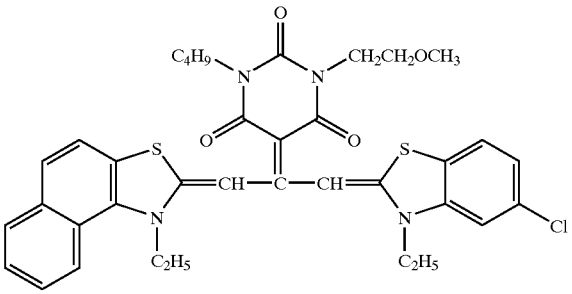
S-4
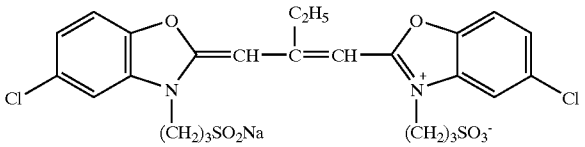
S-5
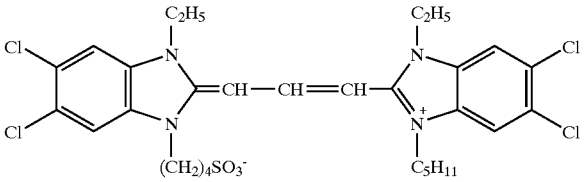
S-6
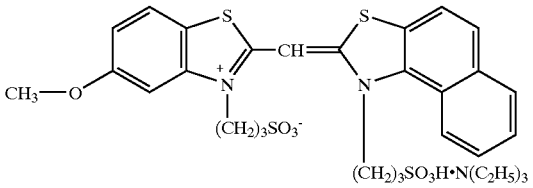
S-7
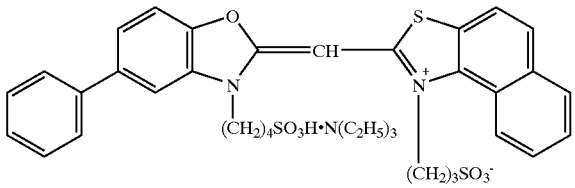
S-8
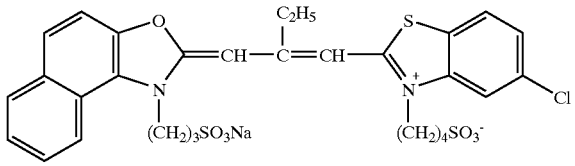
S-9
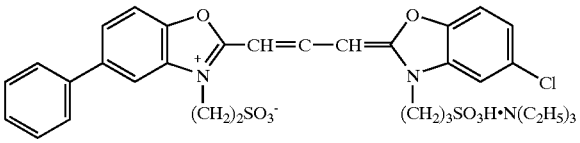
S-10
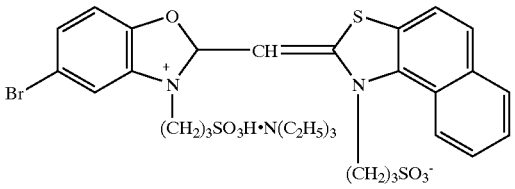
S-11
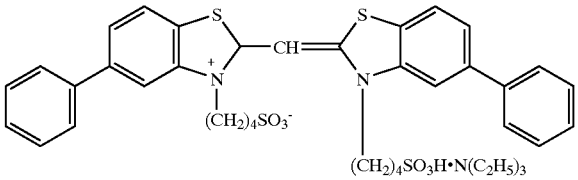
S-12
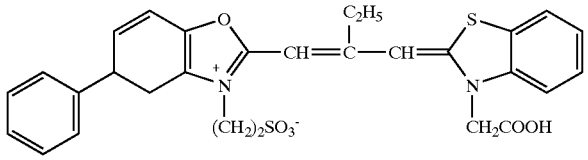

-continued
S-13
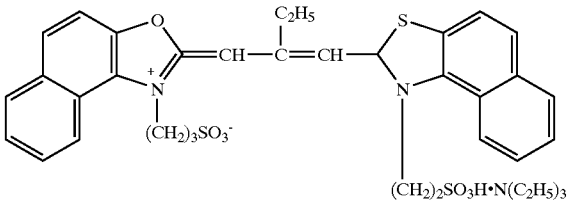
S-14
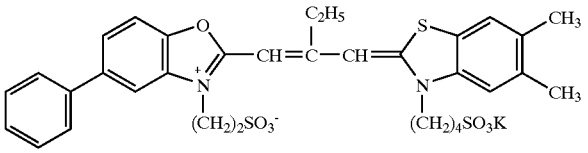
D-1
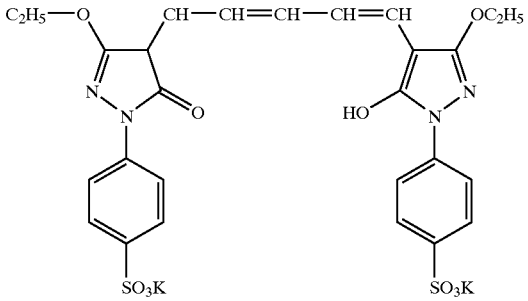
D-2
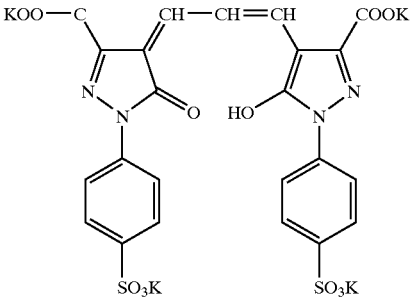
D-3
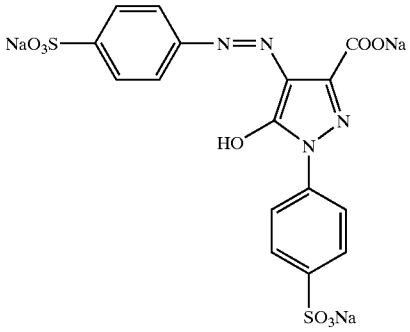
D-4
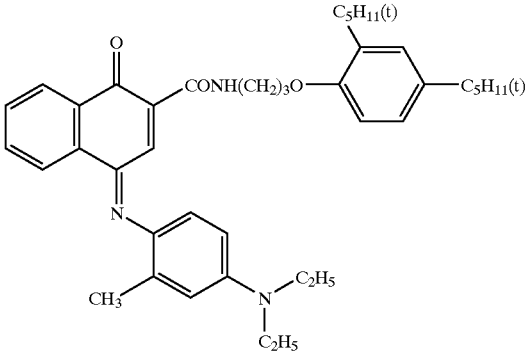
D-5
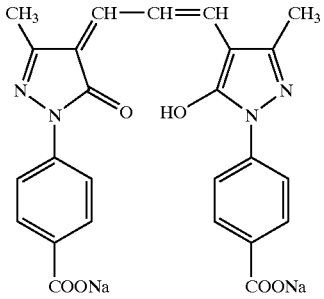
D-7
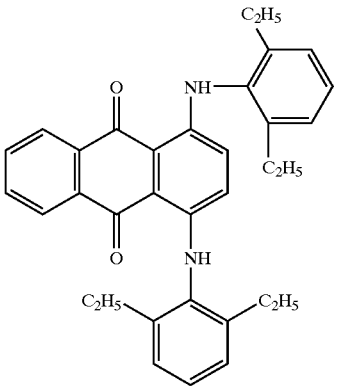
D-8
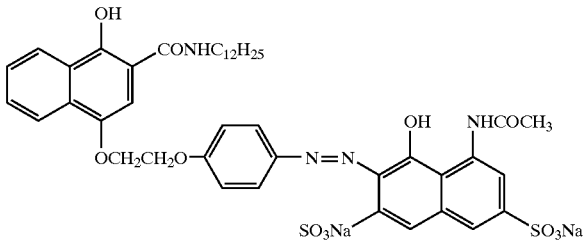
D-9
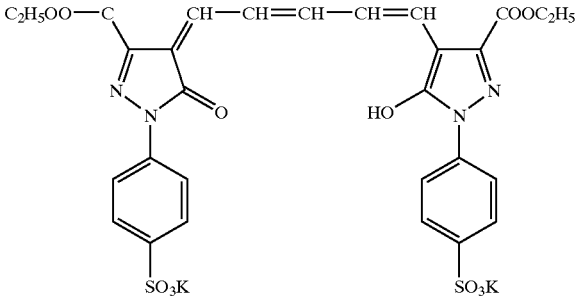

-continued
D-10
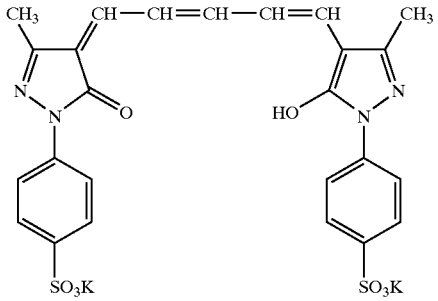
E-1
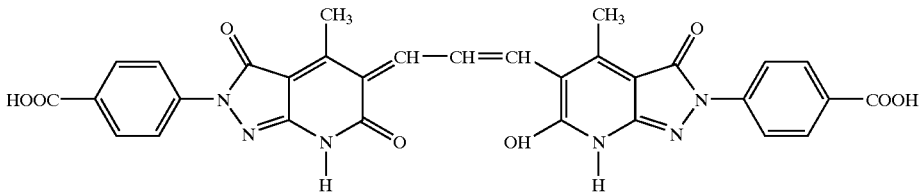
E-2
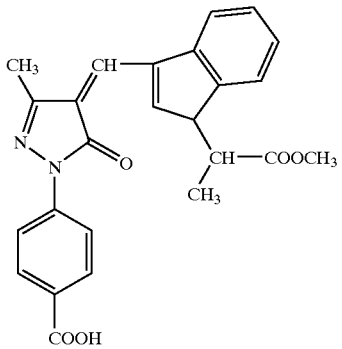
H-1
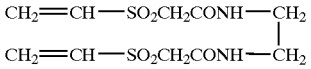
W-1
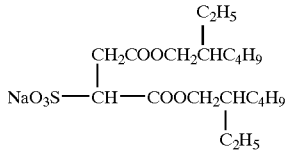
W-2
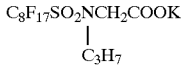
W-3
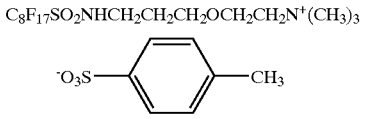
W-4
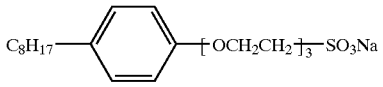
W-5
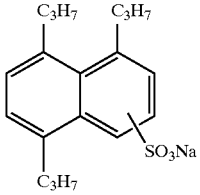
W-6
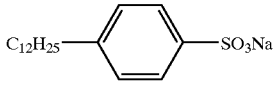
W-7
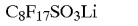
P-1
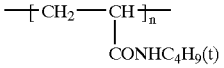
n = 100–1000

-continued
P-2
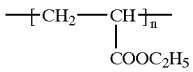
n = 100–1000
P-3
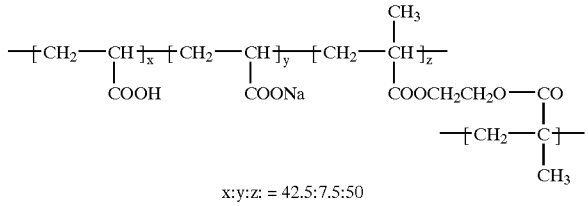
x:y:z: = 42.5:7.5:50
P-4
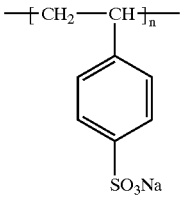
n=100–1000
F-1
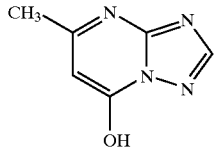
F-2
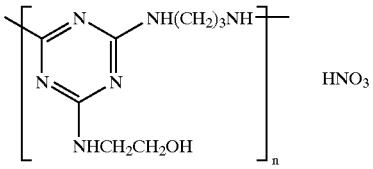
n = 3–4
F-3
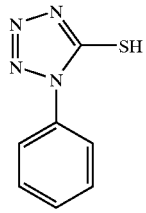
F-4
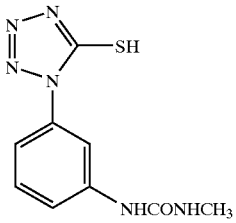
F-5
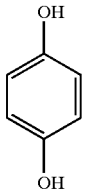
F-6
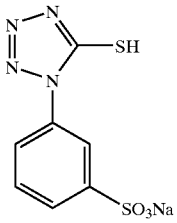
F-7
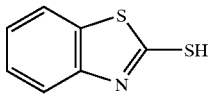
F-8
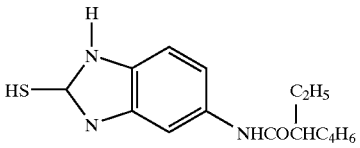
F-9
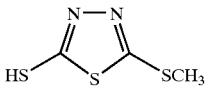
SO-1
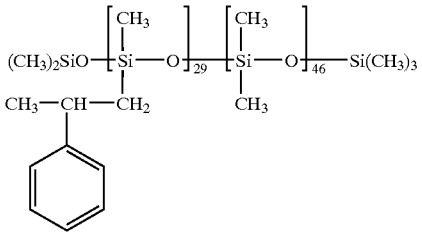

Preparation of fine crystalline solid dispersion of organic dye:

Preparation of Fine Crystalline Solid Dispersion of Dye E-1

Water and 100 g of Pluronic F88 (trade name for ethylene oxide/propylene oxide block copolymer) produced by BASF were added to a wet cake of dye E-1 (containing 270 g of dye E-1 in net weight), and agitated, thereby obtaining 4000 g of a slurry. Subsequently, 1700 mL of zirconia beads having an average grain diameter of 0.5 mm were charged into Ultraviscomill (UVM-2) manufactured by Aimex Co., Ltd. and the slurry was milled at a peripheral speed of 10 m/sec and a delivery of 0.5 L/min for 2 hr. The beads were removed by filtration, and the slurry was diluted with water into a dye concentration of 3%. The dilution was heated at 90° C. for 10 hr for stabilization. The obtained dye fine particles had an average particle diameter of 0.30 $\mu$m and a particle diameter distribution breadth (standard deviation of particle diameters×100/average particle diameter) of 20%.

Preparation of Microcrystalline Solid Dispersion of Dye E-2

Water and 270 g of W-4 were added to 1400 g of a wet cake of dye E-2 containing 30% by weight of water, and agitated, thereby obtaining a slurry of 40% by weight E-2 concentration. Subsequently, 1700 mL of zirconia beads having an average grain diameter of 0.5 mm were charged into a pulverizer, namely, Ultraviscomill (UVM-2) manufactured by Aimex Co., Ltd., and the slurry was milled at a peripheral speed of 10 m/sec and a delivery of 0.5 L/min for 8 hr. Thus, a solid fine particle dispersion of dye E-2 was obtained. This dispersion was diluted with ion-exchanged water to a concentration of 20% by weight. Thus, a microcrystalline solid dispersion was obtained. The average particle diameter thereof was 0.15 $\mu$m.

Preparation of Samples 202 to 250

Samples 202 to 237 were prepared in the same manner as sample 201, except that the couplers of 9th to 11th green-sensitive emulsion layers of the sample 201 were changed to equimolar amounts of couplers specified in Table 4.

Samples 238 to 250 were prepared in the same manner as in the preparation of samples 201, 203, 205, 207, 208 209, 213, 218, 224, 228, 230, 231 and 236, respectively, except that Compound SR-1 was removed from the 9th to 11th layers.

The color-forming property, photographic speed and yellow stain of each of the thus obtained samples 201 to 250 were evaluated in the same manner as in Example 1. In Example 2, the maximum color formation density of each color image density, namely, cyan density magenta density or yellow density and the photographic speed were determined. The results are listed in Tables 5-1 and 5-2.

TABLE 4-1

| | 9th layer | | 10th and 11th layers | |
|---|---|---|---|---|
| Sample No. | Magenta coupler | Oil/coupler ratio (wt./wt.) | Magenta coupler | Oil/coupler ratio (wt./wt.) |
| 201 (Comp.) | Comparative coupler A | 0.3 | Comparative coupler A | 0.3 |
| 202 (Comp.) | Comparative coupler B | 0.3 | Comparative coupler B | 0.3 |
| 203 (Comp.) | Comparative coupler B | 0.1 | Comparative coupler B | 0.1 |
| 204 (Comp.) | Comparative coupler C | 0.3 | Comparative coupler C | 0.3 |
| 205 (Comp.) | Comparative coupler C | 0.1 | Comparative coupler C | 0.1 |
| 206 (Comp.) | Comparative coupler D | 0.3 | Comparative coupler D | 0.3 |
| 207 (Comp.) | Comparative coupler D | 0.1 | Comparative coupler D | 0.1 |
| 208 (Inv.) | MA-1 | 0.1 | MA-1 | 0.1 |
| 209 (Inv.) | MA-7 | 0.1 | MA-7 | 0.1 |
| 210 (Inv.) | MA-11 | 0.1 | MA-11 | 0.1 |
| 211 (Inv.) | MA-13 | 0.1 | MA-13 | 0.1 |
| 212 (Inv.) | MA-26 | 0.1 | MA-26 | 0.1 |
| 213 (Inv.) | MA-90 | 0.1 | MA-90 | 0.1 |
| 214 (Inv.) | MA-113 | 0.1 | MA-113 | 0.1 |
| 215 (Inv.) | MA-116 | 0.1 | MA-116 | 0.1 |
| 216 (Inv.) | MA-117 | 0.1 | MA-117 | 0.1 |
| 217 (Inv.) | MA-144 | 0.1 | MA-144 | 0.1 |
| 218 (Inv.) | MA-13 | 0.1 | MA-64 | 0.1 |
| 219 (Inv.) | MA-13 | 0.1 | MA-70 | 0.1 |
| 220 (Inv.) | MA-13 | 0.1 | MA-71 | 0.1 |

TABLE 4-2

| | 9th layer | | 10th and 11th layers | |
|---|---|---|---|---|
| Sample No. | Magenta coupler | Oil/coupler ratio (wt./wt.) | Magenta coupler | Oil/coupler ratio (wt./wt.) |
| 221 (Inv.) | MA-13 | 0.1 | MA-104 | 0.1 |
| 222 (Inv.) | MA-13 | 0.1 | MA-127 | 0.1 |
| 223 (Inv.) | M-1 | 0.1 | M-1 | 0.1 |
| 224 (Inv.) | M-8 | 0.1 | M-8 | 0.1 |
| 225 (Inv.) | M-16 | 0.1 | M-16 | 0.1 |
| 226 (Inv.) | M-18 | 0.1 | M-18 | 0.1 |
| 227 (Inv.) | M-31 | 0.1 | M-31 | 0.1 |
| 228 (Inv.) | M-38 | 0.1 | M-38 | 0.1 |
| 229 (Inv.) | M-46 | 0.1 | M-46 | 0.1 |
| 230 (Inv.) | M-50 | 0.1 | M-50 | 0.1 |
| 231 (Inv.) | M-51 | 0.1 | M-51 | 0.1 |
| 232 (Inv.) | M-65 | 0.1 | M-65 | 0.1 |
| 233 (Inv.) | M-69 | 0.1 | M-69 | 0.1 |
| 234 (Inv.) | M-83 | 0.1 | M-83 | 0.1 |
| 235 (Inv.) | M-99 | 0.1 | M-99 | 0.1 |
| 236 (Inv.) | M-50 | 0.1 | M-101 | 0.1 |
| 237 (Inv.) | M-101 | 0.1 | M-101 | 0.1 |

TABLE 5

| | Color-forming property (Dmax) | | | Speed | | | |
|---|---|---|---|---|---|---|---|
| Sample No. | Cyan Color image | Magenta color image | Yellow color image | Cyan color image | Magenta color image | Yellow color image | Yellow stain |
| 201 | 3.37 | 3.47 | 3.71 | 100 | 100 | 100 | 0.35 |
| 202 | 3.15 | 3.65 | 3.72 | 98 | 101 | 100 | 0.28 |
| 203 | 3.09 | 2.31 | 3.73 | 99 | 103 | 100 | 0.21 |
| 204 | 3.18 | 3.32 | 3.77 | 99 | 98 | 100 | 0.30 |
| 205 | 3.08 | 2.20 | 3.78 | 99 | 105 | 101 | 0.28 |
| 206 | 3.06 | 3.65 | 3.78 | 100 | 88 | 100 | 0.16 |
| 207 | 3.38 | 2.88 | 3.80 | 101 | 95 | 101 | 0.12 |
| 208 | 3.42 | 3.64 | 3.78 | 100 | 103 | 101 | 0.13 |
| 209 | 3.44 | 3.63 | 3.76 | 99 | 101 | 100 | 0.13 |
| 210 | 3.43 | 3.66 | 3.75 | 101 | 101 | 100 | 0.13 |
| 211 | 3.43 | 3.65 | 3.71 | 101 | 100 | 101 | 0.12 |
| 212 | 3.43 | 3.64 | 3.72 | 101 | 101 | 100 | 0.12 |
| 213 | 3.45 | 3.64 | 3.76 | 100 | 100 | 100 | 0.13 |
| 214 | 3.45 | 3.64 | 3.76 | 100 | 100 | 100 | 0.13 |
| 215 | 3.44 | 3.65 | 3.75 | 101 | 100 | 100 | 0.13 |
| 216 | 3.43 | 3.64 | 3.76 | 100 | 101 | 101 | 0.13 |
| 217 | 3.44 | 3.65 | 3.76 | 100 | 100 | 101 | 0.13 |
| 218 | 3.44 | 3.66 | 3.76 | 101 | 97 | 100 | 0.11 |
| 219 | 3.45 | 3.67 | 3.77 | 100 | 97 | 101 | 0.12 |
| 220 | 3.43 | 3.67 | 3.76 | 99 | 97 | 101 | 0.12 |
| 221 | 3.44 | 3.67 | 3.76 | 99 | 96 | 101 | 0.11 |
| 222 | 3.45 | 3.66 | 3.77 | 100 | 96 | 100 | 0.12 |
| 223 | 3.45 | 3.68 | 3.80 | 100 | 102 | 101 | 0.13 |
| 224 | 3.42 | 3.67 | 3.78 | 99 | 103 | 100 | 0.12 |
| 225 | 3.46 | 3.65 | 3.77 | 100 | 101 | 100 | 0.11 |

TABLE 5-2

| | Color-forming property (Dmax) | | | Speed | | | |
|---|---|---|---|---|---|---|---|
| Sample No. | Cyan Color image | Magenta color image | Yellow color image | Cyan color image | Magenta color image | Yellow color image | Yellow stain |
| 226 | 3.46 | 3.65 | 3.78 | 100 | 101 | 100 | 0.12 |
| 227 | 3.45 | 3.65 | 3.78 | 100 | 102 | 100 | 0.11 |
| 228 | 3.45 | 3.63 | 3.76 | 101 | 101 | 100 | 0.10 |
| 229 | 3.46 | 3.65 | 3.78 | 99 | 101 | 100 | 0.10 |
| 230 | 3.40 | 3.67 | 3.80 | 99 | 101 | 101 | 0.10 |
| 231 | 3.44 | 3.66 | 3.80 | 101 | 100 | 101 | 0.10 |
| 232 | 3.45 | 3.67 | 3.78 | 101 | 101 | 100 | 0.10 |
| 233 | 3.45 | 3.66 | 3.77 | 99 | 102 | 100 | 0.11 |
| 234 | 3.44 | 3.67 | 3.78 | 99 | 102 | 101 | 0.10 |
| 235 | 3.40 | 3.68 | 3.77 | 99 | 102 | 101 | 0.11 |
| 236 | 3.40 | 3.65 | 3.77 | 100 | 99 | 100 | 0.10 |
| 237 | 3.41 | 3.68 | 3.78 | 101 | 95 | 100 | 0.10 |
| 238 | 3.38 | 3.46 | 3.71 | 100 | 100 | 100 | 0.38 |
| 239 | 3.11 | 2.30 | 3.74 | 99 | 103 | 100 | 0.25 |
| 240 | 3.10 | 2.20 | 3.78 | 99 | 105 | 101 | 0.30 |
| 241 | 3.38 | 2.87 | 3.80 | 101 | 95 | 101 | 0.17 |
| 242 | 3.43 | 3.63 | 3.78 | 101 | 101 | 100 | 0.15 |
| 243 | 3.45 | 3.62 | 3.77 | 100 | 100 | 102 | 0.15 |
| 244 | 3.46 | 3.62 | 3.76 | 101 | 100 | 100 | 0.14 |
| 245 | 3.46 | 3.64 | 3.76 | 101 | 97 | 102 | 0.12 |
| 246 | 3.43 | 3.65 | 3.79 | 99 | 103 | 100 | 0.15 |
| 247 | 3.45 | 3.63 | 3.76 | 101 | 101 | 100 | 0.12 |
| 248 | 3.40 | 3.65 | 3.80 | 99 | 101 | 101 | 0.12 |
| 249 | 3.44 | 3.66 | 3.80 | 101 | 100 | 101 | 0.12 |
| 250 | 3.40 | 3.65 | 3.77 | 100 | 99 | 100 | 0.11 |

It is apparent from the results of Tabled 5-1 and 5-2 that the sample 201 containing comparative coupler A, although the color formation density is high, as in Example 1, exhibits high occurrence of yellow stain in heat and humidity atmosphere. The samples 202 and 203 containing comparative coupler B suffer extensive fluctuation of magenta Dmax depending on the amount of oil, are poor in the balance with cyan and yellow color formation densities, and causes a color tint change. It is also apparent that the samples 204 and 205 containing comparative coupler C exhibit low maximum color formation density in oilless condition, are poor in the balance with cyan and yellow color formation densities, and cause a color tint change.

It has been shown that the samples 206 and 207 containing comparative coupler D cause similar color tint changes. By contrast, the samples 208 to 235 of the present invention are free from these problems and hence attain the objects of the present invention. It has further been shown that, although the sample 237 of the present invention exhibits relatively low photographic speed for magenta images and causes a color tint shift from other color images, the use of, for example, sample 236, can suppress such a color tint shift.

Furthermore, the dependence on pH of color developer and the dependence on addition amount of color developing agent were evaluated in the same manner as in Example 1. It has been shown that the samples 208 to 237 and 242 to 243 of the present invention exert excellent advantages.

It has also been shown that the samples 238 to 250 wherein Compound SR-1 was removed from the 9th to 11th layers exhibit extensive yellow stain as compared with that of the corresponding samples containing Compound SR-1 without exception, thereby attesting to the effect of Compound SR-1 on the inhibition of yellow stain.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photosensitive material comprising a 1H-pyrazolo[3,2-c]1,2,4-triazole coupler represented by the following formula (VIII):

(VIII)

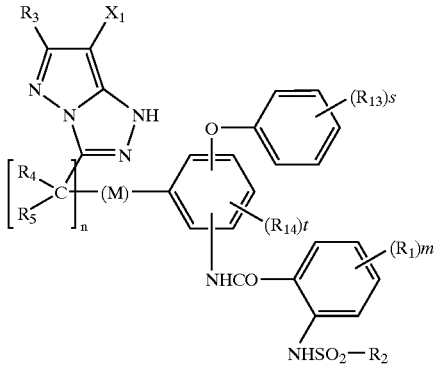

wherein $R_1$ represents a substitutent; m represents an integer of 0 to 4; $R_2$ represents an alkyl group, alkenyl group or aryl group; $R_3$ represents a substituent; $X_1$ represents a hydrogen atom or a group capable of splitting-off upon reaction with an oxidized developing agent; $R_4$ and $R_5$ each independently represents a hydrogen atom, alkyl group, of aryl group; and n represents an integer of 1 to 3; M represents —O—, —S—, —SO—, —$SO_2$—, —C(=O)O—, —OC(=O), —C(=O)N($R_6$)—, —N($R_6$)C(=O)—, —$SO_2$N($R_6$)—, —N($R_6$)$SO_2$—, —C($R_6$)C(=O)N($R_7$)—, —N($R_6$)C(=O)O— or —OC(=O)N($R_6$)—, wherein $R_6$ and $R_7$ each independently represents a hydrogen atom, alkyl group or aryl group; R13 and R14 each independently represents a substitutent; s represents an integer of 0 to 5; and t represents an integer of 0 to 3.

2. The silver halide color photosensitive material according to claim 1 further comprising the following compound SR-1:

(SR-1)

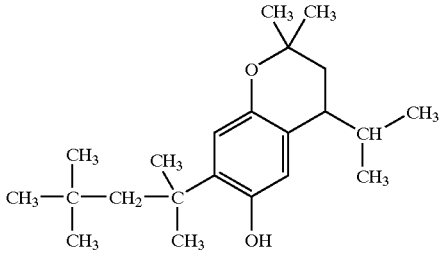

3. A silver halide color photosensitive material comprising a coupler represented by the following general formula (II):

(II)

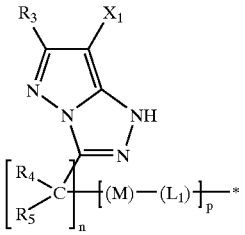

wherein $R_3$ represents tertiary alkyl group; $X_1$ represents a hydrogen atom; $R_4$ represents a hydrogen atom or a methyl group; $R_5$ represents a methyl group; n represents an integer of 1 to 2; M represents OC(=O)—, —N($R_6$)C(=O)—, or —N($R_6$)$SO_2$—, wherein $R_6$ represents a hydrogen atom; $L_1$ represents an alkylene group, p represents 0 or 1; * represents the position at which a group represented by the general formula (I) is attached (I)

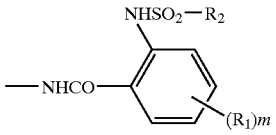

wherein $R_1$ represents a substitutent; m represents 0 and $R_2$ represents an alkyl group or aryl group.

4. The silver halide color photosensitive material according to claim 3 further comprising the following compound SR-1:

(SR-1)

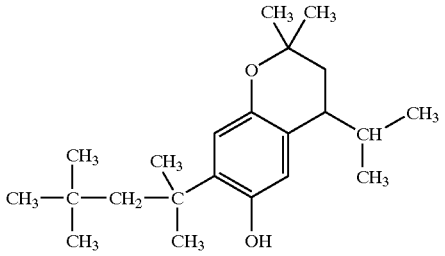

5. A silver halide color photosensitive material comprising at least one coupler represented by the following general formula (III) or general formula (IV):

(III)

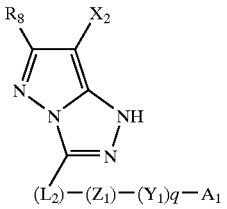

(IV)

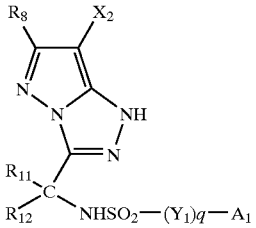

wherein $R_8$ represents a substituent; $X_2$ represents a hydrogen atom or a group capable of splitting-off upon reaction with an oxidized developing agent; $L_2$ represents an alkylene group or aralkylene group; $Z_1$ represents —N($R_9$)C(=O)—, —N($R_9$)C(=O)O—, —N($R_9$)C(=O)N($R_{10}$)—, —OC(=O)—, OC(=O)N($R_9$)—, —C(=O)N($R_9$)— or —C(=O)O—, wherein R9 and R10 each independently represents a hydrogen atom, alkyl group or aryl group; $Y_1$ represents a divalent linking group; q represents 0 or 1; $R_{11}$ and $R_{12}$ each independently represents a hydrogen atom, alkyl group or aryl group, and $A_1$ represents a group represented by the following general formula (V) or a group having a group represented by the following general formula (V):

(V)

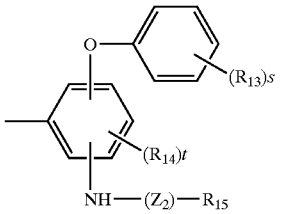

wherein $R_{13}$ and $R_{14}$ each independently represents a substituent; s represents an integer of 0 to 5; t represents an integer of 0 to 3; $R_{15}$ represents an alkyl group or aryl group; and $Z_2$ represents —C(=O)—, —C(=O)O—, —C(=O)N($R_{16}$)—, —$SO_2$— or —$SO_2$N($R_{16}$)—, wherein $R_{16}$ represents hydrogen atom, alkyl group or aryl group.

6. The silver halide color photosensitive material according to claim 5, wherein $L_2$ in the general formula (III) is represented by the following general formula (VI):

(VI)

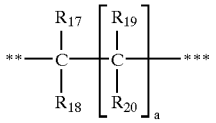

wherein $R_{17}$, $R_{18}$, $R_{19}$ and $R_{20}$ each independently represents a hydrogen atom, alkyl group or aryl group; a represents an integer of 0 to 2;  represents a position at which $L_2$ attaches to the pyrazolotriazole skeleton of the coupler represented by the general formula (III); and * represents a position to which $Z_1$ in the general formula (III) attaches.

7. The silver halide color photosensitive material according to claim 6, wherein the group represented by $A_1$ in the general formula (III) and general formula (IV) is represented by the following general formula (VII):

(VII)

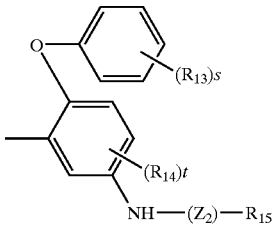

wherein $R_{13}$ and $R_{14}$ each independently represents a substituent, s represents an integer of 0 to 5; t represents an integer of 0 to 3; $R_{15}$ represents an alkyl group or aryl group; and $Z_2$ represents —C(=O)—, —C(=O)O—, —C(=O)N($R_{16}$)—, —$SO_2$— or —$SO_2$N($R_{16}$) wherein $R_{16}$ represents a hydrogen atom, alkyl group or aryl group.

8. The silver halide color photosensitive material according to claim 7, wherein the substituent represented by $R_3$ is a tertiary alkyl group.

9. The silver halide color photosensitive material according to claim 7, wherein $X_1$ represents a hydrogen atom.

10. The silver halide color photosensitive material according to claim 7 further comprising the following compound SR-1:

(SR-1)

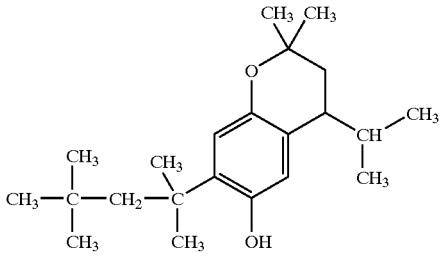

11. The silver halide color photosensitive material according to claim 5, wherein the group represented by $A_1$ in the general formula (III) and general formula (IV) is represented by the following general formula (VII):

(VII)

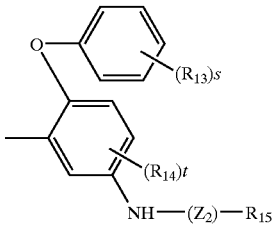

wherein $R_{13}$ and $R_{14}$ each independently represents a substituent, s represents an integer of 0 to 5; t represents an integer of 0 to 3; $R_{15}$ represents an alkyl group or aryl group; and $Z_2$ represents —C(=O)—, —C(=O)O—, —C(=O)N($R_{16}$)—, —$SO_2$— or —$SO_2$N($R_{16}$)—, wherein $R_{16}$ represents hydrogen atom, alkyl group or aryl group.

12. The silver halide color photosensitive material according to claim 5, wherein the substituent represented by $R_8$ of the general formula (III) and general formula (IV) is a tertiary alkyl group.

13. The silver halide color photosensitive material according to claim 5, wherein $X_2$ in the general formula (III) and general formula (IV) represents a hydrogen atom.

14. The silver halide color photosensitive material according to claim 5 further comprising the following compound SR-1:

(SR-1)

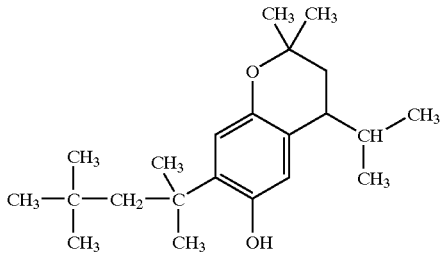

* * * * *